US007409171B2

(12) United States Patent
Maeda et al.

(10) Patent No.: US 7,409,171 B2
(45) Date of Patent: Aug. 5, 2008

(54) IMAGE FORMING APPARATUS AND METHOD HAVING AN INTERMEDIATE TRANSFER MEMBER WITH A MULTILAYER STRUCTURE THAT PREVENTS ABNORMAL IMAGES DUE TO ABNORMAL DISCHARGES

(75) Inventors: Masahiro Maeda, Nagano (JP); Yoichi Yamada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 374 days.

(21) Appl. No.: 11/195,352

(22) Filed: Aug. 1, 2005

(65) Prior Publication Data

US 2006/0024074 A1 Feb. 2, 2006

(30) Foreign Application Priority Data

| | | |
|---|---|---|
| Aug. 2, 2004 | (JP) | 2004-225699 |
| Aug. 2, 2004 | (JP) | 2004-225700 |
| Aug. 2, 2004 | (JP) | 2004-225701 |
| Aug. 2, 2004 | (JP) | 2004-225702 |
| Aug. 2, 2004 | (JP) | 2004-225703 |
| Aug. 2, 2004 | (JP) | 2004-225704 |

(51) Int. Cl.
*G03G 15/02* (2006.01)
*G03G 15/16* (2006.01)

(52) U.S. Cl. ..... 399/50; 399/66

(58) Field of Classification Search ..... 399/43, 399/44, 50, 66, 49, 302, 308, 314, 46, 55, 399/56

See application file for complete search history.

(56) References Cited

U.S. PATENT DOCUMENTS

| | | | | |
|---|---|---|---|---|
| 4,285,025 A | | 8/1981 | Nishikawa | 361/230 |
| 5,552,861 A | * | 9/1996 | Mizude et al. | 399/50 |
| 5,887,218 A | * | 3/1999 | Yuu et al. | 399/44 |
| 5,966,561 A | | 10/1999 | Yamaguchi | |
| 6,144,817 A | | 11/2000 | Takeuchi et al. | |
| 6,226,469 B1 | | 5/2001 | Suzuki et al. | |
| 6,904,245 B2 | * | 6/2005 | Mochizuki et al. | 399/49 |
| 2001/0046388 A1 | | 11/2001 | Inoue et al. | 399/44 |
| 2003/0081959 A1 | | 5/2003 | Komori | 399/50 |

FOREIGN PATENT DOCUMENTS

| | | | |
|---|---|---|---|
| JP | 62-059980 | | 3/1987 |
| JP | 05080648 A | * | 4/1993 |
| JP | 06089054 A | * | 3/1994 |
| JP | 08-030070 | | 2/1996 |
| JP | 09-006067 | | 1/1997 |

(Continued)

*Primary Examiner*—Robert Beatty
(74) *Attorney, Agent, or Firm*—Hogan & Hartson LLP

(57) ABSTRACT

An image forming apparatus includes an image carrier, a charging unit configured to charge the image carrier, an exposing unit configured to form an electrostatic latent image on the charged image carrier, a developing unit configured to develop the electrostatic latent image formed on the image carrier with a development material for forming a development image, an intermediate transfer member that includes a multilayer structure having a conductive layer;

a transfer unit configured to transfer the development image on the intermediate transfer member, and a control unit that controls a transfer potential and a charging potential so that a potential difference between the transfer potential and a non-image portion potential on the image carrier in a transfer position falls within a predetermined range.

45 Claims, 25 Drawing Sheets

FOREIGN PATENT DOCUMENTS

| | | | | |
|---|---|---|---|---|
| JP | 09-222775 | | | 8/1997 |
| JP | 11-109689 | | | 4/1999 |
| JP | 11-153910 | | | 6/1999 |
| JP | 11-231583 | | | 8/1999 |
| JP | 2000-147849 | | | 5/2000 |
| JP | 2002-357939 | | | 12/2002 |
| JP | 2003-215862 | | | 7/2003 |
| JP | 2003215864 | A | * | 7/2003 |
| JP | 2003-323012 | | | 11/2003 |
| JP | 2003-337479 | | | 11/2003 |
| JP | 2004-109703 | | | 4/2004 |
| JP | 2004-177437 | | | 6/2004 |

* cited by examiner

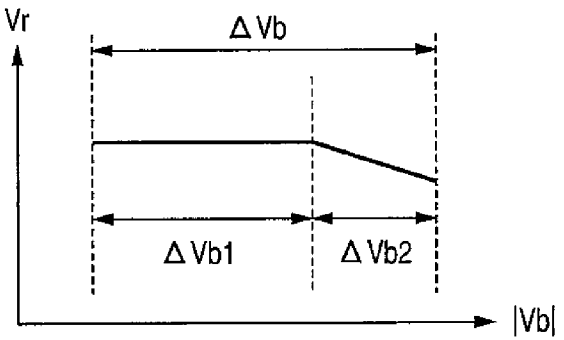
FIG. 29
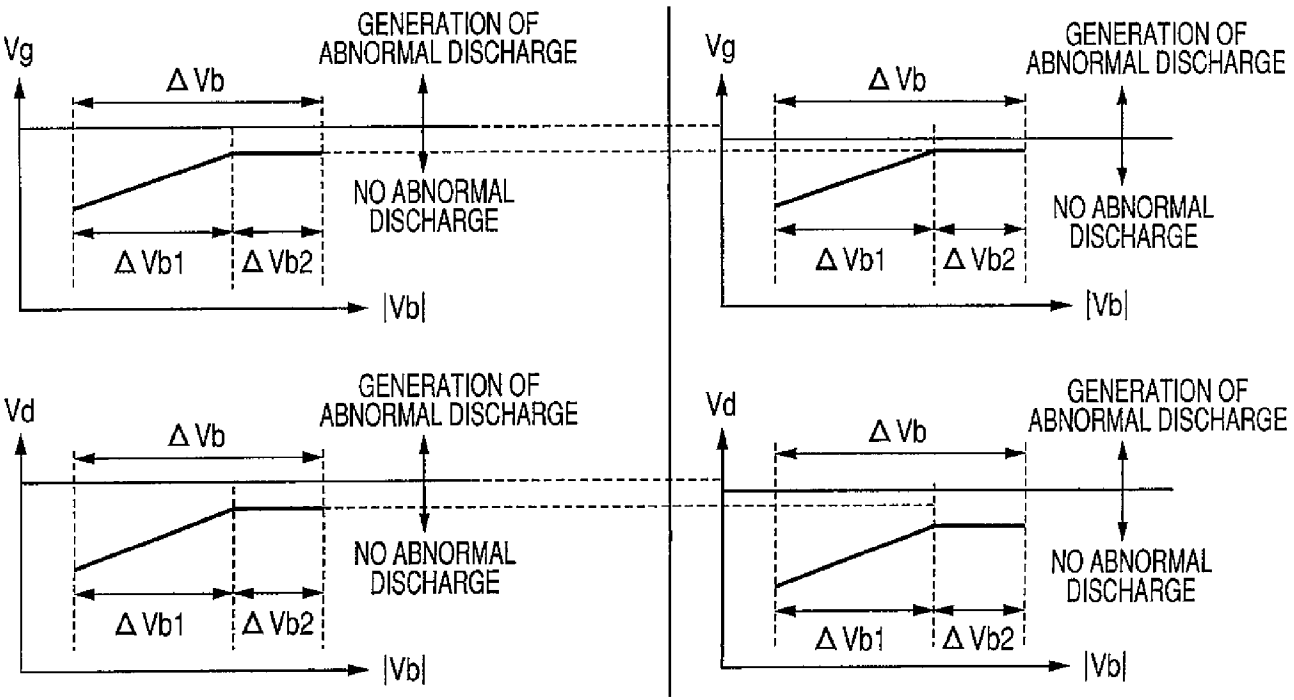
FIG. 30A
FIG. 30B

IMAGE FORMING APPARATUS AND METHOD HAVING AN INTERMEDIATE TRANSFER MEMBER WITH A MULTILAYER STRUCTURE THAT PREVENTS ABNORMAL IMAGES DUE TO ABNORMAL DISCHARGES

BACKGROUND OF THE INVENTION

The present invention relates to an image forming apparatus such as a printer, a facsimile or a copying machine to form an image by using an electrophotographic technique, and an image forming method.

An image forming apparatus using an electrophotographic technique includes an image carrier having a photosensitive layer on an outer peripheral surface, a charging unit for uniformly charging the outer peripheral surface of the image carrier, an exposing unit for selectively exposing the outer peripheral surface of the image carrier charged uniformly by the charging unit to form an electrostatic latent image, a developing unit for giving a toner to the electrostatic latent image formed by the exposing unit to form a toner image, and a transfer unit for transferring the toner image developed by the developing unit to a transfer medium such as a paper. There has been known an image forming apparatus for primarily transferring the toner image on the image carrier to an intermediate transfer belt and secondarily transferring the toner image on the intermediate transfer belt to a transfer medium in order to transfer the toner image developed on the image carrier to the transfer medium.

Some intermediate transfer belts have a single layer structure formed of a dielectric. The intermediate transfer belt of this type is pressed in contact with an image carrier formed by two transfer rollers having a conductiveness, and furthermore, a voltage having a reverse polarity to the polarity of a toner on the image carrier is applied. In the intermediate transfer belt having the single layer structure formed of the dielectric, a great potential difference is made between the two transfer rollers and a pressure contact portion (a transfer portion) with the image carrier to be an intermediate portion. For this reason, if an electric field from which a sufficient transfer efficiency is obtained is to be formed in the pressure contact portion (transfer portion) with the image carrier, the potential difference between a contact portion with the two transfer rollers in the intermediate transfer belt and the image carrier is excessively increased so that a discharge in this portion is generated. Consequently, there is a problem in that toner scattering is generated due to the discharge and the quality of an image is thus influenced. Moreover, some distance is made between the two transfer rollers constituting an electrode portion and the pressure contact portion (transfer portion) with the image carrier, and an unevenness is easily generated on the electric field in the transfer portion by the influence of the unevenness of the surface resistance of the intermediate transfer belt itself. As a result, there is a problem in that a transfer unevenness is easily generated.

For a countermeasure, there has been developed an intermediate transfer belt having a multilayer structure which is constituted by a conductive layer and a resistive layer formed on the conductive layer and serves to press the resistive layer in contact with an image carrier. The intermediate transfer belt having the multilayer structure including the conductive layer and the resistive layer can apply a uniform electric potential over the whole region of the pressure contact portion of the image carrier with the intermediate transfer belt. Therefore, it is possible to suppress toner scattering caused by a discharge and the generation of a transfer unevenness due to the unevenness of a surface resistance which are the problems of an image forming apparatus using an intermediate transfer belt having a single layer structure which is formed of a dielectric.

Moreover, it has been known that the image forming apparatus using the electrophotographic technique has a process control unit for properly regulating image density control factors (an exposure energy, a non-image portion potential, an image portion potential and a developing bias potential) in such a manner that the image density is optimized also in various use environments (a temperature and a humidity). In an actual image forming process, however, a toner image is formed with these factors related mutually. For this reason, these factors cannot be always controlled independently and optionally. In the factors, the absolute value of a potential difference between a developing bias potential Vb and a non-image portion potential Vd on an image carrier will be referred to as a reverse contrast potential Vr. In the case in which $Vr=|Vb-Vd|$ is set, toner scattering is increased and a fog is also increased when Vr is small. On the other hand, when Vr is great, both the amount of the toner scattering and that of the fog are decreased and a toner is stuck, with difficulty, to an image portion in a narrow region interposed between non-image portions, particularly, in an electrostatic latent image on an image carrier. As a result, there has been known a deterioration in the quality of a low density image having a comparatively low area ratio of a dot, for example, a blur is generated on an isolated dot or a fine line and the uniformity of a line width is damaged. As a countermeasure, there has been proposed an image forming method of holding the reverse contrast potential Vr to be the absolute value of the potential difference between the developing bias potential Vb to be applied to a developing unit and the non-image portion potential Vd on the image carrier to be constant, and furthermore, forming a halftone toner image while setting and changing the image density control factor to influence the image density of a toner image in a multistage, and optimizing the image density control factor based on the result of the detection of the image density of the toner image, thereby optimizing the image density of the toner image. According to the image forming method, it is possible to cause the image density to be proper while preventing toner scattering into the image forming apparatus by holding the reverse contrast potential Vr to be the absolute value of the potential difference between the developing bias potential Vb and the non-image portion potential Vd on the image carrier to be a proper value (see for example, JP-A-11-153910 and JP-A-2003-215862).

Moreover, a corona charger is generally used as a charger unit for charging an image carrier. There has generally been known a corona charger having a discharge electrode provided in a back plate to be a metal casing and having a grid electrode provided between the image carrier and the discharge electrode to apply a grid bias potential Vg to a grid electrode in order to apply a high voltage Va to the discharge electrode to generate a corona discharge and to uniformly charge the surface of the image carrier. The grid bias potential Vg and the non-image portion potential Vd in the transfer portion of the image carrier have a functional relation (see, for example, JP-B-7-21671).

Furthermore, there has been developed a corona charger for increasing a charge current stepwise based on information about a lifetime such as the number of times of use in order to prevent a deterioration in an image due to the contamination or aging caused by a toner in a discharge electrode, a grid electrode or a back plate.

In the image forming apparatus using the intermediate transfer belt having the multilayer structure including the conductive layer and the resistive layer, however, in some cases in which Vdt=|Vd−Vt1| is increased, an abnormal image which is not transferred partially or wholly is generated in a primary transfer portion, wherein a potential difference between a non-image portion potential Vd on the image carrier and a primary transfer bias potential Vt1 is represented by Vdt. In particular, this phenomenon is remarkably presented over a half image.

This phenomenon is presented for the following reason. More specifically, when the potential difference Vdt between the non-image portion potential Vd and the primary transfer bias potential Vt1 is equal to or greater than a threshold Vth, an abnormal discharge is generated locally and instantaneously between an image carrier provided before a transfer nip and the intermediate transfer belt having the multilayer structure including the conductive layer and the resistive layer so that a necessary transfer potential cannot be obtained. This can be confirmed from the fact that a toner to be moved onto the intermediate transfer belt from the surface of the image carrier is rarely transferred to a primary transfer nip portion at time of the generation of an abnormal image but remains on the image carrier.

Furthermore, the phenomenon in which the abnormal image is generated due to the abnormal discharge is not confirmed in the image forming apparatus using the intermediate transfer belt having the single layer structure formed of a dielectric at all, and therefore, is peculiar to the image forming apparatus using the intermediate transfer belt having the multilayer structure including the conductive layer and the resistive layer. For this reason, the abnormal discharge according to the invention is completely different from a discharge before the transfer nip which causes the toner scattering in the image forming apparatus using the intermediate transfer belt having the single layer structure formed of a dielectric, and an influence on the quality of an image is greater than a deterioration in the quality of an image which is caused by the toner scattering due to the discharge generated in the image forming apparatus using the intermediate transfer belt having the single layer structure formed of the dielectric beyond comparison.

Referring to the abnormal discharging phenomenon; it has been found that the threshold Vth of the potential difference Vdt at which an abnormal image is started to be generated by an abnormal discharge between the non-image portion potential Vd and the primary transfer bias potential Vt1 is changed depending on a variation in the thickness of the photosensitive layer of the image carrier, and the threshold Vth is decreased when the thickness is reduced. For example, if the threshold Vth of Vdt at which the abnormal image is started to be generated due to the abnormal discharge in 25 μm of the thickness of the photosensitive layer in the image carrier is 1000V, the threshold Vth is reduced to 950V if the thickness of the photosensitive layer in the image carrier is decreased to 20 μm.

Referring to the phenomenon of the generation of the abnormal image due to the abnormal discharge, moreover, it has been found that the threshold Vth of Vdt at which the abnormal image is started to be generated due to the abnormal discharge is changed depending on a variation in an air pressure, and the threshold Vth is decreased when the air pressure is dropped. For example, if the threshold Vth of Vdt at which the abnormal image is started to be generated due to the abnormal discharge with an air pressure of 760 mmHg (corresponding to an altitude of 0 m) is 1000V, the threshold Vth of Vdt at which the abnormal image is started to be generated due to the abnormal discharge with an air pressure of 560 mmHg (corresponding to an altitude of 2500 m) is reduced to 950V.

Referring to the phenomenon of the generation of the abnormal image due to the abnormal discharge, moreover, it has been found that the threshold Vth of Vdt at which the abnormal image is started to be generated due to the abnormal discharge is changed depending on a variation in a temperature and humidity, and the threshold Vth is decreased at a high temperature and a high humidity. For example, if the threshold Vth of Vdt at which the abnormal image is started to be generated due to the abnormal discharge at a temperature of 15° C. and a humidity of 35% is 1000V, the threshold Vth of Vdt at which the abnormal image is started to be generated due to the abnormal discharge at a temperature of 30° C. and a humidity of 85% is reduced to 950V.

Also, there is a problem in that the non-image portion potential Vd on the surface of the image carrier having the functional relation with the grid bias potential Vg is also increased and the threshold Vth of Vdt at which an abnormal image is started to be generated due to an abnormal discharge is thus exceeded, resulting in the generation of the abnormal discharge if a charge current is increased stepwise based on the number of times of use in order to prevent a deterioration in an image due to a contamination after the endurance of a discharge electrode, a grid electrode and a back plate in a corona charger.

SUMMARY OF THE INVENTION

In order to solve the problems, it is a first object of the invention to provide an image forming apparatus using an intermediate transfer belt having a multilayer structure including a conductive layer and a resistive layer which can suppress toner scattering in the image forming apparatus, and furthermore, can prevent the generation of an abnormal image due to an abnormal discharge in a primary transfer portion and can maintain a proper image density, and an image forming method.

Also, it is a second object of the invention to provide an image forming apparatus using an intermediate transfer belt having a multilayer structure including a conductive layer and a resistive layer which can prevent a deterioration in an image due to the number of times of use of a corona charger, can suppress toner scattering in the image forming apparatus, and furthermore, can prevent the generation of an abnormal image due to an abnormal discharge in a primary transfer portion and can maintain a proper image density, and an image forming method.

In order to achieve the above objects, one embodiment of the present invention is an image forming apparatus. The apparatus comprises an image carrier; a charging unit configured to charge the image carrier; an exposing unit configured to form an electrostatic latent image on the charged image carrier; a developing unit configured to develop the electrostatic latent image formed on the image carrier with a development material for forming a development image; an intermediate transfer member that includes a multilayer structure having a conductive layer; a transfer unit configured to transfer the development image on the intermediate transfer member; and a control unit that controls a transfer potential (Vt1) and a charging potential so that a potential difference (Vdt) between the transfer potential (Vt1) and a non-image portion potential (Vd) on the image carrier in a transfer position falls within a predetermined range.

In one aspect of the image forming apparatus of the invention, the control unit performs a normal mode and an abnormal discharge countermeasure mode; wherein a reverse contrast potential (Vr) is controlled so as to become constant within a variable range of a developing bias potential (Vb) in the normal mode; wherein the reverse contrast potential (Vr) is decreased within the variable range of the developing bias potential (Vb) in the abnormal discharge countermeasure mode (ΔVb2); and wherein the reverse contrast potential (Vr) is defined as an absolute value of a potential difference between the developing bias potential (Vb) and the non-image portion potential (Vd).

In another aspect of the image forming apparatus of the invention, the control unit controls the charging potential so as to fix the non-image portion potential Vd in the abnormal discharge countermeasure mode.

In another aspect of the image forming apparatus of the invention, the control unit switches the normal mode and the abnormal discharge countermeasure mode.

Another aspect of the image forming apparatus of the invention comprises an apparatus body that has a user interface, wherein the normal mode and the abnormal discharge countermeasure mode are switched in accordance with an operation through the user interface.

In another aspect of the image forming apparatus of the invention, the control unit switches the normal mode and the abnormal discharge countermeasure mode based on at least one of life time information about a lifetime of an image forming operation including a number of used sheets set in an apparatus body and information about environment of an air pressure, a temperature or humidity.

In another aspect of the image forming apparatus of the invention, the control unit performs a normal mode and an abnormal discharge countermeasure mode; the transfer potential (Vt1) is controlled so as to become constant within a variable range of a developing bias potential (Vb) in the normal mode; and the transfer potential (Vt1) is decreased within the variable range of the developing bias potential (Vb) in the abnormal discharge countermeasure mode (ΔVb2).

In another aspect of the image forming apparatus of the invention, the control unit controls a reverse contrast potential (Vr) so as to become constant within a variable range of a developing bias potential (Vb) in the normal mode and the abnormal discharge countermeasure mode; and the reverse contrast potential (Vr) is defined as an absolute value of a potential difference between the developing bias potential (Vb) and the non-image portion potential (Vd).

Another aspect of the image forming apparatus of the invention comprises a toner density detecting unit that detects a toner density of a patch image on at least one of the image carrier and the intermediate transfer member, wherein the control unit performs the normal mode and the abnormal discharge countermeasure mode based on the toner density detected by the toner density detecting unit.

In another aspect of the image forming apparatus of the invention, the toner density detecting unit compares a first density of a patch image having a low density formed after a high density image with a second density of a patch image having a low density formed after a medium density image; and wherein the control unit performs the abnormal discharge countermeasure mode when a difference between the first density and the second density detected by the toner density detecting unit is greater than a threshold value.

Another aspect of the image forming apparatus of the invention comprises a toner density detecting unit that detects a toner density of a patch image on at least one of the image carrier and the intermediate transfer member, wherein the control unit controls an image density control factor including at least the developing bias potential for applying to the developing unit in accordance with the toner density detected by the toner density detecting unit; wherein the control unit forms a patch image while varying the image density control factor; wherein the control unit measures an abnormal discharge voltage based on the toner density detected by the toner density detecting unit; wherein the control unit performs the normal mode when the abnormal discharge voltage is not measured; and wherein the control unit performs the abnormal discharge countermeasure mode when the abnormal discharge voltage is measured.

Another aspect of the image forming apparatus of the invention comprises a transfer current detecting unit that detects the transfer current, wherein the control unit performs the normal mode and the abnormal discharge countermeasure mode based on at least one of a value of the transfer current and a change in the value of the transfer current detected by the transfer current detecting unit.

In another aspect of the image forming apparatus of the invention, the control unit switches the normal mode and the abnormal discharge countermeasure mode based on the transfer current in a transfer of a half image which is detected by the transfer current detecting unit.

In another aspect of the image forming apparatus of the invention, the charging unit is a corona charging unit; wherein the corona charging unit includes a discharge electrode, a back plate and a grid electrode; wherein the control unit controls an image density control factor including at least the developing bias potential for applying to the developing unit; and wherein the control unit controls the transfer potential and a grid bias potential so that a potential difference (Vdt) between the transfer potential (Vt1) and a non-image portion potential (Vd) on the image carrier in a transfer position falls within a predetermined range.

In another aspect of the image forming apparatus of the invention, the control unit performs a normal mode and an abnormal discharge countermeasure mode; wherein a reverse contrast potential (Vr) is controlled so as to become constant within a variable range of a developing bias potential (Vb) in the normal mode; wherein the reverse contrast potential (Vr) is decreased within the variable range of the developing bias potential (Vb) in the abnormal discharge countermeasure mode (ΔVb2); and wherein the reverse contrast potential (Vr) is defined as an absolute value of a potential difference between the developing bias potential (Vb) and the grid bias potential (Vd).

In another aspect of the image forming apparatus of the invention, the control unit controls the corona charging unit so as to fix the grid bias potential in the abnormal discharge countermeasure mode.

In another aspect of the image forming apparatus of the invention, the control unit controls the transfer potential, the grid bias potential and a discharge current so that the potential difference (Vdt) between the transfer potential (Vt1) and the non-image portion potential (Vd) on the image carrier in a transfer position falls within the predetermined range.

In another aspect of the image forming apparatus of the invention, the control unit controls a discharge current value and a discharge time so as to increase and also controls the grid bias potential so as to decrease based on lifetime information about a lifetime of an image forming operation including a number of used sheets.

Another embodiment of the invention is an image forming methods. The method comprises applying a charging bias to a charging unit to charge a surface of an image carrier; exposing the charged surface of the image carrier to form an electrostatic latent image on the image carrier; applying a developing bias to a developing unit to develop the electrostatic latent image with a development material for forming a development image; applying a transfer bias to transfer the development image on the surface of the image carrier to an intermediate transfer member including a multilayer structure having a conductive layer; controlling a transfer potential and a charging potential so that a potential difference between the transfer potential and a non-image portion potential on the image carrier in a transfer position falls within a predetermined range.

In one aspect of the image forming method of the invention the control process, a normal mode and an abnormal discharge countermeasure mode are performed; wherein the transfer potential is controlled so as to become constant while a reverse contrast potential (Vr) is maintained in constant within a variable range of a developing bias potential (Vb) in the normal mode; wherein the transfer potential (Vt1) is decreased within the variable range of the developing bias potential in the abnormal discharge countermeasure mode (ΔVb2); and wherein the reverse contrast potential is defined as an absolute value of a potential difference between the developing bias potential and the non-image portion potential.

Another aspect of the image forming method of the invention comprises a process of detecting a toner density of a patch image on at least one of the image carrier and the intermediate transfer member, wherein a normal mode and an abnormal discharge countermeasure mode are performed in the control process based on the toner density detected by the toner density detecting process; wherein a reverse contrast potential is controlled so as to become constant within a variable range of a developing bias potential in the normal mode; wherein the reverse contrast potential is decreased within the variable range of the developing bias potential in the abnormal discharge countermeasure mode; and wherein the reverse contrast potential is defined as an absolute value of a potential difference between the developing bias potential and the non-image portion potential.

Another aspect of the image forming method of the invention comprises a process of detecting the transfer current, wherein in the control process, the normal mode and the abnormal discharge countermeasure mode are performed based on at least one of a value of the transfer current and a change in the value of the transfer current detected by the transfer current detecting process.

In another aspect of the image forming method of the invention, the charging unit is a corona charging unit; wherein in the applying process of the charge bias, a grid bias potential is applied to a grid electrode of the corona charging unit; and wherein in the control process, the transfer potential and a grid bias potential are controlled so that a potential difference (Vdt) between the transfer potential (Vt1) and the non-image portion potential (Vd) on the image carrier in the transfer position falls within a predetermined range.

In another aspect of the image forming method of the invention, the charging unit is a corona charging unit; wherein in the applying process of the charge bias, a discharging current is applied to a discharge electrode of the corona charging unit, and also a grid bias potential is applied to a grid electrode of the corona charging unit; and wherein in the control process, the transfer potential, the grid bias potential and the discharging current are controlled so that a potential difference (Vdt) between the transfer potential (Vt1) and the non-image portion potential (Vd) on the image carrier in the transfer position falls within a predetermined range.

By such a structure that there is provided the control unit for controlling a transfer potential and a charging potential in order to cause a difference between the transfer potential and a non-image portion potential on the image carrier in a transfer position to be set within a predetermined range, it is possible to prevent the generation of an abnormal image due to an abnormal discharge which is peculiar to a primary transfer portion using an intermediate transfer member having a multilayer structure including a conductive layer.

By such a structure that the control unit carries out a control into a control region ΔVb1 for setting a reverse contrast potential Vr (Vr=|Vd−Vb|) to be an absolute value of a difference between a developing bias potential Vb and a non-image portion potential Vd on the image carrier to be constant and a control region ΔVb2 for decreasing the reverse contrast potential Vr within the variable range of the developing bias potential Vb in the abnormal discharge countermeasure mode, in the control region in which the abnormal image might be generated due to the abnormal discharge in the primary transfer portion, the reverse contrast potential Vr is reduced. Consequently, it is possible to maintain the non-image portion potential Vd on the image carrier to be equal to or smaller than a threshold Vth of the generation of the abnormal discharge with a potential difference Vdt=|Vd−Vt1| between the primary transfer bias potential Vt1 and the non-image portion potential on the image carrier. Thus, it is possible to prevent the generation of the abnormal image due to the abnormal discharge which is peculiar to the image forming apparatus using the intermediate transfer belt having a multilayer structure including a conductive layer. By limiting the control region for decreasing the reverse contrast potential Vr, it is possible to minimize the amount of toner scattering into the apparatus.

By such a structure that the control unit controls a charging potential to fix the non-image portion potential Vd on the image carrier in the control region ΔVb2 for decreasing the reverse contrast potential Vr in the abnormal discharge countermeasure mode, even if the developing bias potential Vb to influence a developing property (a flying property) is set to be high, the non-image portion potential Vd is fixed. Therefore, the potential difference Vdt=|Vd−Vt1| between the primary transfer bias potential Vt1 and the non-image portion potential on the image carrier can be maintained to be equal to or smaller than the threshold Vth of the generation of the abnormal discharge. Therefore, it is possible to prevent the generation of an abnormal image due to the abnormal discharge which is peculiar to the image forming apparatus using the intermediate transfer belt having the multilayer structure including the conductive layer.

By such a structure that the control unit can switch the normal mode and the abnormal discharge countermeasure mode, the control region for decreasing the reverse contrast potential Vr can be limited to only the time of the generation of an abnormal image due to an abnormal discharge which is peculiar to the image forming apparatus using the intermediate transfer belt having the multilayer structure including the conductive layer. Thus, it is possible to minimize an influence to reduce the reverse contrast potential Vr.

By such a structure that the normal mode and the abnormal discharge countermeasure mode can be switched by the operation of the control panel provided in the apparatus body, it is possible to quickly take a countermeasure when the abnormal image is generated due to the abnormal discharge which is peculiar to the image forming apparatus using the intermediate transfer belt having the multilayer structure including the conductive layer.

By such a structure that the normal mode and the abnormal discharge countermeasure mode can be switched based on information about a lifetime such as the number of used sheets and information about an environment such as an air pressure or a temperature and humidity which are provided in the apparatus body, it is possible to quickly take a countermeasure corresponding to a rise in the probability of the generation of the abnormal image due to the abnormal discharge.

By such a structure that a transfer potential and a charging potential are controlled in order to cause a difference between the transfer potential and a non-image portion potential on the image carrier in a transfer position to be set within a predetermined range in an image forming method of giving a charging bias to a charging unit to charge a surface of an image carrier, then forming an electrostatic latent image on the surface of the image carrier by an exposing unit, applying a developing bias to a developing unit to reveal the electrostatic latent image with a toner, thereby forming a toner image, and applying a transfer bias to primarily transfer the toner image on the surface of the image carrier to an intermediate transfer member having a multilayer including a conductive layer, it is possible to prevent the generation of the abnormal image due to the abnormal discharge which is peculiar to the primary transfer portion using the intermediate transfer member having the multilayer including the conductive layer in the same manner as in the image forming apparatus.

By such a structure that an image forming apparatus comprises an image carrier, a charging unit for charging the image carrier, an exposing unit for forming an electrostatic latent image on the charged image carrier, a developing unit for revealing the electrostatic latent image formed on the image carrier with a toner and thus forming a toner image, an intermediate transfer member having a multilayer structure including a conductive layer, and a transfer unit, comprising a control unit for controlling a transfer potential and a charging potential in order to cause a difference between the transfer potential and a non-image portion potential on the image carrier in a transfer position to be set within a predetermined range, the control unit carrying out a control into a control region ΔVb1 for setting a primary transfer potential Vt1 to be constant and a control region Vb2 capable of varying the primary transfer potential Vt1 in a decreasing direction within a variable range ΔVb of a developing bias potential in an abnormal discharge corresponding mode, it is possible to reduce the primary transfer potential, thereby maintaining a difference between the non-image portion potential and the primary transfer potential to be equal to or smaller than a threshold of the generation of an abnormal discharge in a region in which an abnormal image might be generated due to the abnormal discharge in a primary transfer portion which is peculiar to the image forming apparatus using the intermediate transfer member having the multilayer structure including the conductive layer. Consequently, it is possible to prevent the generation of the abnormal image due to the abnormal discharge. By limiting a control region for decreasing the primary transfer potential, moreover, it is possible to minimize an increase in a waste toner.

By such a structure that the control unit controls a reverse contrast potential Vr ($Vr=|Vd-Vb|$) to be an absolute value of a difference between a developing bias potential Vb and a non-image portion potential Vd on the image carrier to be constant in the normal mode and the abnormal discharge corresponding mode, it is possible to properly set an image density while preventing the generation of an abnormal image due to an abnormal discharge to suppress toner scattering into the image forming apparatus.

By such a structure that the control unit can switch the normal mode and the abnormal discharge corresponding mode, the control region for decreasing the primary transfer potential can be limited to the time of the generation of the abnormal image due to the abnormal discharge which is peculiar to the image forming apparatus using the intermediate transfer belt having the multilayer structure including the conductive layer. Consequently, it is possible to minimize the influence of an increase in a waste toner generated by the decrease in the primary transfer potential.

By such a structure that the normal mode and the abnormal discharge corresponding mode can be switched by an operation of a control panel provided in an apparatus body, it is possible to quickly convert the control region when the abnormal image is generated due to the abnormal discharge which is peculiar to the image forming apparatus using the intermediate transfer belt having the multilayer structure including the conductive layer.

By such a structure that the normal mode and the abnormal discharge corresponding mode can be switched based on information about a lifetime such as the number of used sheets and information about an environment such as an air pressure and a temperature and humidity which are provided in the apparatus body, it is possible to quickly take a countermeasure corresponding to a rise in the probability of the generation of the abnormal image due to the abnormal discharge.

In an image forming method of giving a charging bias to a charging unit to charge a surface of an image carrier, then forming an electrostatic latent image on the surface of the image carrier by an exposing unit, applying a developing bias to a developing unit to reveal the electrostatic latent image with a toner, thereby forming a toner image, and applying a transfer bias to transfer the toner image on the surface of the image carrier to an intermediate transfer member having a multilayer structure including a conductive layer, a transfer potential and a charging potential are controlled in order to cause a difference between the transfer potential and a non-image portion potential on the image carrier in a transfer position to be set within a predetermined range, the control including a control in a normal mode for setting a primary transfer potential to be constant while holding a reverse bias potential to be constant within a variable range of the developing bias potential and a control in an abnormal discharge corresponding mode having two control regions, that is, a control region for setting the primary transfer potential to be constant while holding the reverse bias potential to be constant and a control region capable of varying the primary transfer potential in a decreasing direction within the variable range of the developing bias potential. By such a structure, it is possible to prevent the generation of the abnormal image due to the abnormal discharge which is peculiar to the primary transfer portion using the intermediate transfer member having the multilayer structure including the conductive layer in the same manner as in the image forming apparatus.

By such a structure that there is provided the control unit for controlling a transfer potential and a charging potential in order to cause a difference between the transfer potential and a non-image portion potential on the image carrier in a transfer position to be set within a predetermined range, it is possible to prevent the generation of an abnormal image due to an abnormal discharge which is peculiar to a primary transfer portion using an intermediate transfer member having a multilayer structure including a conductive layer.

By such a structure that the control unit carries out a control into a control region ΔVb1 for setting a reverse contrast potential Vr ($Vr=|Vd-Vb|$) to be an absolute value of a difference between a developing bias potential Vb and a non-image portion potential Vd on the image carrier to be constant and a control region ΔVb2 for decreasing the reverse contrast potential Vr within the variable range of the developing bias potential Vb in the abnormal discharge corresponding mode, in the control region in which the abnormal image might be generated due to the abnormal discharge in the primary transfer portion, the reverse contrast potential Vr is reduced. Consequently, it is possible to maintain the non-image portion potential Vd on the image carrier to be equal to or smaller than a threshold Vth of the generation of the abnormal discharge with a potential difference Vdt=|Vd−Vt1| between the primary transfer bias potential Vt1 and the non-image portion potential on the image carrier. Thus, it is possible to prevent the generation of the abnormal image due to the abnormal discharge which is peculiar to the image forming apparatus using the intermediate transfer belt having a multilayer structure including a conductive layer. By limiting the control region for decreasing the reverse contrast potential Vr, it is possible to minimize the amount of toner scattering into the apparatus.

The normal mode and the abnormal discharge corresponding mode can be switched by the detection of a toner density through the toner density detecting unit based on a patch image which is usually provided in an apparatus body. Consequently, it is possible to prevent an abnormal image from being generated due to an abnormal discharge without providing a new apparatus.

By such a structure that the control unit controls a charging potential to fix the non-image portion potential Vd on the image carrier in the control region ΔVb2 for decreasing the reverse contrast potential Vr in the abnormal discharge corresponding mode, even if the developing bias potential Vb to influence a developing property (a flying property) is set to be high, the non-image portion potential Vd is fixed. Therefore, the potential difference Vdt=|Vd−Vt1| between the primary transfer bias potential Vt1 and the non-image portion potential on the image carrier can be maintained to be equal to or smaller than the threshold Vth of the generation of the abnormal discharge. Therefore, it is possible to prevent the generation of an abnormal image due to the abnormal discharge which is peculiar to the image forming apparatus using the intermediate transfer belt having the multilayer structure including the conductive layer.

By such a structure that the toner density detecting unit compares the density of a patch image having a low density after a high density with the density of a patch image having a low density after a medium density and detects a predetermined difference or more, and detects the generation of an abnormal image due to an abnormal discharge, the measurement of the density can easily be carried out because of a low density and a difference between both densities can accurately be detected.

By such a structure that the normal mode and the abnormal discharge corresponding mode can be switched by the operation of the control panel provided in the apparatus body, it is possible to quickly take a countermeasure when the abnormal image is generated due to the abnormal discharge which is peculiar to the image forming apparatus using the intermediate transfer belt having the multilayer structure including the conductive layer.

By such a structure that the normal mode and the abnormal discharge corresponding mode can be switched based on information about a lifetime such as the number of used sheets and information about an environment such as an air pressure or a temperature and humidity which are provided in the apparatus body, it is possible to quickly take a countermeasure corresponding to a rise in the probability of the generation of the abnormal image due to the abnormal discharge.

In an image forming method of applying a charging bias to a charging unit to charge a surface of an image carrier, then forming an electrostatic latent image on the surface of the image carrier by an exposing unit, applying a developing bias to a developing unit to reveal the electrostatic latent image with a toner, thereby forming a toner image, applying a transfer bias to transfer the toner image on the surface of the image carrier to an intermediate transfer member having a multilayer structure including a conductive layer, and controlling a transfer potential and a charging potential to cause a difference between the transfer potential and a non-image portion potential on the image carrier in a transfer position to be set within a predetermined range, a toner density of a predetermined patch image on the image carrier or the intermediate transfer member is detected and a control is carried out in a normal mode for controlling a reverse contrast potential Vr (Vr=|Vd−Vb|) to be an absolute value of a difference between a developing bias potential Vb and a non-image portion potential Vd on the image carrier to be constant within a variable range of the developing bias potential Vb corresponding to the toner density thus detected, and an abnormal discharge corresponding mode for performing a control into a control region ΔVb1 for controlling the reverse contrast potential Vr to be constant and a control region ΔVb2 for decreasing the reverse contrast potential Vr within the variable range of the developing bias potential Vb. By such a structure, it is possible to prevent an abnormal image from being generated due to an abnormal discharge which is peculiar to a primary transfer portion using an intermediate transfer member having a multilayer including a conductive layer in the same manner as in the image forming apparatus.

By such a structure that there is provided the control unit for controlling a transfer potential and a charging potential in order to cause a difference between the transfer potential and a non-image portion potential on the image carrier in a transfer position to be set within a predetermined range, it is possible to prevent the generation of an abnormal image due to an abnormal discharge which is peculiar to a primary transfer portion using an intermediate transfer member having a multilayer structure including a conductive layer.

By such a structure that the control unit carries out a control into a control region ΔVb1 for setting a reverse contrast potential Vr (Vr=|Vd−Vb|) to be an absolute value of a difference between a developing bias potential Vb and a non-image portion potential Vd on the image carrier to be constant and a control region ΔVb2 for decreasing the reverse contrast potential Vr within the variable range of the developing bias potential Vb in the abnormal discharge corresponding mode, in the control region in which the abnormal image might be generated due to the abnormal discharge in the primary transfer portion, the reverse contrast potential Vr is reduced. Consequently, it is possible to maintain the non-image portion potential Vd on the image carrier to be equal to or smaller than a threshold Vth of the generation of the abnormal discharge with a potential difference Vdt=|Vd−Vt1| between the primary transfer bias potential Vt1 and the non-image portion potential on the image carrier. Thus, it is possible to prevent the generation of the abnormal image due to the abnormal discharge which is peculiar to the image forming apparatus using the intermediate transfer belt having a multilayer structure including a conductive layer. By limiting the control region for decreasing the reverse contrast potential Vr, it is possible to minimize the amount of toner scattering into the apparatus.

By detecting a transfer current to be increased rapidly in an abnormal discharge through the transfer current detecting unit, it is possible to easily detect the generation of the abnormal discharge and to quickly correspond to the generation of an abnormal image due to the abnormal discharge.

By setting the detection of the transfer current through the transfer current detecting unit at time of the transfer of a half image, it is possible to limit the detection to an image transfer in which the abnormal discharge is often generated and the quality of an image is greatly influenced.

The normal mode and the abnormal discharge corresponding mode can be switched by the detection of a toner density through the toner density detecting unit based on a patch image which is usually provided in an apparatus body. Consequently, it is possible to prevent an abnormal image from being generated due to an abnormal discharge without providing a new apparatus.

By such a structure that the toner density detecting unit compares the density of a patch image having a low density after a high density with the density of a patch image having a low density after a medium density and detects a predetermined difference or more, and detects the generation of an abnormal image due to an abnormal discharge, the measurement of the density can easily be carried out because of a low density and a difference between both densities can accurately be detected.

By such a structure that the control unit controls a charging potential to fix the non-image portion potential Vd on the image carrier in the control region ΔVb2 for decreasing the reverse contrast potential Vr in the abnormal discharge corresponding mode, even if the developing bias potential Vb to influence a developing property (a flying property) is set to be high, the non-image portion potential Vd is fixed. Therefore, the potential difference Vdt=|Vd−Vt1| between the primary transfer bias potential Vt1 and the non-image portion potential on the image carrier can be maintained to be equal to or smaller than the threshold Vth of the generation of the abnormal discharge. Therefore, it is possible to prevent the generation of an abnormal image due to the abnormal discharge which is peculiar to the image forming apparatus using the intermediate transfer belt having the multilayer structure including the conductive layer.

By such a structure that the normal mode and the abnormal discharge corresponding mode can be switched by the operation of the control panel provided in the apparatus body, it is possible to quickly convert a control region when the abnormal image is generated due to the abnormal discharge which is peculiar to the image forming apparatus using the intermediate transfer belt having the multilayer structure including the conductive layer.

By such a structure that the normal mode and the abnormal discharge corresponding mode can be switched based on information about a lifetime such as the number of used sheets and information about an environment such as an air pressure or a temperature and humidity which are provided in the apparatus body, it is possible to quickly take a countermeasure corresponding to a rise in the probability of the generation of the abnormal image due to the abnormal discharge.

In an image forming method of applying a charging bias to a charging unit to charge a surface of an image carrier, then forming an electrostatic latent image on the surface of the image carrier by an exposing unit, applying a developing bias to a developing unit to reveal the electrostatic latent image with a toner, thereby forming a toner image, applying a transfer bias to transfer the toner image on the surface of the image carrier to an intermediate transfer member having a multilayer structure including a conductive layer, and controlling a transfer potential and a charging potential to cause a difference between the transfer potential and a non-image portion potential on the image carrier in a transfer position to be set within a predetermined range, there are carried out a control in a normal mode for setting a reverse contrast potential Vr (Vr=|Vd−Vb|) to be an absolute value of a difference between a developing bias potential Vb and a non-image portion potential Vd on the image carrier to be constant within a variable range of the developing bias potential Vb corresponding to a change in a transfer current, and a control in an abnormal discharge corresponding mode having a control region ΔVb1 for setting the reverse contrast potential Vr to be constant and a control region ΔVb2 for decreasing the reverse contrast potential Vr within the variable range of the developing bias potential Vb. By such a structure, it is possible to prevent an abnormal image from being generated due to an abnormal discharge which is peculiar to a primary transfer portion using an intermediate transfer member having a multilayer including a conductive layer in the same manner as in the image forming apparatus.

By such a structure that there is provided the control unit for controlling a transfer potential and a grid bias potential in order to cause a difference between the transfer potential and a non-image portion potential on the image carrier in a transfer position to be set within a predetermined range, it is possible to prevent the generation of an abnormal image due to an abnormal discharge which is peculiar to a primary transfer portion using an intermediate transfer member having a multilayer structure including a conductive layer.

By such a structure that the control unit has a normal mode for controlling an absolute value Vr (=|Vb−Vg|) of a difference between a developing bias potential Vb and a grid bias potential Vg to be constant within the variable range of a developing bias potential and an abnormal discharge corresponding mode for carrying out a control into a control region ΔVb1 for setting the absolute value Vr of the difference between the developing bias potential Vb and the grid bias potential Vg to be constant and a control region ΔVb2 for decreasing Vr within the variable range of the developing bias potential, in the control region in which the abnormal image might be generated due to the abnormal discharge in the primary transfer portion, the potential Vr is reduced. Consequently, it is possible to maintain a non-image portion potential Vd on the image carrier to be equal to or smaller than a threshold Vth of the generation of the abnormal discharge with a potential difference Vdt=|Vd−Vt1| between a primary transfer bias potential Vt1 and the non-image portion potential on the image carrier. Thus, it is possible to prevent the generation of the abnormal image due to the abnormal discharge which is peculiar to the image forming apparatus using the intermediate transfer belt having a multilayer structure including a conductive layer. By limiting the control region for decreasing Vr, it is possible to minimize the amount of toner scattering into the apparatus.

By such a structure that the control unit controls a grid bias to fix the grid bias potential Vg having a functional relation with the non-image portion potential Vd on the image carrier in the control region ΔVb2 for decreasing the Vr in the abnormal discharge corresponding mode, even if the developing bias potential Vb to influence a developing property (a flying property) is set to be high, the grid bias potential Vg having the functional relation with the non-image portion potential Vd is fixed. Therefore, the potential difference Vdt=|Vd−Vt1| between the primary transfer bias potential Vt1 and the non-image portion potential on the image carrier can be maintained to be equal to or smaller than the threshold Vth of the generation of the abnormal discharge. Therefore, it is possible to prevent the generation of an abnormal image due to the abnormal discharge which is peculiar to the image forming apparatus using the intermediate transfer belt having the multilayer structure including the conductive layer.

By such a structure that the control unit can switch the normal mode and the abnormal discharge corresponding mode, the control region for decreasing Vr can be limited to only the time of the generation of an abnormal image due to an abnormal discharge which is peculiar to the image forming apparatus using the intermediate transfer belt having the multilayer structure including the conductive layer. Thus, it is possible to minimize an influence to reduce Vr.

By such a structure that the normal mode and the abnormal discharge corresponding mode can be switched by the operation of the control panel provided in the apparatus body, it is possible to quickly convert the control region when the abnormal image is generated due to the abnormal discharge which is peculiar to the image forming apparatus using the intermediate transfer belt having the multilayer structure including the conductive layer.

By such a structure that the normal mode and the abnormal discharge corresponding mode can be switched based on at least any of information about a lifetime such as the number of used sheets and information about an environment such as an air pressure or a temperature and humidity which are provided in the apparatus body, and a change in a transfer current detected by a transfer current detecting unit, it is possible to quickly take a countermeasure corresponding to a rise in the probability of the generation of the abnormal image due to the abnormal discharge.

In an image forming method of applying a grid bias potential to a grid electrode of a corona charging unit to charge a surface of an image carrier; then forming an electrostatic latent image on the surface of the image carrier by an exposing unit, applying a developing bias to a developing unit to reveal the electrostatic latent image with a toner, thereby forming a toner image, and applying a transfer bias to transfer the toner image on the surface of the image carrier to an intermediate transfer member having a multilayer structure including a conductive layer, a transfer potential and the grid bias potential are controlled in order to cause a difference between the transfer potential and a non-image portion potential on the image carrier in a transfer position to be set within a predetermined range. By such a structure, it is possible to prevent the generation of the abnormal image due to the abnormal discharge which is peculiar to the primary transfer portion using the intermediate transfer member having the multilayer including the conductive layer in the same manner as in the image forming apparatus.

By such a structure that a transfer potential, a grid bias potential and a discharge current are controlled in order to cause a difference between the transfer potential and a non-image portion potential on the image carrier in a transfer position to be set within a predetermined range, it is possible to prevent the generation of an abnormal image due to an abnormal discharge which is peculiar to a primary transfer portion using an intermediate transfer member having a multilayer structure including a conductive layer.

By such a structure that the control unit carries out a control to increase a discharge current value and a discharge time stepwise based on information about a lifetime such as the number of times of use and to decrease the grid bias potential stepwise, it is possible to prevent the generation of an abnormal image due to an abnormal discharge which is peculiar to a primary transfer portion using an intermediate transfer member having a multilayer structure including a conductive layer while preventing a deterioration in an image due to the contamination of the corona charging unit.

By such a structure that the control unit has a normal mode for setting an absolute value Vr (=|Vb−Vg|) of a difference between a developing bias potential Vb and a grid bias potential Vg to be constant within the variable range of a developing bias potential and an abnormal discharge corresponding mode for carrying out a control into a control region ΔVb1 for setting the absolute value Vr (=|Vb−Vg|) of the difference between the developing bias potential Vb and the grid bias potential Vg to be constant and a control region ΔVb2 for decreasing Vr within the variable range of the developing bias potential, in the control region in which the abnormal image might be generated due to the abnormal discharge in the primary transfer portion, the potential Vr is reduced. Consequently, it is possible to maintain a non-image portion potential Vd on the image carrier to be equal to or smaller than a threshold Vth of the generation of the abnormal discharge with a potential difference Vdt=|Vd−Vt1| between a primary transfer bias potential Vt1 and the non-image portion potential on the image carrier. Thus, it is possible to prevent the generation of the abnormal image due to the abnormal discharge which is peculiar to the image forming apparatus using the intermediate transfer belt having a multilayer structure including a conductive layer. By limiting the control region for decreasing Vr, it is possible to minimize the amount of toner scattering into the apparatus.

By such a structure that the control unit controls a grid bias to fix the grid bias potential Vg having a functional relation with the non-image portion potential Vd on the image carrier in the control region ΔVb2 for decreasing Vr in the abnormal discharge corresponding mode, even if the developing bias potential Vb to influence a developing property (a flying property) is set to be high, the grid bias potential Vg having the functional relation with the non-image portion potential Vd is fixed. Therefore, the potential difference Vdt=|Vd−Vt1| between the primary transfer bias potential Vt1 and the non-image portion potential on the image carrier can be maintained to be equal to or smaller than the threshold Vth of the generation of the abnormal discharge. Therefore, it is possible to prevent the generation of an abnormal image due to the abnormal discharge which is peculiar to the image forming apparatus using the intermediate transfer belt having the multilayer structure including the conductive layer.

By such a structure that the control unit can switch the normal mode and the abnormal discharge corresponding mode, the control region for decreasing Vr can be limited to only the time of the generation of an abnormal image due to an abnormal discharge which is peculiar to the image forming apparatus using the intermediate transfer belt having the multilayer structure including the conductive layer. Thus, it is possible to minimize an influence to reduce Vr.

By such a structure that the normal mode and the abnormal discharge corresponding mode can be switched by the operation of the control panel provided in the apparatus body, it is possible to quickly convert the control region when the abnormal image is generated due to the abnormal discharge which is peculiar to the image forming apparatus using the intermediate transfer belt having the multilayer structure including the conductive layer.

By such a structure that the normal mode and the abnormal discharge corresponding mode can be switched based on at least any of information about a lifetime such as the number of used sheets and information about an environment such as an air pressure or a temperature and humidity which are provided in the apparatus body, and a change in a transfer current detected by transfer current detecting unit, it is possible to quickly take a countermeasure corresponding to a rise in the probability of the generation of the abnormal image due to the abnormal discharge.

In an image forming method of applying a discharge current and a grid bias potential to a discharge electrode and a grid electrode in corona charging unit respectively to charge a surface of an image carrier, then forming an electrostatic latent image on the surface of the image carrier by an exposing unit, applying a developing bias to a developing unit to reveal the electrostatic latent image with a toner, thereby forming a toner image, and applying a transfer bias to transfer the toner image on the surface of the image carrier to an intermediate transfer member having a multilayer structure including a conductive layer, a transfer potential, the grid bias potential and the discharge current are controlled in order to cause a difference between the transfer potential and a non-image portion potential on the image carrier in a transfer position to be set within a predetermined range. By such a structure, it is possible to prevent the generation of the abnormal image due to the abnormal discharge which is peculiar to the primary transfer portion using the intermediate transfer member having the multilayer structure including the conductive layer in the same manner as in the image forming apparatus.

BRIEF DESCRIPTION OF THE DRAWINGS

The above objects and advantages of the present invention will become more apparent by describing in detail preferred exemplary embodiments thereof with reference to the accompanying drawings, wherein:

FIG. 29 is a chart for explaining two control regions in an abnormal discharge countermeasure mode according to the invention;

FIGS. 30A and 30B are charts for explaining the two control regions in the abnormal discharge countermeasure mode;

DETAILED DESCRIPTION OF THE PREFERRED EMBODIMENTS

Figure 1:
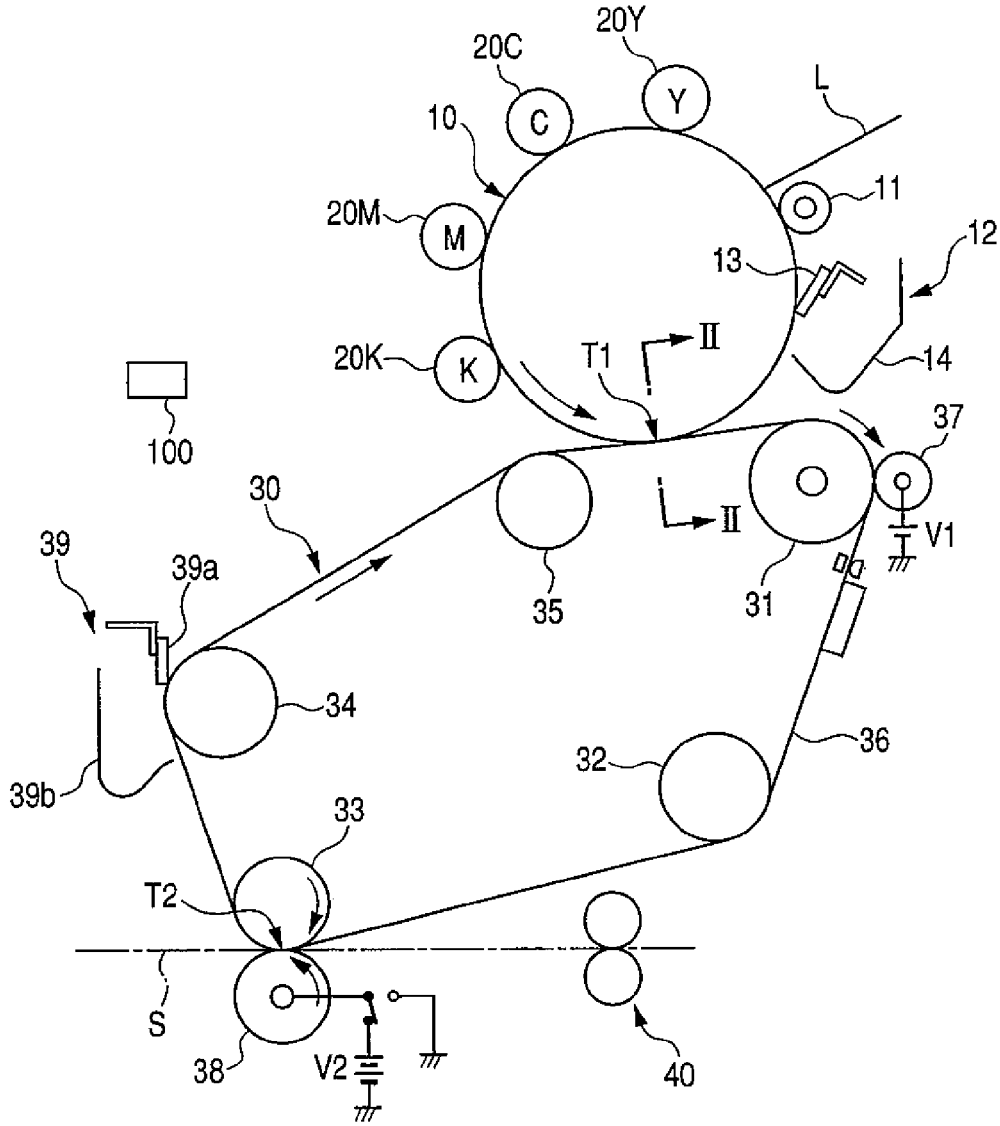
FIG. 1 is a typical view showing main parts of an image forming apparatus according to a first embodiment of the invention.
Figure 2:
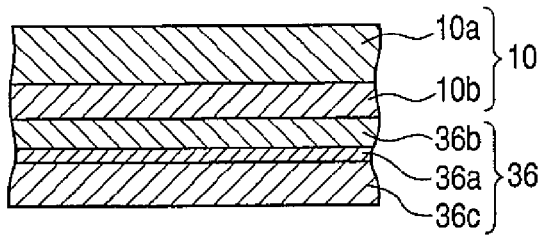
FIG. 2 is an end view showing an enlarged portion taken along II-II in FIG. 1.

Embodiments of the invention will be described with reference to the drawings. FIG. 1 is a typical view showing an image forming apparatus according to a first embodiment of the invention and FIG. 2 is an end view showing an enlarged portion taken along a II-II line in FIG. 1.

A charging roller 11 serving as charging unit, a developing roller 20 (Y, M, C and K) serving as developing unit, an intermediate transfer member 30 and a cleaning unit 12 are provided in the direction of a rotation around an image carrier 10. The image carrier 10 has a cylindrical conductive base material 10*a* (see FIG. 2) and a photosensitive layer 10*b* formed on a surface thereof. The charging roller 11 abuts on the outer peripheral surface of the image carrier 10 to uniformly charge the outer peripheral surface. A selective light L is exposed corresponding to desirable image information by an exposing unit over the outer peripheral surface of the image carrier 10 charged uniformly so that an electrostatic latent image is formed on the image carrier 10 by the exposed light L.

In the first embodiment, the developing roller 20Y for yellow, the developing roller 20C for cyan, the developing roller 20M for magenta and the developing roller 20K for black are provided as the developing roller 20. These developing rollers 20Y, 20C, 20M and 20K can selectively abut on the image carrier 10. At time of the abutment, any of yellow, cyan, magenta and black toners is given to the surface of the image carrier 10 so that the electrostatic latent image on the image carrier 10 is developed. The toner image thus developed is transferred onto an intermediate transfer belt 36 of the intermediate transfer device 30. A patch sensor PS serving as a toner density detecting unit is provided opposite to the surface of the intermediate transfer belt 36 in the vicinal position of the primary transfer region. The cleaning unit 12 includes a cleaner blade 13 for scraping off a toner remaining on and stuck to the outer peripheral surface of the image carrier 10 after the transfer and a receiving portion 14 for receiving the toner thus scraped off.

The intermediate transfer device 30 has a driving roller 31, four driven rollers 32, 33, 34 and 35, and the non-end intermediate transfer belt 36 stretched over each of the rollers. As shown in FIG. 2, the intermediate transfer belt 36 is constituted by a multilayer structure having a conductive layer 36*a* and a resistive layer 36*b* formed on the conductive layer 36*a* and pressed in contact with the image carrier 10. In the embodiment, the conductive layer 36*a* is formed on an insulating base member 36*c* formed of a synthetic resin, and a primary transfer voltage Vt1 is applied to the conductive layer 36*a* through an electrode roller 37. The resistive layer 36*b* is removed like a band in the side edge portion of the belt 36 so that the conductive layer 36*a* is exposed like the band and the electrode roller 37 comes in contact with the exposed portion. In a process in which the intermediate transfer belt 36 is circulated and driven, a toner image on the image carrier 10 is transferred onto the intermediate transfer belt 36 in a primary transfer portion T1, and a toner image transferred onto the intermediate transfer belt 36 is transferred by applying a secondary transfer voltage V2 to a recording medium S such as a paper supplied between the intermediate transfer belt 36 and a secondary transfer roller 38 in a secondary transfer portion T2. The recording medium S is fed from a paper feed device which is not shown and is supplied to the secondary transfer portion T2 in a predetermined timing by a gate roller pair 40. A cleaner blade 39*a* of a belt cleaner 39 abuts on the intermediate transfer belt 36 to remove the toner remaining on the intermediate transfer belt 36 after a secondary transfer and to drop the toner into a receiving portion 39*b*.

According to the image forming apparatus described above, the intermediate transfer belt 36 stretched over the rollers and pressed in contact with the image carrier 10 between rollers is constituted by the multilayer structure having the conductive layer 36*a* and the resistive layer 36*b* formed on the conductive layer 36*a* and pressed in contact with the image carrier 10. By applying a voltage having a reverse polarity to the polarity of the toner carried on the image carrier 10 to the conductive layer 36*a*, therefore, it is possible to transfer the toner on the image carrier 10 onto the intermediate transfer belt 36. The intermediate transfer belt 36 is constituted by the multilayer structure having the conductive layer 36*a* and the resistive layer 36*b* formed on the conductive layer 36*a* and pressed in contact with the photosensitive member 10. Therefore, an electric potential on the back side of the resistive layer 36*b* of the intermediate transfer belt 36 becomes uniform over the whole region of the pressure contact portion (that is, the primary transfer portion) T1 of the image carrier 10 with the intermediate transfer belt 36. As a result, it is possible to obtain a transfer having small toner scattering.

Moreover, the influence of the unevenness of the surface resistance of the intermediate transfer belt 36 is small and a transfer unevenness is generated with difficulty. In addition, the electric potential on the back side of the resistive layer 36*b* of the intermediate transfer belt 36 becomes uniform over the whole region of the pressure contact portion (that is, the primary transfer portion) T1 of the image carrier 10 with the intermediate transfer belt 36. Consequently, it is possible to carry out a transfer at a minimum voltage.

Figure 3:
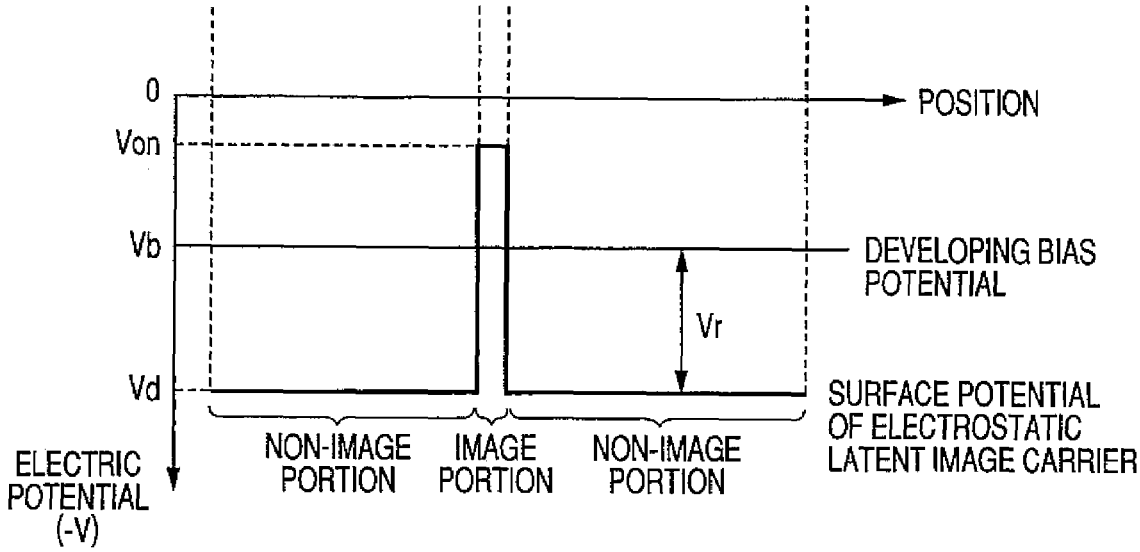
FIG. 3 is a diagram showing the principle of the image forming apparatus according to the invention.

A mechanism for forming an image in the image forming apparatus will be described with reference to FIG. 3. In the image forming apparatus according to the embodiment, the outer surface of the image carrier 10 is charged to have a negative surface potential Vo by the charging roller 11. When the light L exposed from the exposing unit is irradiated on the surface, a part of electric charges in the irradiated portion is neutralized so that the surface potential is changed to Von. Thus, scanning and exposure are carried out over the image carrier 10 while the light exposure L is turned ON/OFF corresponding to an image signal. Consequently, the electric potential of a surface region corresponding to an image portion is changed to Von ($\neq$Vo) in response to the image signal, while the electric potential of a surface region corresponding to a non-image portion is attenuated from the surface potential Vo obtained immediately after the charging to Vd ($|Vd| \leqq |Vo|$) by a dark decay. Thus, an electrostatic latent image corresponding to the image signal is formed on the image carrier 10. The electrostatic latent image thus formed is delivered to a developing position which is opposed to the developing roller 20 constituting the developing unit by the rotation of the image carrier 10. A toner charged to be negative is carried on the developing roller 20, and furthermore, a developing bias potential Vb to promote the toner to be stuck to the image portion of the image carrier 10 is applied thereto. As shown in FIG. 3, the developing bias potential Vb is set to have a value between the non-image portion potential Vd and the image portion potential Von. In a developing position, accordingly, the surface of the image carrier 10 has a lower electric potential than the developing roller 20 in a non-image portion, while the surface of the image carrier 10 has a higher electric potential than the developing roller 20 in an image portion. For this reason, any of the negative charged toners carried on the developing roller 20 which is placed in an opposed position to the image portion is moved to the image carrier 10 side by an electrostatic force, while a force in a drawing direction toward the developing roller 20 side acts on the toner placed in an opposed position to the non-image portion. Thus, the toner is stuck to only the image portion so that the electrostatic latent image on the image carrier 10 is revealed with the toner.

In the image forming process for forming a toner image, thus, it has been known that each of parameters such as the exposure energy of the exposed light L, the non-image portion potential Vd, the image portion potential Von and the developing bias potential Vb greatly influences the image density of a final toner image, and there have conventionally been proposed a large number of techniques for properly regulating some of these parameters as image density control factors, thereby optimizing the image density. In an actual image forming process, however, a toner image is formed with these parameters related mutually. For this reason, they cannot be always controlled isolatedly and optionally. In particular, a relative electric potential relationship between the developing bias potential Vb and the non-image portion potential Vd greatly influences the quality of a toner image which is obtained and the amount of toner scattering into the apparatus in addition to the shade of an image. In order to set the image density control factor with higher precision to form a toner image of high quality, therefore, it is important that these values are to be properly set. The absolute value of the potential difference between the developing bias potential Vb and the non-image portion potential Vd will be referred to as a reverse contrast potential Vr. More specifically, the reverse contrast potential Vr is set to be $Vr=|Vb-Vd|$.

In order to investigate the influence of the relationship between the electric potentials, first of all, there will be considered the case in which the developing bias potential Vb is approximated to the level of the non-image portion potential Vd to reduce the reverse contrast potential Vr. At this time, the potential difference between the image portion potential Von and the developing bias potential Vb, that is, the contrast potential ($=|Vb-Von|$) is increased and the movement of the toner from the developing roller 20 to the image carrier 10 is promoted in the image portion. Consequently, it is possible to obtain a high image density. On the other hand, however, the potential difference from the developing roller 20 is reduced in the non-image portion of the image carrier 10. Therefore, an action for returning an extra toner to the developing roller 20 side is reduced. For this reason, the amount of the toner liberated from the developing roller 20 and scattering into the apparatus is increased. On the other hand, when the developing bias potential Vb is exactly maintained and the absolute value of the non-image portion potential Vd is increased to raise the reverse contrast potential Vr, the amount of the toner scattering into the apparatus can be decreased and a force for repelling a negative charged toner by a negative charge held in the non-image portion of the image carrier 10 is increased. For this reason, the toner is stuck, with difficulty, to an image portion in a narrow region interposed between the non-image portions, particularly, in an electrostatic latent image. As a result, the quality of a low density image having a comparatively low area ratio of a dot is deteriorated, for example, an isolated dot or a fine line is blurred or the uniformity of a line width is deteriorated.

Thus, it is preferable to increase the reverse contrast potential Vr in order to suppress the toner scattering, while there is a contradicting demand for reducing the reverse contrast potential Vr in order to maintain the quality of an image, for example, the uniformity of a fine line. In order to form an image of high picture quality while suppressing the toner scattering into the apparatus, it is necessary to set a parameter, for example, the developing bias potential Vb in such a manner that the reverse contrast potential Vr always has a proper value. When optimizing the forming density control factor of a halftone toner image, particularly, the quality of the reproducibility of a very small dot or a fine line greatly influences precision. In order to set the image density control factor with high precision, therefore, it is important to form a patch image in a state in which the reverse contrast potential Vr is maintained to have a proper value.

For this reason, there is provided a control unit for holding the potential difference between the developing bias potential Vb and the non-image portion potential Vd on the image carrier 10, that is, the reverse contrast potential Vr to be constant, and furthermore, forming a halftone toner image as a patch image while setting and changing an image density control factor to influence the image density of a toner image in a multistage, optimizing the image density control factor based on the result of the detection of the image density of the patch image which is obtained by the density detecting unit, thereby controlling the image density of a toner image formed by the developing unit. In a developing bias optimization processing in the optimization of the image density control factor, for example, the developing bias potential Vb is changed and set in a multistage to form the patch image in a state in which the absolute values of an exposure energy and a non-image portion potential are fixed to be maximum values within a variable range thereof. When the absolute value of the non-image portion potential Vd is maximized, the reverse contrast potential $Vr=|Vb-Vd|$ is maximized also in any developing bias potential Vb so that the toner scattering in the apparatus can be minimized. With such a structure, the potential difference between the developing bias potential Vb and the non-image portion potential Vd, that is, the reverse contrast potential Vr is held to be constant when the halftone toner image is to be formed as the patch image. Therefore, it is possible to form such a patch image on the condition that the very small dot and the fine line to be used for obtaining a halftone have an excellent reproducibility. Consequently, it is possible to carry out the processing of optimizing the image density control factor with high precision based on the image density of the patch image. As a result, it is possible to stably form a toner image of high picture quality. By maintaining the reverse contrast potential Vr to have a proper value, furthermore, it is also possible to effectively suppress the toner scattering into the apparatus as described above. In order to stably form a toner image on a low density side, particularly, it is desirable to use a patch image having a dot area ratio to the whole patch image of 20% or less.

Figure 4:
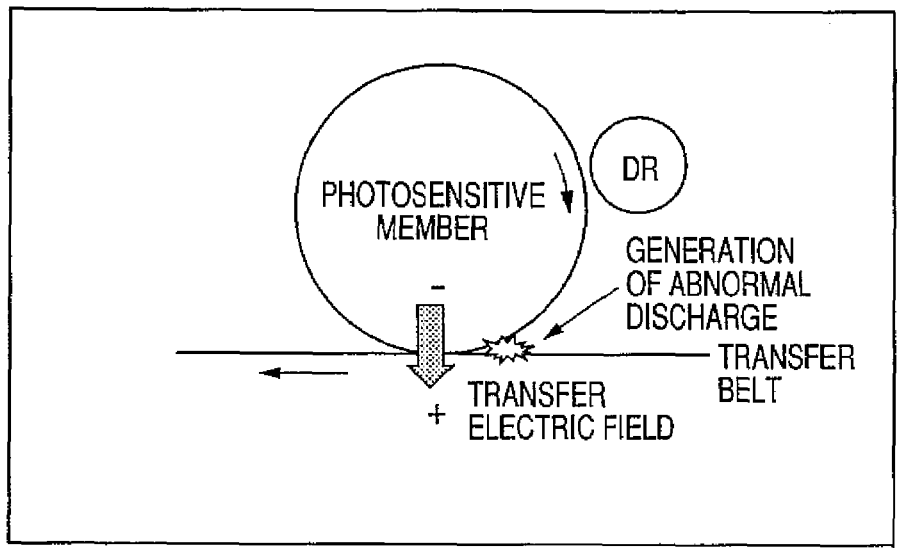
FIG. 4 is a view for explaining the state of an abnormal discharge.

In the image forming apparatus using the intermediate transfer belt 36 having the multilayer structure including the conductive layer 36*a* and the resistive layer 36*b*, as shown in FIG. 4, in some cases in which a potential difference $Vdt=|Vd-Vt1|$ between the non-image portion potential Vd on the image carrier (photosensitive member) 10 and the primary transfer bias potential Vt1 is increased, an abnormal image is generated partially or wholly due to an abnormal discharge in the primary transfer portion. This phenomenon is particularly remarkable in a half image.

Figure 5A:
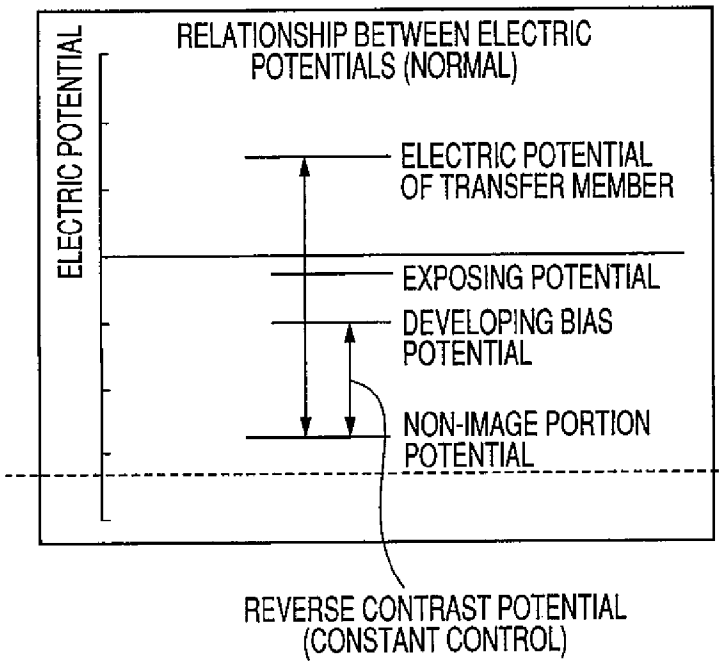
FIGS. 5A and 5B are diagrams showing a relationship between electric potentials in a normal state and a state in which an abnormal discharge is generated.
Figure 5B:
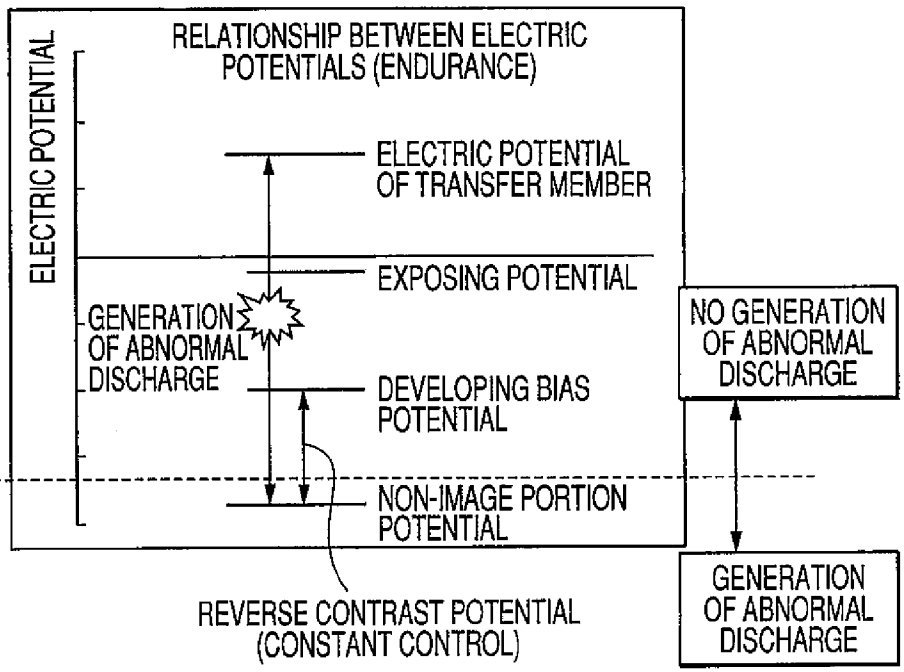

A mechanism for generating the phenomenon will be described based on a relationship between electric potentials shown in FIGS. 5A and 5A. FIG. 5A shows a relationship between electric potentials in a normal mode, and a primary transfer is carried out while the reverse contrast potential Vr to be the difference between the developing bias potential Vb and the non-image portion potential Vd is held to be constant. The potential difference Vdt=|Vd−Vt1| between the non-image portion potential Vd and the primary transfer bias potential Vt1 is equal to or smaller than a threshold Vth of the generation of an abnormal discharge. Therefore, an abnormal image can be prevented from be generated due to the abnormal discharge. FIG. 5B shows the relationship between the electric potentials in a state in which the abnormal discharge is generated. In this case, when the primary transfer is carried out while the reverse contrast potential Vr to be the difference between the developing bias potential Vb and the non-image portion potential Vd is held to be constant, the thickness of the photosensitive layer of the image carrier is decreased and the threshold of the generation of the abnormal discharge is reduced, and furthermore, a developing property (a flying property) is deteriorated after a large number of sheets are printed. Consequently, it is necessary to set the developing bias potential Vb to be high. The developing bias potential Vb is set to be high so that it is necessary to hold the reverse bias potential Vr to be constant. Consequently, the non-image portion potential Vd is also set to be high and the potential difference Vdt=|Vd−Vt1| between the non-image portion potential Vd and the primary transfer bias potential Vt1 exceeds the threshold Vth of the generation of the abnormal discharge so that an abnormal image is generated due to the abnormal discharge.

Figure 6:
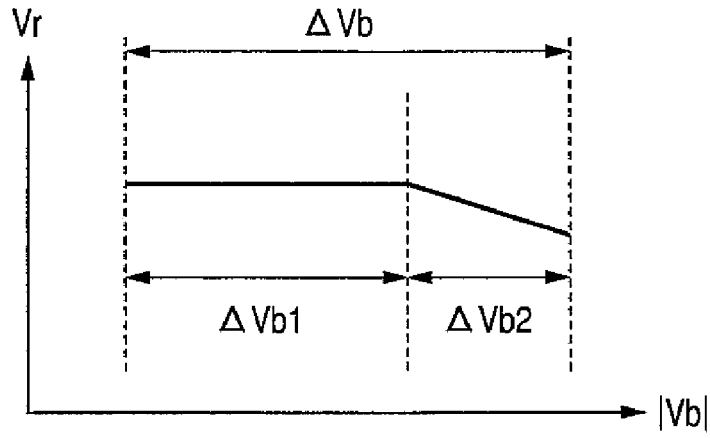
FIG. 6 is a chart for explaining two control regions in an abnormal discharge countermeasure mode according to the invention.
Figure 7:
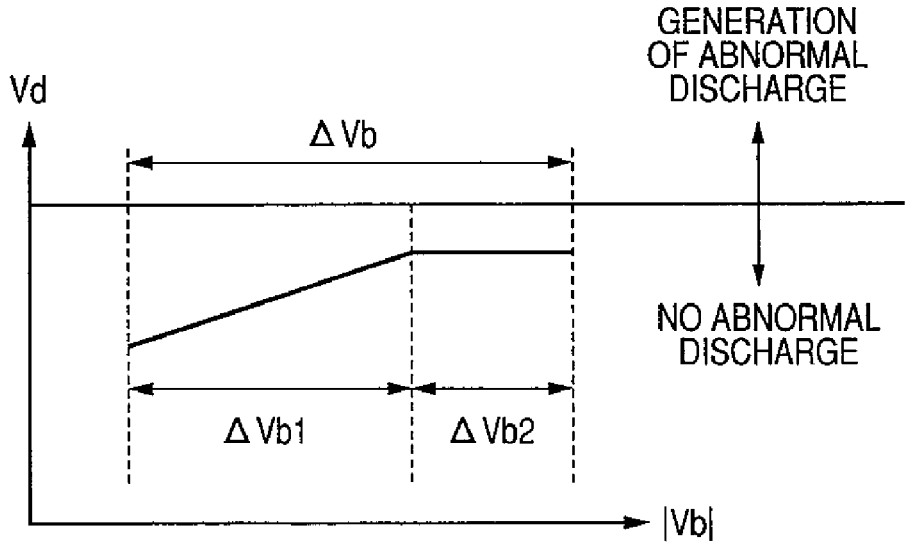
FIG. 7 is a chart for explaining the two control regions in the abnormal discharge countermeasure mode according to the invention.

For preventing the generation of the abnormal image due to the abnormal discharge, the control unit of the image forming apparatus according to the first embodiment of the invention has an abnormal discharge countermeasure mode. In the abnormal discharge countermeasure mode, a control region ΔVb1 for holding the reverse contrast potential Vr so as to become a constant and a control region ΔVb2 for decreasing the reverse contrast potential Vr are set as shown in FIG. 6 in order to cause the potential difference Vdt=|Vd−Vt1| between the non-image portion potential Vd and the primary transfer bias potential Vt1 to be equal to or smaller than the threshold Vth of the generation of the abnormal discharge. The reverse contrast potential Vr is the difference between the developing bias potential Vb and the non-image portion potential Vd. In other words, in the control region ΔVb1 in a normal state in which the abnormal image is not generated due to the abnormal discharge, the reverse contrast potential Vr is held to be constant and a toner image of high picture quality is stably formed, and furthermore, the toner scattering into the apparatus is also suppressed effectively. In the control region ΔVb2 in the case in which the abnormal image might be generated due to the abnormal discharge or the case in which the abnormal image is generated due to the abnormal discharge, a control is carried out in such a direction that the primary transfer bias potential Vt1 is exactly maintained and the reverse contrast potential Vr is decreased in order to cause the potential difference Vdt between the non-image portion potential Vd and the primary transfer bias potential Vt1 to be equal to or smaller than the threshold Vth of the generation of the abnormal discharge. In other words, even if the developing bias potential Vb is set to be high in order to maintain the developing property, the control is carried out to cause the non-image portion potential Vd to be equal to or smaller than the threshold Vth of the generation of the abnormal discharge so that the abnormal image can be prevented from being generated due to the abnormal discharge. FIG. 7 shows an embodiment in which the control is carried out to fix the non-image portion potential Vd and the potential difference Vdt between the non-image portion potential Vd and the primary transfer bias potential Vt1 is set to be equal to or smaller than the threshold Vth of the generation of the abnormal discharge in the control region ΔVb2 in which the reverse contrast potential Vr in the abnormal discharge countermeasure mode is decreased.

Figure 8:
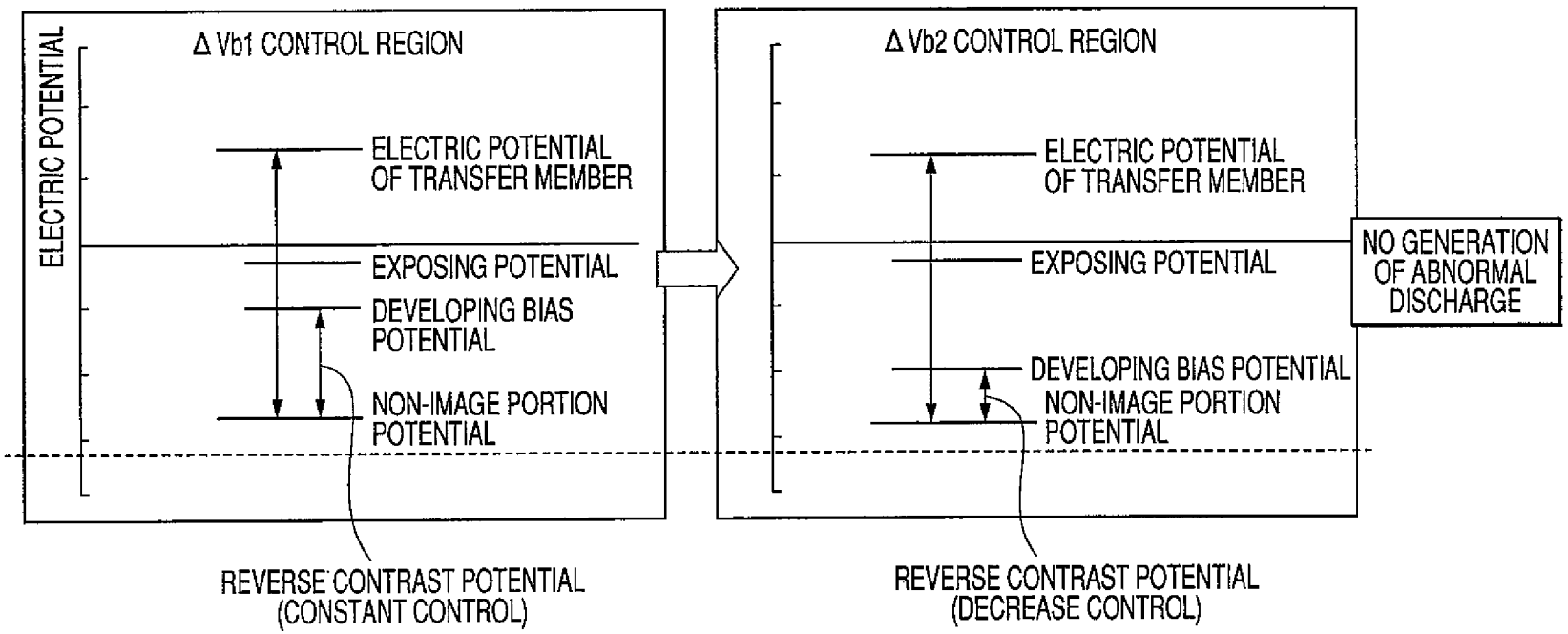
FIG. 8 is a diagram showing a relationship between electric potentials in the two control regions in the abnormal discharge countermeasure mode.

FIG. 8 shows a relationship between electric potentials in the control region ΔVb2 for decreasing the reverse contrast potential Vr in the abnormal discharge countermeasure mode. A control is carried out to hold the primary transfer bias potential Vt1 to be constant, and furthermore, to hold the non-image portion potential Vd to be constant. Even if the developing bias potential Vb is set to be high in order to hold a developing property, the reverse contrast potential Vr is decreased. However, the potential difference Vdt between the non-image portion potential Vd and the primary transfer bias potential Vt1 can be held to be equal to or smaller than the threshold Vth of the generation of the abnormal discharge. Consequently, it is possible to prevent an abnormal image from being generated due to an abnormal discharge.

The normal mode and the abnormal discharge countermeasure mode can be switched by the operation of a control panel provided in the apparatus body. Consequently, the control region ΔVb2 for decreasing the reverse contrast potential Vr is held only when the abnormal image is generated due to the abnormal discharge. Therefore, it is possible to minimize the influence of a reduction in the reverse contrast potential Vr.

As described above, moreover, the apparatus body may be provided with sensors 100 for detecting information about a lifetime such as the number of used sheets and information about an environment such as a temperature and humidity and an air pressure which are the fluctuation factors of the threshold Vth of the generation of the abnormal discharge with the potential difference Vdt between the non-image portion potential Vd and the primary transfer bias potential Vt1, and thus, the normal mode and the abnormal discharge countermeasure mode may be switched based on data transmitted from each of the sensors 100.

Table 1 shows the result of an experiment in the image forming apparatus according to the first embodiment of the invention.

TABLE 1

| Vb (Development) | Vd (Non-image portion potential) | Vr (=IVb − VdI) | Vt1 (Primary transfer) | Vdt (=IVd − Vt1I) | Presence of abnormal discharge, (No, Yes) | Fine line density | Amount of scattering | Remark |
|---|---|---|---|---|---|---|---|---|
| | | | NG example | | | | | |
| −100 | −500 | −400 | 300 | 800 | No | Normal | Normal | |
| −150 | −550 | −400 | 300 | 850 | No | Normal | Normal | |
| −200 | −600 | −400 | 300 | 900 | No | Normal | Normal | |

TABLE 1-continued

| | | | | | | | | |
|---|---|---|---|---|---|---|---|---|
| −250 | −650 | −400 | 300 | 950 | No | Normal | Normal | |
| −300 | −700 | −400 | 300 | 1000 | No | Normal | Normal | |
| −350 | −750 | −400 | 300 | 1050 | Yes | Normal | Normal | |
| −400 | −800 | −400 | 300 | 1100 | Yes | Normal | Normal | |
| In the case in which a discharge threshold is 1000 V | | | | | | | | |
| Contribute to a fine line density | | | | | | | | |
| | | | Example of countermeasure | | | | | |
| −100 | −500 | −400 | 300 | 800 | No | Normal | Normal | |
| −150 | −550 | −400 | 300 | 850 | No | Normal | Normal | |
| −200 | −600 | −400 | 300 | 900 | No | Normal | Normal | |
| −250 | −650 | −400 | 300 | 950 | No | Normal | Normal | |
| −300 | −700 | −400 | 300 | 1000 | No | Normal | Normal | |
| −350 | −700 | −350 | 300 | 1000 | No | Slightly high | Slightly large | Regulated with exposure power |
| −400 | −700 | −300 | 300 | 1000 | No | Slightly high | Slightly large | Regulated with exposure power |

In the case in which a discharge threshold is 1000 V

As is seen from the result of an experiment shown in the Table 1, it has been found that the potential difference Vdt between the non-image portion potential Vd and the primary transfer bias potential Vt1 can be caused to be equal to or smaller than the threshold Vth of the generation of the abnormal discharge and an abnormal image can be prevented from being generated due to an abnormal discharge by setting the control region ΔVb2 for decreasing the reverse contrast potential Vr in the region for generating the abnormal image due to the abnormal discharge in the abnormal discharge countermeasure mode.

Next, a second embodiment will be described with reference to drawings. Hence, the identical parts and portions will be denoted by the same reference numerals, and a detailed description thereof will be omitted. In this embodiment, the image forming apparatus includes a control unit for holding the potential difference between the developing bias potential Vb and the non-image portion potential Vd on the image carrier 10, that is, the reverse contrast potential Vr to be constant while maintaining the primary transfer potential to be constant in the normal mode, and furthermore, forming a halftone toner image as a patch image while setting and changing an image density control factor to influence the image density of a toner image in a multistage, and optimizing the image density control factor based on the result of the detection of the image density of the patch image which is obtained by the density detecting unit, thereby controlling the image density of a toner image formed by the developing unit. In a developing bias optimization processing in the optimization of the image density control factor, for example, the developing bias potential Vb is changed and set in a multistage to form the patch image in a state in which the absolute values of an exposure energy and a non-image portion potential are fixed to be maximum values within a variable range thereof. When the absolute value of the non-image portion potential Vd is maximized, the reverse contrast potential Vr=|Vb−Vd| is maximized also in any developing bias potential Vb so that the toner scattering in the apparatus can be minimized. With such a structure, the potential difference between the developing bias potential Vb and the non-image portion potential Vd, that is, the reverse contrast potential Vr is held to be constant when the halftone toner image is to be formed as the patch image. Therefore, it is possible to form such a patch image on the condition that the very small dot and the fine line to be used for obtaining a halftone have an excellent reproducibility. Consequently, it is possible to carry out the processing of optimizing the image density control factor with high precision based on the image density of the patch image. As a result, it is possible to stably form a toner image of high picture quality. By maintaining the reverse contrast potential Vr to have a proper value, furthermore, it is also possible to effectively suppress the toner scattering into the apparatus as described above. In order to stably form a toner image on a low density side, particularly, it is desirable to use a patch image having a dot area ratio to the whole patch image of 20% or less.

Since a relationship between the primary transfer potential Vt1 and a primary transfer efficiency generally draws an upward convex curve, moreover, it is used in the vicinity of a maximum value thereof. When the primary transfer efficiency is reduced, a toner remains on the surface of the image carrier after passing through the primary transfer portion so that the amount of a waste toner collected by a cleaning member is increased. If the primary transfer efficiency is low, therefore, it is necessary to increase the capacity of a waste toner vessel so that the size of the apparatus is increased. For this reason, it is necessary to maintain the primary transfer efficiency to have a proper value.

In the image forming apparatus using the intermediate transfer belt 36 having the multilayer structure including the conductive layer 36*a* and the resistive layer 36*b*, as shown in FIG. 4, in some cases in which a potential difference Vdt=|Vd−Vt1| between the non-image portion potential Vd on the image carrier (photosensitive member) 10 and the primary transfer bias potential Vt1 is increased, an abnormal image is generated partially or wholly due to an abnormal discharge in the primary transfer portion. This phenomenon is particularly remarkable in a half image.

Figure 9A:
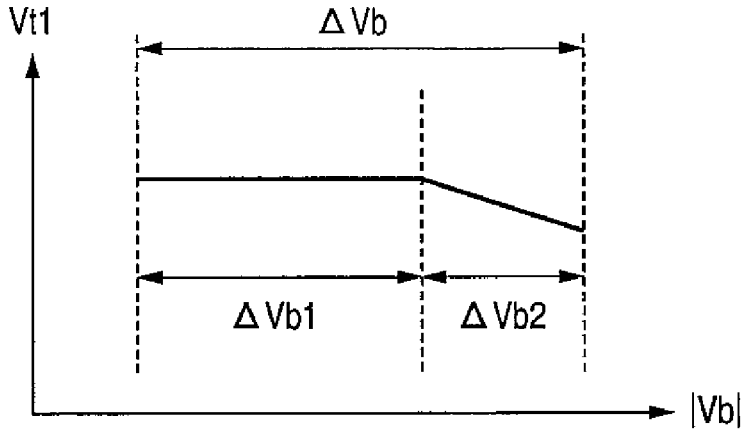
FIGS. 9A and 9B are charts for explaining two control regions in an abnormal discharge countermeasure mode according to a second embodiment of the invention.
Figure 9B:
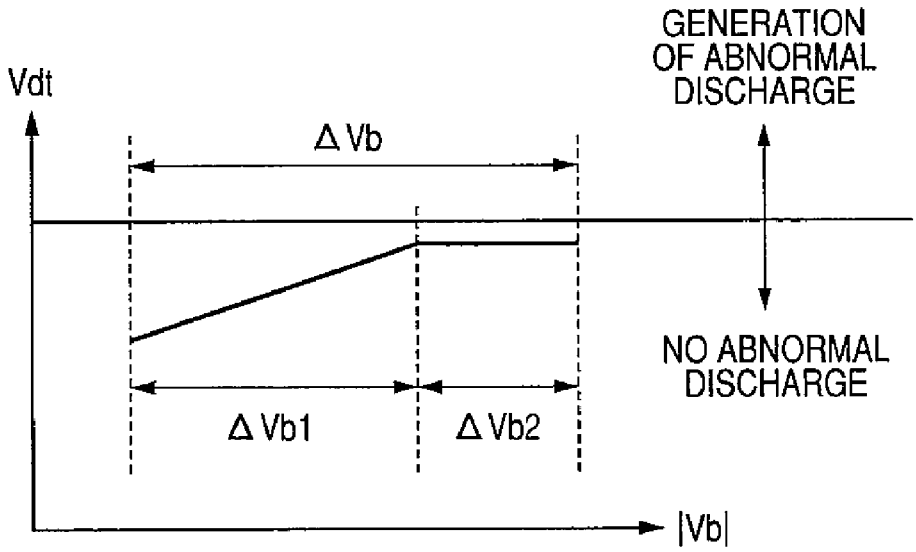

For preventing the generation of the abnormal image due to the abnormal discharge, the control unit of the image forming apparatus according to the invention has an abnormal discharge countermeasure mode. In the abnormal discharge countermeasure mode, a control region ΔVb1 for holding the primary transfer bias potential Vt1 to be constant and a control region ΔVb2 for decreasing the primary transfer bias potential Vt1 are set as shown in FIGS. 9A and 9B in order to cause the potential difference Vdt=|Vd−Vt1| between the non-image portion potential Vd and the primary transfer bias potential Vt1 to be equal to or smaller than the threshold Vth of the generation of the abnormal discharge. In other words, in the control region ΔVb1 in a normal state in which the abnormal image is not generated due to the abnormal discharge, the primary transfer bias potential Vt1 is held to be constant and is used in a state in which the primary transfer efficiency is high so that it is possible to carry out a primary transfer in a small amount of a waste toner. In the control region ΔVb2 in the case in which the abnormal image might be generated due to the abnormal discharge or the case in which the abnormal image is generated due to the abnormal discharge, a control is carried out in such a direction as to decrease the primary transfer bias potential Vt1 in order to cause the potential difference Vdt between the non-image portion potential Vd and the primary transfer bias potential Vt1 to be equal to or smaller than the threshold Vth of the generation of the abnormal discharge. In other words, even if the developing bias potential Vb is set to be high and the non-image portion potential Vd is also set to be correspondingly high in order to maintain the developing property, the control is carried out to cause the potential difference Vdt between the non-image portion potential Vd and the primary transfer bias potential Vt1 to be equal to or smaller than the threshold Vth of the generation of the abnormal discharge so that the abnormal image can be prevented from being generated due to the abnormal discharge.

Figure 10:
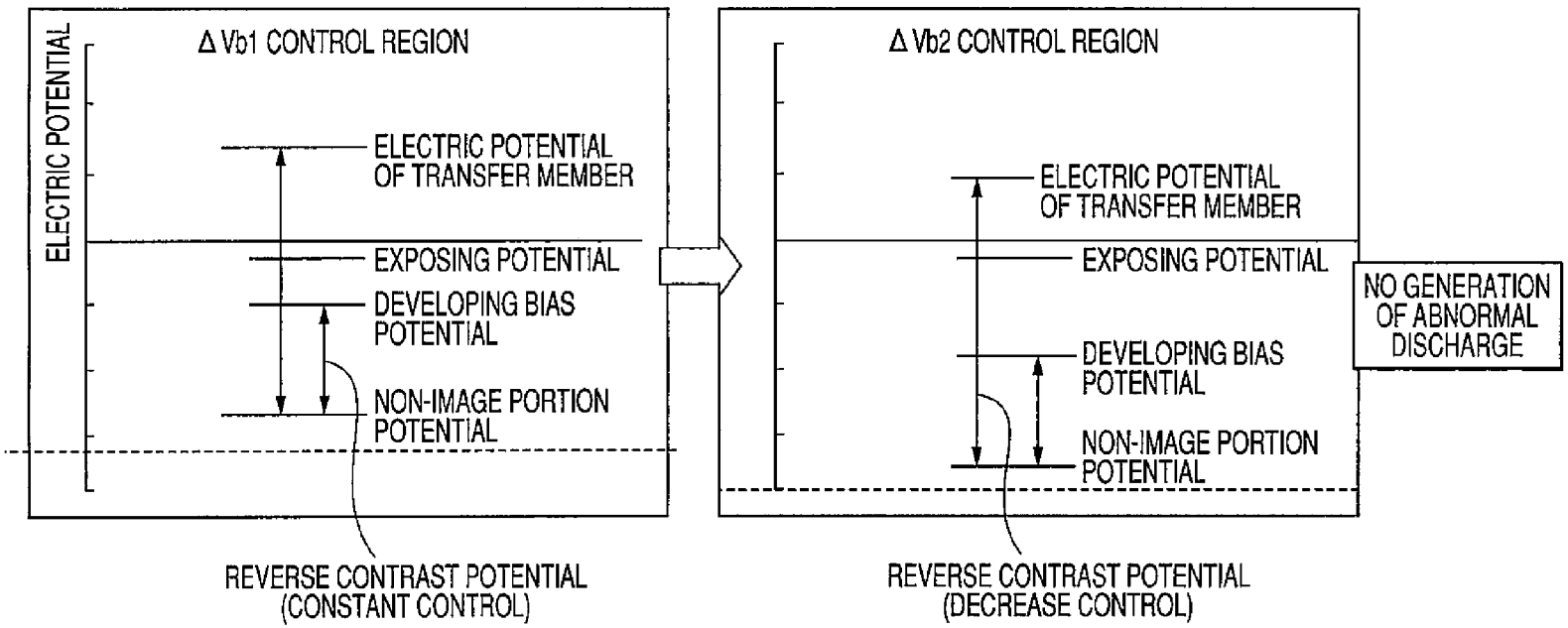
FIG. 10 is a diagram showing a relationship between electric potentials in the two control regions in the abnormal discharge countermeasure mode.

FIG. 10 shows a relationship between electric potentials in the control region ΔVb2 for decreasing the primary transfer bias potential Vt1 in the abnormal discharge countermeasure mode. It is possible to control the primary transfer bias potential Vt1 to be decreased while controlling the reverse contrast potential Vr to be constant, thereby holding the potential difference Vdt between the non-image portion potential Vd and the primary transfer bias potential Vt1 to be equal to or smaller than the threshold Vth of the generation of the abnormal discharge. Consequently, it is possible to prevent the abnormal image from being generated due to the abnormal discharge.

The normal mode and the abnormal discharge countermeasure mode can be switched by the operation of a control panel provided in the apparatus body. Only when the abnormal image is generated due to the abnormal discharge, consequently, the switching to the control region ΔVb2 for decreasing the primary transfer bias potential Vt1 is carried out. Therefore, it is possible to minimize the influence of a reduction in the primary transfer efficiency due to the decrease in the primary transfer bias potential Vt1.

As described above, moreover, the apparatus body may be provided with sensors for detecting information about a lifetime such as the number of used sheets and information about an environment such as a temperature and humidity and an air pressure which are the fluctuation factors of the threshold Vth of the generation of the abnormal discharge with the potential difference Vdt between the non-image portion potential Vd and the primary transfer bias potential Vt1, and thus, the normal mode and the abnormal discharge countermeasure mode may be switched based on data transmitted from each of the sensors.

Table 2 shows the result of an experiment in the image forming apparatus according to the second embodiment of the invention.

TABLE 2

NG example

| Vb (Development) | Vd (Non-image portion potential) | Vr (=IVb − VdI) | Vt1 (Primary transfer) | Vdt (=IVd − Vt1I) | Presence of abnormal discharge, (No, Yes) | Fine line density | Amount of scattering |
|---|---|---|---|---|---|---|---|
| −100 | −500 | −400 | 300 | 800 | No | Normal | Normal |
| −150 | −550 | −400 | 300 | 850 | No | Normal | Normal |
| −200 | −600 | −400 | 300 | 900 | No | Normal | Normal |
| −250 | −650 | −400 | 300 | 950 | No | Normal | Normal |
| −300 | −700 | −400 | 300 | 1000 | No | Normal | Normal |
| −350 | −750 | −400 | 300 | 1050 | Yes | Normal | Normal |
| −400 | −800 | −400 | 300 | 1100 | Yes | Normal | Normal |

In the case in which a discharge threshold is 1000 V
Contribute to a fine line density Example of countermeasure

| Vb (Development) | Vd (Non-image portion potential) | Vr (=IVb − VdI) | Vt1 (Primary transfer) | Vdt (=IVd − Vt1I) | Presence of abnormal discharge, (No, Yes) | Fine line density | Transfer efficiency |
|---|---|---|---|---|---|---|---|
| −100 | −500 | −400 | 300 | 800 | No | Normal | Normal |
| −150 | −550 | −400 | 300 | 850 | No | Normal | Normal |
| −200 | −600 | −400 | 300 | 900 | No | Normal | Normal |
| −250 | −650 | −400 | 300 | 950 | No | Normal | Normal |
| −300 | −700 | −400 | 300 | 1000 | No | Normal | Normal |
| −350 | −700 | −400 | 250 | 1000 | No | Normal | Slightly reduced |
| −400 | −800 | −400 | 200 | 1000 | No | Normal | Slightly reduced |

In the case in which a discharge threshold is 1000 V

As is apparent from the result of an experiment shown in the Table 2, the potential difference Vdt between the non-image portion potential Vd and the primary transfer bias potential Vt1 can be caused to be equal to or smaller than the threshold Vth of the generation of the abnormal discharge and an abnormal image can be prevented from being generated due to an abnormal discharge by setting the control region ΔVb2 for decreasing the primary transfer bias potential Vt1 in the region in which the abnormal image is generated due to the abnormal discharge in the abnormal discharge countermeasure mode.

Next, a third embodiment will be described with reference to drawings. Hence, the identical parts and portions will be denoted by the same reference numerals, and a detailed description thereof will be omitted. In this embodiment, the image forming apparatus includes a control unit for holding the potential difference between the developing bias potential Vb and the non-image portion potential Vd on the image carrier 10, that is, the reverse contrast potential Vr to be constant, and furthermore, forming a halftone toner image as a patch image while setting and changing an image density control factor to influence the image density of a toner image in a multistage, and optimizing the image density control factor based on the result of the detection of the image density of the patch image which is obtained by the density detecting unit, thereby controlling the image density of a toner image formed by the developing unit. In a developing bias optimization processing in the optimization of the image density control factor, for example, the developing bias potential Vb is changed and set in a multistage to form the patch image in a state in which the absolute values of an exposure energy and a non-image portion potential are fixed to be maximum values within a variable range thereof. When the absolute value of the non-image portion potential Vd is maximized, the reverse contrast potential Vr=|Vb−Vd| is maximized also in any developing bias potential Vb so that the toner scattering in the apparatus can be minimized. The potential difference between the developing bias potential Vb and the non-image portion potential Vd, that is, the reverse contrast potential Vr is held to be constant when the halftone toner image is to be formed as the patch image. Therefore, it is possible to form such a patch image on the condition that the very small dot and the fine line to be used for obtaining a halftone have an excellent reproducibility. Consequently, it is possible to carry out the processing of optimizing the image density control factor with high precision based on the image density of the patch image. As a result, it is possible to stably form a toner image of high picture quality. By maintaining the reverse contrast potential Vr to have a proper value, furthermore, it is also possible to effectively suppress the toner scattering into the apparatus as described above. In order to stably form a toner image on a low density side, particularly, it is desirable to use a patch image having a dot area ratio to the whole patch image of 20% or less.

In the image forming apparatus using the intermediate transfer belt 36 having the multilayer structure including the conductive layer 36*a* and the resistive layer 36*b*, as shown in FIG. 4, in some cases in which a potential difference Vdt=|Vd−Vt1| between the non-image portion potential Vd on the image carrier (photosensitive member) 10 and the primary transfer bias potential Vt1 is increased, an abnormal image is generated partially or wholly due to an abnormal discharge in the primary transfer portion. This phenomenon is particularly remarkable over a half image.

In order to detect the generation of the abnormal image due to the abnormal discharge, a toner density detecting unit is provided opposite to the surface of the image carrier or the intermediate transfer belt, thereby measuring the density of a predetermined patch image formed on the image carrier or the intermediate transfer belt. Referring to the density of the predetermined patch image, for example, the toner image of an image having a low density (a dot area ratio of 10%) after an image having a high density (a dot area ratio of 100%) is compared with that of an image having a low density (a dot area ratio of 10%) after an image having a medium density (a dot area ratio of 30%) and an abnormal image is decided to be generated due to an abnormal discharge when a predetermined difference or more is detected from both of them. The reason why the patch image having the low density after the high density is compared with the patch image having the low density after the medium density is that the probability of the abnormal discharge in a toner image having a low density is higher than that in a toner image having a high density and a difference in the density can be measured more easily with the low density.

Figure 11:
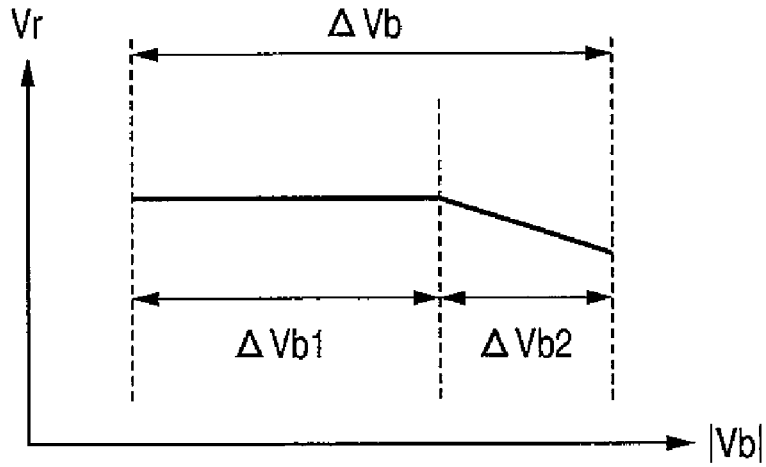
FIG. 11 is a chart for explaining two control regions in an abnormal discharge countermeasure mode according to a third embodiment of the invention.
Figure 12:
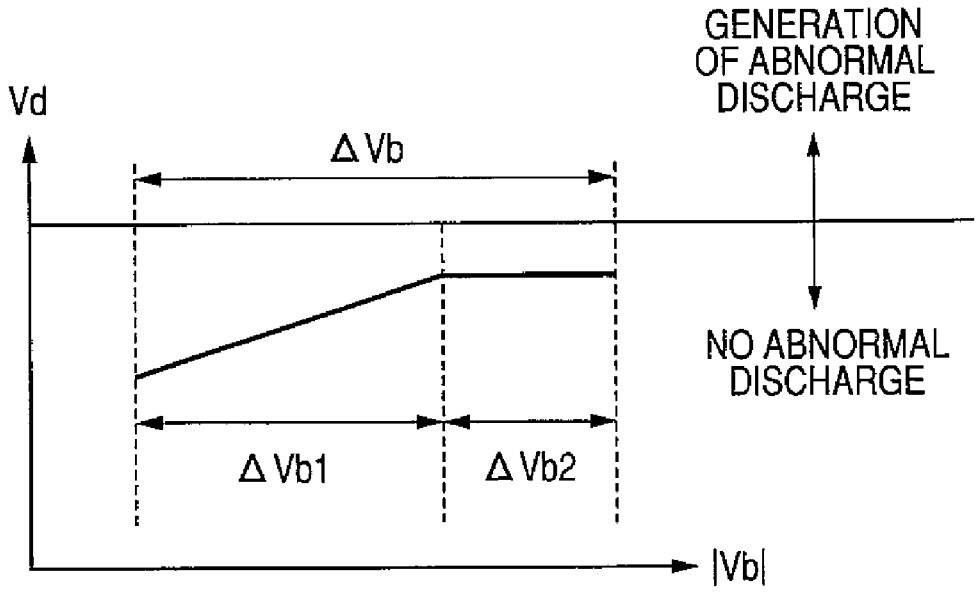
FIG. 12 is a chart for explaining the two control regions in the abnormal discharge countermeasure mode according to the third embodiment of the invention.

For preventing the generation of the abnormal image due to the abnormal discharge, the control unit of the image forming apparatus according to the invention has an abnormal discharge countermeasure mode. In the abnormal discharge countermeasure mode, a control region ΔVb1 for holding the reverse contrast potential Vr to be the difference between the developing bias potential Vb and the non-image portion potential Vd to be constant and a control region ΔVb2 for decreasing the reverse contrast potential Vr to be the difference between the developing bias potential Vb and the non-image portion potential Vd are set as shown in FIG. 11 in order to cause the potential difference Vdt=|Vd−Vt1| between the non-image portion potential Vd and the primary transfer bias potential Vt1 to be equal to or smaller than the threshold Vth of the generation of the abnormal discharge. In other words, in the region in which the abnormal image is not generated due to the abnormal discharge, the reverse contrast potential Vr is held to be constant and a toner image of high picture quality is stably formed, and furthermore, the toner scattering into the apparatus is also suppressed effectively. In the abnormal discharge countermeasure mode in the case in which the abnormal image might be generated due to the abnormal discharge or is generated due to the abnormal discharge by the detection of the density through the patch image, a control is carried out in such a direction that the primary transfer bias potential Vt1 is exactly maintained and the reverse contrast potential Vr is decreased in order to cause the potential difference Vdt between the non-image portion potential Vd and the primary transfer bias potential Vt1 to be equal to or smaller than the threshold Vth of the generation of the abnormal discharge in the control region ΔVb2. In other words, even if the developing bias potential Vb is set to be high in order to maintain the developing property, the control is carried out to cause the non-image portion potential Vd to be equal to or smaller than the threshold Vth of the generation of the abnormal discharge so that the abnormal image can be prevented from being generated due to the abnormal discharge. FIG. 12 shows an embodiment in which the control is carried out to fix the non-image portion potential Vd and the potential difference Vdt between the non-image portion potential Vd and the primary transfer bias potential Vt1 is set to be equal to or smaller than the threshold Vth of the generation of the abnormal discharge in the control region ΔVb2 in which the reverse contrast potential Vr in the abnormal discharge countermeasure mode is decreased.

Figure 13:
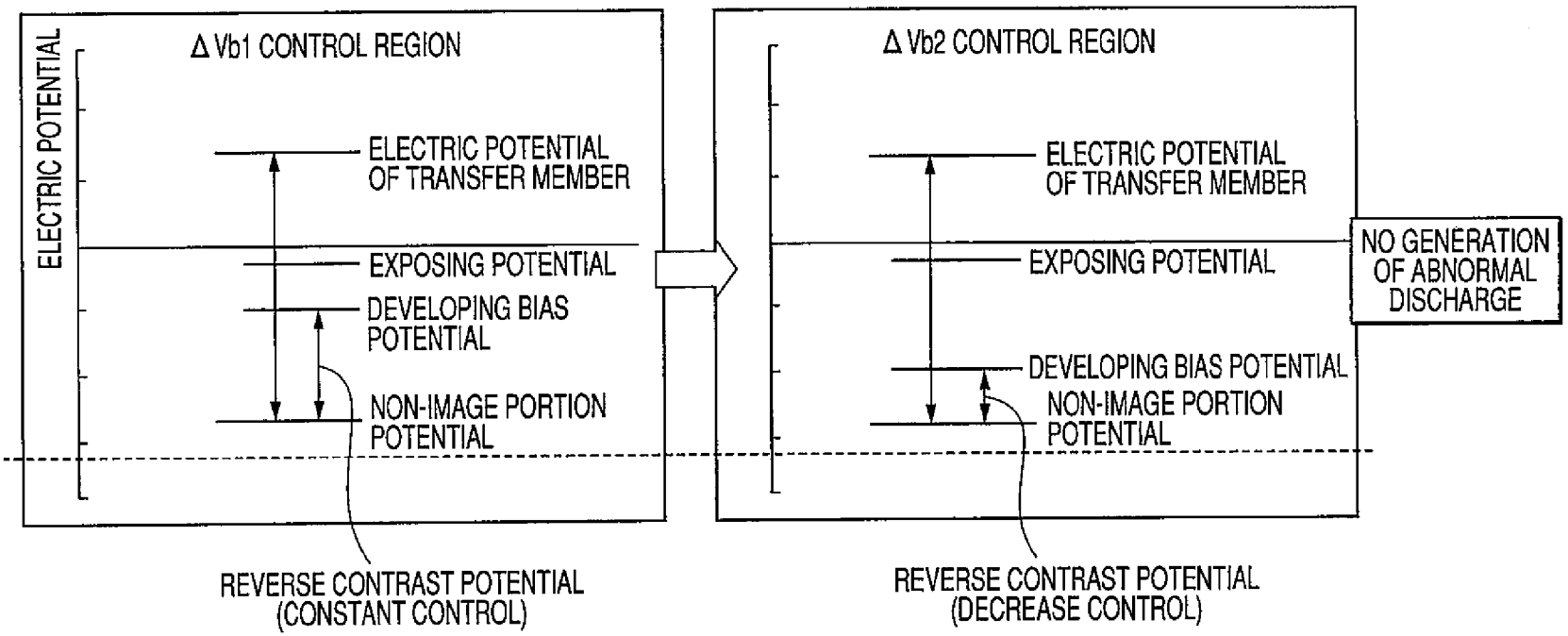
FIG. 13 is a diagram showing a relationship between electric potentials in the two control regions in the abnormal discharge countermeasure mode.

FIG. 13 shows a relationship between electric potentials in the control region ΔVb2 for decreasing the reverse contrast potential Vr in the abnormal discharge countermeasure mode. A control is carried out to hold the primary transfer bias potential Vt1 to be constant, and furthermore, to hold the non-image portion potential Vd to be constant. Even if the developing bias potential Vb is set to be high in order to hold a developing property, the reverse contrast potential Vr is decreased. However, the potential difference Vdt between the non-image portion potential Vd and the primary transfer bias potential Vt1 can be held to be equal to or smaller than the threshold Vth of the generation of the abnormal discharge. Consequently, it is possible to prevent an abnormal image from being generated due to an abnormal discharge.

The normal mode and the abnormal discharge countermeasure mode can be switched by the operation of a control panel provided in the apparatus body in addition to the operation of the toner density detecting unit through the patch image. Consequently, the switching to the control region ΔVb2 for decreasing the reverse contrast potential Vr is carried out only when the abnormal image is generated due to the abnormal discharge. Therefore, it is possible to minimize the influence of a reduction in the reverse contrast potential Vr.

As described above, moreover, the apparatus body may be provided with sensors for detecting information about a lifetime such as the number of used sheets and information about an environment such as a temperature and humidity and an air pressure which are the fluctuation factors of the threshold Vth of the generation of the abnormal discharge with the potential difference Vdt between the non-image portion potential Vd and the primary transfer bias potential Vt1, and thus, it is also possible to add the function of switching the normal mode and the abnormal discharge countermeasure mode based on data sent from each sensor.

Figure 14:
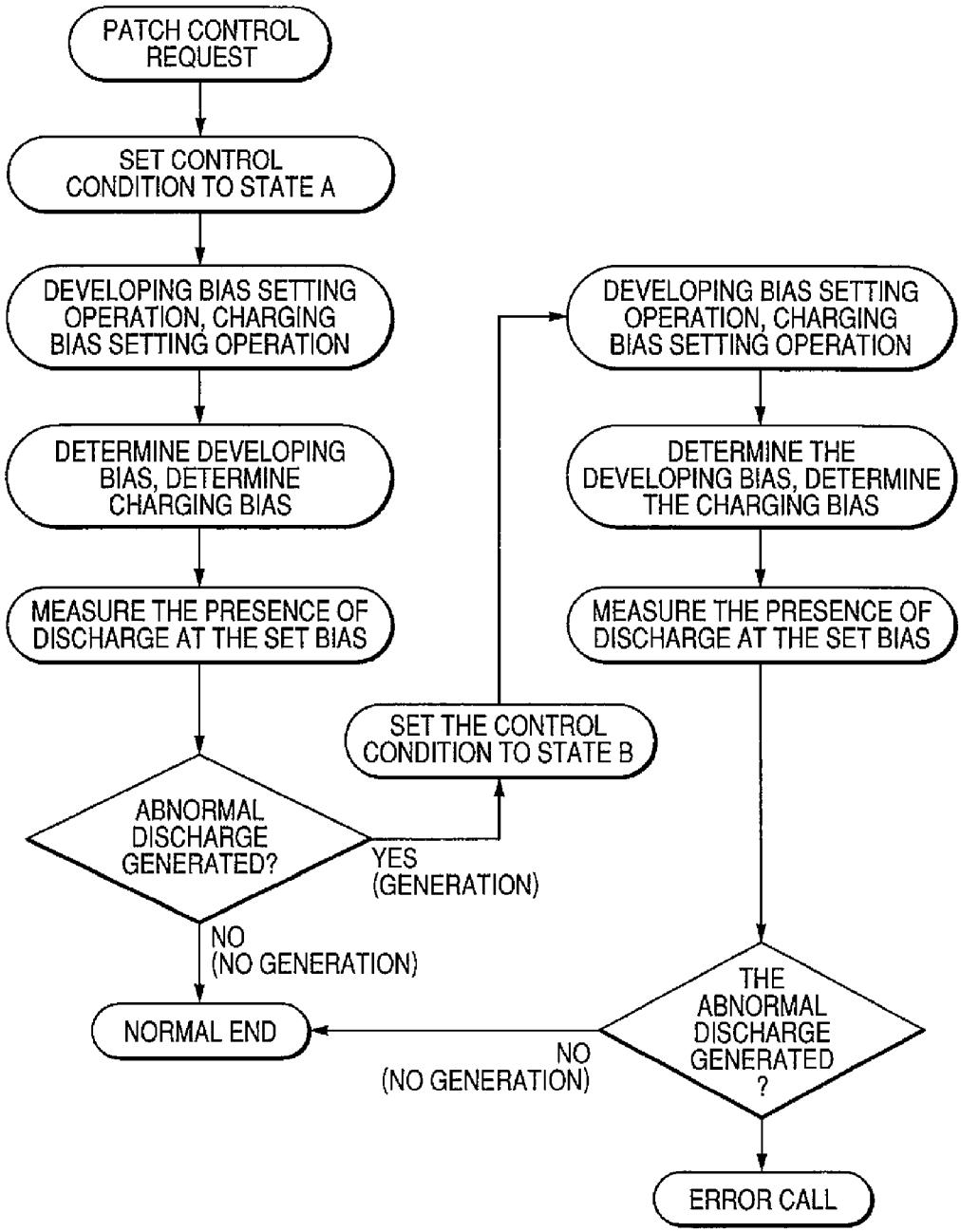
FIG. 14 is a flowchart showing a process for detecting the presence of an abnormal discharge and switching a normal mode and an abnormal discharge countermeasure mode according to the third embodiment.

FIG. 14 is a flowchart according to an embodiment of a process for switching the normal mode and the abnormal discharge countermeasure mode depending on the generation of an abnormal image due to an abnormal discharge according to the invention. In the process, a patch control request is given for the presence of the abnormal discharge and, first of all, a state A is set as a control condition (the reverse contrast potential Vr is constant). Subsequently, a developing bias setting operation and a charging bias setting operation corresponding to the state A are carried out, and a developing bias and a charging bias corresponding to the state A are determined and a patch image is formed on the image carrier or the intermediate transfer belt at the biases thus set. The presence of the abnormal discharge is executed by detecting the density of the patch image through a patch sensor serving as a toner density detecting unit. As an example, the density of a patch image having a low density after a high density is compared with that of a patch image having a low density after a medium density, and it is decided that the abnormal discharge is generated if a predetermined difference in the density or more is detected from both of them. When the abnormal discharge is not generated, a decision of "normal" is given. When it is decided that the abnormal discharge is generated, a state B is set as a control condition (the reverse contrast potential Vr is decreased) and a developing bias setting operation and a charging bias setting operation corresponding to the state B are carried out, a developing bias and a charging bias corresponding to the state B are determined, and a patch image is formed on the image carrier or the intermediate transfer belt at the biases thus set. Thus, the presence of the abnormal discharge is detected by the detection of a density through the patch image in the same manner as described above.

Figure 15:
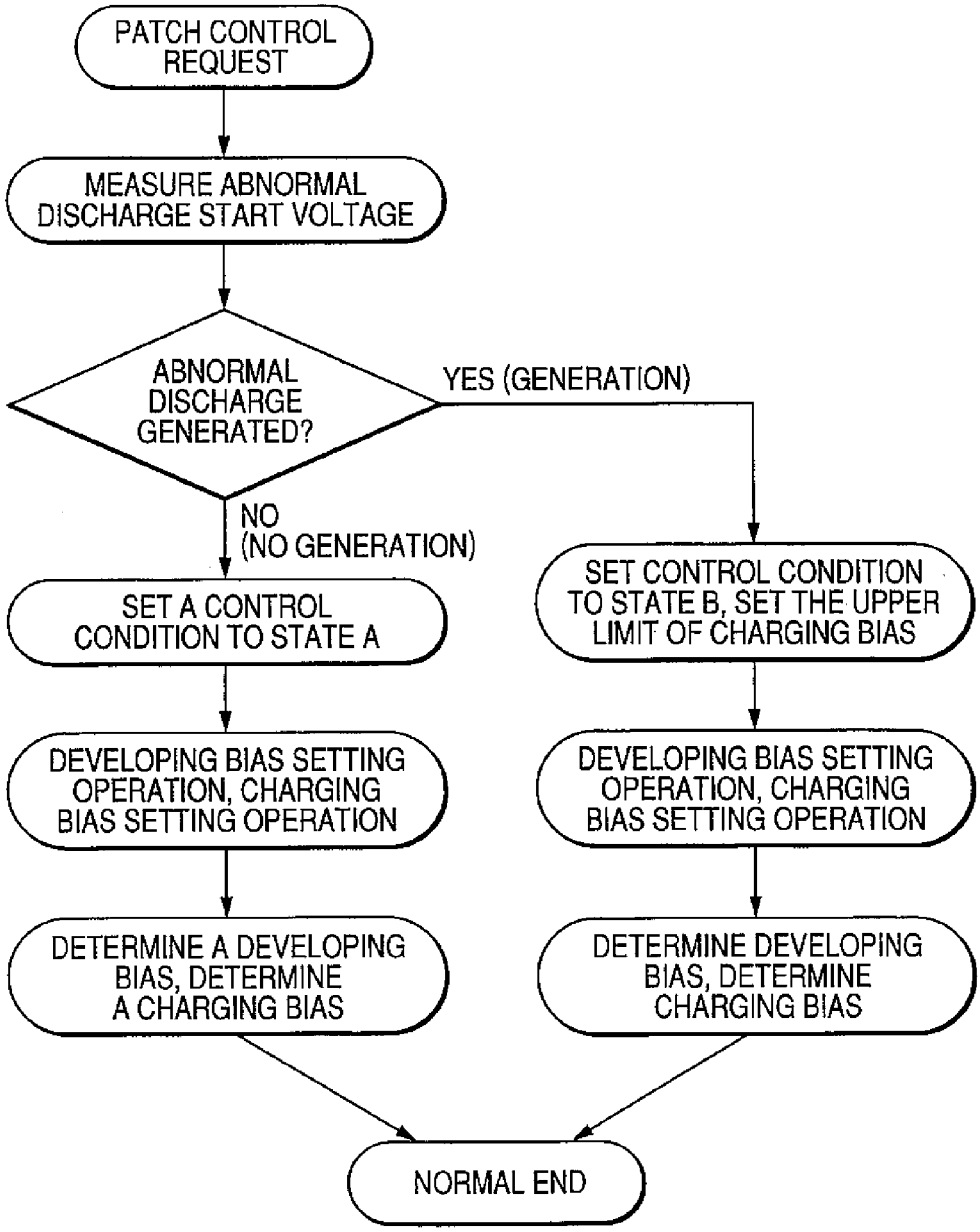
FIG. 15 is a flowchart showing a process for detecting the presence of an abnormal discharge and switching a normal mode and an abnormal discharge countermeasure mode according to a fourth embodiment.

FIG. 15 is a flowchart according to another embodiment of the process for switching the normal mode and the abnormal discharge countermeasure mode depending on the generation of an abnormal image due to an abnormal discharge according to the invention. In the process, a patch control request is given for checking the presence of the abnormal discharge and an image density control factor is varied in a multistage, and at the same time, a predetermined patch image is created, a toner density is detected by the toner density detecting unit, and an abnormal discharge start voltage is measured based on the toner image thus detected so that the presence of an abnormal discharge is decided. When it is decided that the abnormal discharge is not generated, a state A is set as a control condition (the reverse contrast potential Vr is constant) and a developing bias setting operation and a charging bias setting operation corresponding to the state A are carried out, and a developing bias and a charging bias corresponding to the state A are determined. When it is decided that the abnormal discharge is present, a state B is set as a control condition (the reverse contrast potential Vr is decreased) to set the upper limit of a charging bias potential. Subsequently, a developing bias setting operation and a charging bias setting operation corresponding to the state B are carried out, and a developing bias and a charging bias corresponding to the state B are determined.

Table 3 shows the result of an experiment in the image forming apparatus according to the third embodiment of the invention.

TABLE 3

| Vb (Development) | Vd (Non-image portion potential) | Vr (=IVb − VdI) | Vt1 (Primary transfer) | Vdt (=IVd − Vt1I) | Presence of abnormal discharge, (No, Yes) | Fine line density | Amount of scattering | Remark |
|---|---|---|---|---|---|---|---|---|
| | | | NG example | | | | | |
| −100 | −500 | −400 | 300 | 800 | No | Normal | Normal | |
| −150 | −550 | −400 | 300 | 850 | No | Normal | Normal | |
| −200 | −600 | −400 | 300 | 900 | No | Normal | Normal | |
| −250 | −650 | −400 | 300 | 950 | No | Normal | Normal | |
| −300 | −700 | −400 | 300 | 1000 | No | Normal | Normal | |
| −350 | −750 | −400 | 300 | 1050 | Yes | Normal | Normal | |
| −400 | −800 | −400 | 300 | 1100 | Yes | Normal | Normal | |
| In the case in which a discharge threshold is 1000 V Contribute to a fine line density | | | | | | | | |
| | | | Example of countermeasure | | | | | |
| −100 | −500 | −400 | 300 | 800 | No | Normal | Normal | |
| −150 | −550 | −400 | 300 | 850 | No | Normal | Normal | |
| −200 | −600 | −400 | 300 | 900 | No | Normal | Normal | |

TABLE 3-continued

| | | | | | | | | |
|---|---|---|---|---|---|---|---|---|
| −250 | −650 | −400 | 300 | 950 | No | Normal | Normal | |
| −300 | −700 | −400 | 300 | 1000 | No | Normal | Normal | |
| −350 | −700 | −350 | 300 | 1000 | No | Slightly high | Slightly large | Regulated with exposure power |
| −400 | −700 | −300 | 300 | 1000 | No | Slightly high | Slightly large | Regulated with exposure power |

In the case in which a discharge threshold is 1000 V

As is apparent from the result of an experiment shown in the Table 3, the potential difference Vdt between the non-image portion potential Vd and the primary transfer bias potential Vt1 can be caused to be equal to or smaller than the threshold Vth of the generation of the abnormal discharge and an abnormal image can be prevented from being generated due to an abnormal discharge by setting the control region ΔVb2 for decreasing the reverse contrast potential Vr in the region in which the abnormal image is generated due to the abnormal discharge in the abnormal discharge countermeasure mode.

Next, a fifth embodiment and a sixth embodiment will be described with reference to drawings. Hence, the identical parts and portions will be denoted by the same reference numerals, and a detailed description thereof will be omitted. In this embodiment, the image forming apparatus includes a control unit for holding the potential difference between the developing bias potential Vb and the non-image portion potential Vd on the image carrier 10, that is, the reverse contrast potential Vr to be constant, and furthermore, forming a halftone toner image as a patch image while setting and changing an image density control factor to influence the image density of a toner image in a multistage, and optimizing the image density control factor based on the result of the detection of the image density of the patch image which is obtained by the density detecting unit, thereby controlling the image density of a toner image formed by the developing unit. In a developing bias optimization processing in the optimization of the image density control factor, for example, the developing bias potential Vb is changed and set in a multistage to form the patch image in a state in which the absolute values of an exposure energy and a non-image portion potential are fixed to be maximum values within a variable range thereof. When the absolute value of the non-image portion potential Vd is maximized, the reverse contrast potential Vr=|Vb−Vd| is maximized also in any developing bias potential Vb so that the toner scattering in the apparatus can be minimized. By such a structure, the potential difference between the developing bias potential Vb and the non-image portion potential Vd, that is, the reverse contrast potential Vr is held to be constant when the halftone toner image is to be formed as the patch image. Therefore, it is possible to form such a patch image on the condition that the very small dot and the fine line to be used for obtaining a halftone have an excellent reproducibility. Consequently, it is possible to carry out the processing of optimizing the image density control factor with high precision based on the image density of the patch image. As a result, it is possible to stably form a toner image of high picture quality. By maintaining the reverse contrast potential Vr to have a proper value, furthermore, it is also possible to effectively suppress the toner scattering into the apparatus as described above. In order to stably form a toner image on a low density side, particularly, it is desirable to use a patch image having a dot area ratio to the whole patch image of 20% or less.

In the image forming apparatus using the intermediate transfer belt 36 having the multilayer structure including the conductive layer 36*a* and the resistive layer 36*b*, as shown in FIG. 4, in some cases in which a potential difference Vdt=|Vd−Vt1| between the non-image portion potential Vd on the image carrier (photosensitive member) 10 and the primary transfer bias potential Vt1 is increased, an abnormal image is generated partially or wholly due to an abnormal discharge in the primary transfer portion. This phenomenon is particularly remarkable over a half image.

Figure 16:
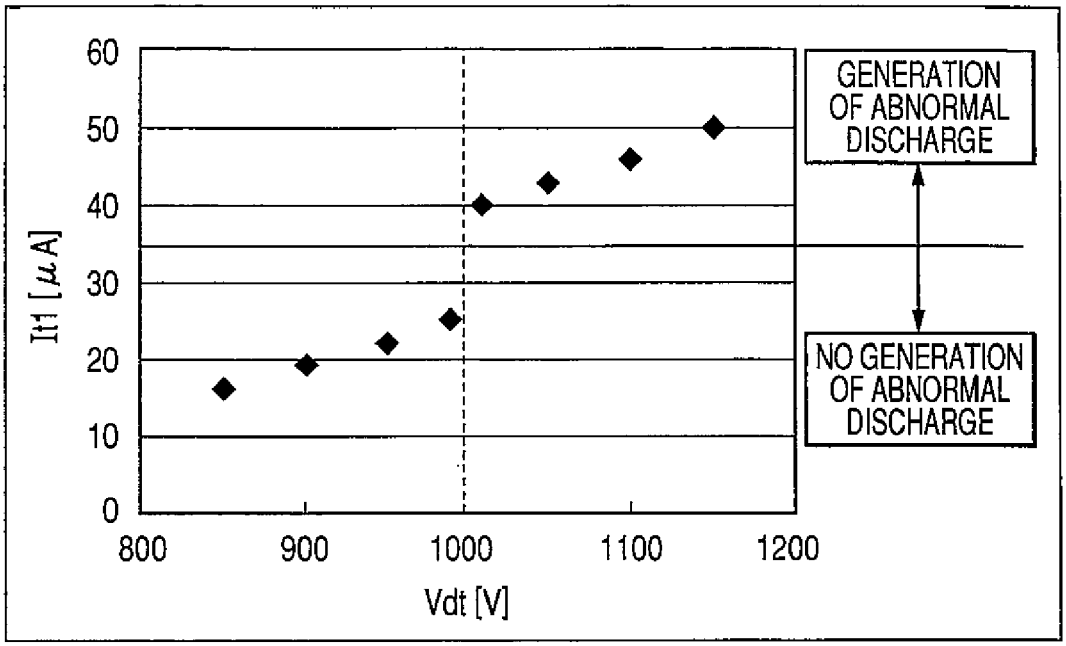
FIG. 16 is a chart showing a relationship between Vdt and a transfer current value It1.
Figure 17:
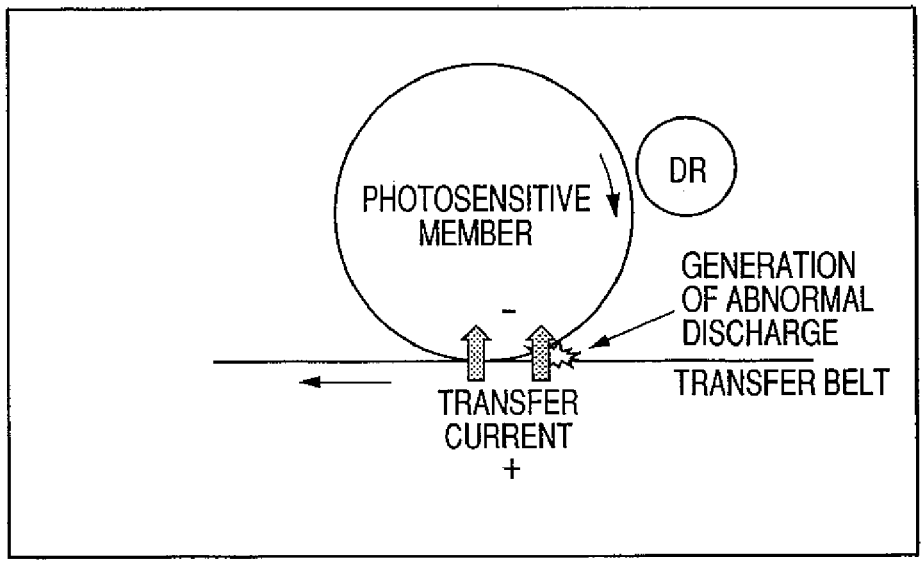
FIG. 17 is a view for explaining the state of the abnormal discharge.

FIG. 16 is a graph in which an axis of abscissa indicates the potential difference Vdt (V) between the non-image portion potential Vd and the primary transfer bias potential Vt1 and an axis of ordinate indicates a transfer current It1 (μA), in which the transfer current value It1 is rapidly increased at a portion in which Vdt has a value of 1000V. The reason is that an abnormal discharge is generated in the primary transfer portion of the intermediate transfer belt 36 having the multilayer structure including the conductive layer and the image carrier 10 so that the transfer current flows in a large amount as shown in FIG. 17. By detecting a change in the transfer current value It1, accordingly, it is possible to detect the generation of the abnormal discharge. The abnormal discharge is often generated in the transfer of a half image and the quality of the image is also influenced greatly by the abnormal discharge. Therefore, the detection of the transfer current value It1 may be limited to the time of the transfer of the half image.

In order to detect the generation of the abnormal image due to the abnormal discharge, moreover, a toner density detecting unit is provided opposite to the surface of the image carrier or the intermediate transfer belt, thereby measuring the density of a predetermined patch image formed on the image carrier or the intermediate transfer belt. Referring to the density of the predetermined patch image, for example, the toner image of an image having a low density (a dot area ratio of 10%) after an image having a high density (a dot area ratio of 100%) is compared with that of an image having a low density (a dot area ratio of 10%) after an image having a medium density (a dot area ratio of 30%) and an abnormal image is decided to be generated due to an abnormal discharge when a predetermined difference or more is detected from both of them. The reason why the patch image having the low density after the high density is compared with the patch image having the low density after the medium density is that the probability of the abnormal discharge in a toner image having a low density is higher than that in a toner image having a high density and a difference in the density can be measured more easily with the low density.

Figure 18:
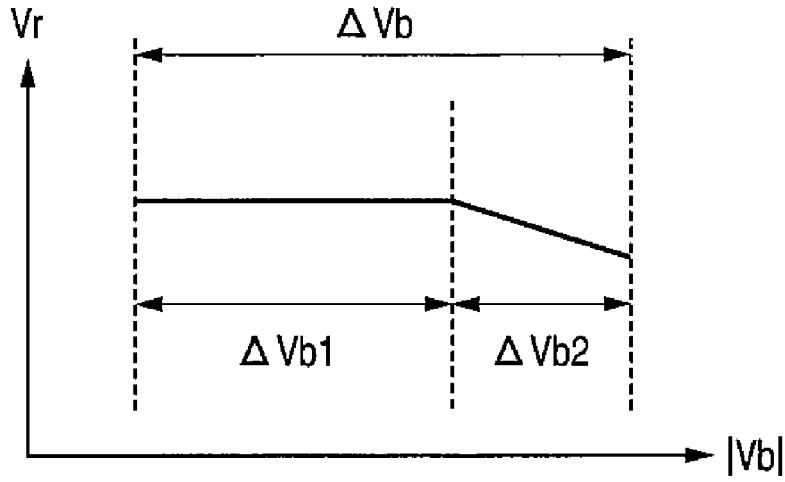
FIG. 18 is a chart for explaining two control regions in an abnormal discharge countermeasure mode according to the invention.
Figure 19:
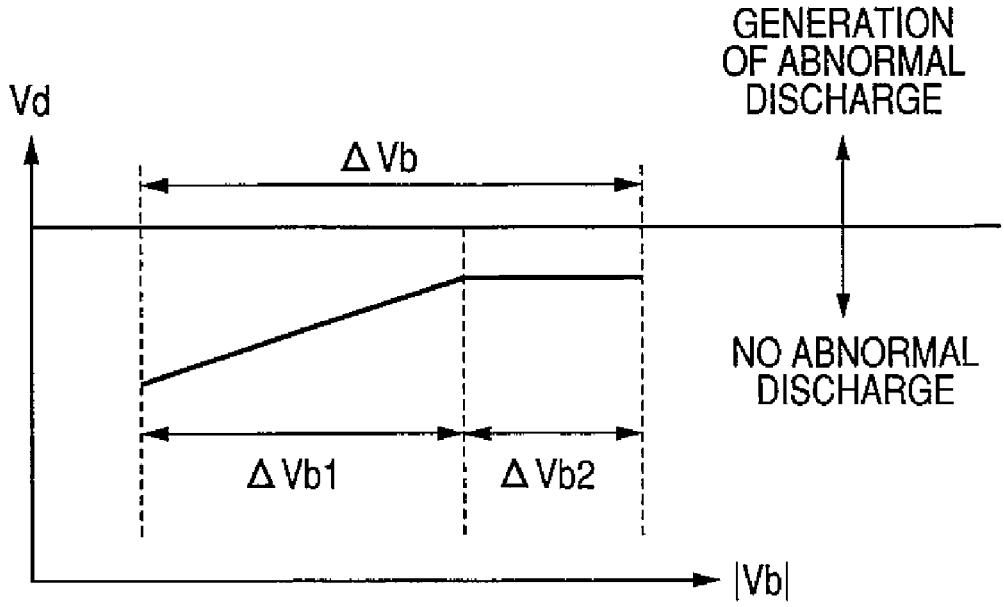
FIG. 19 is a chart for explaining the two control regions in the abnormal discharge countermeasure mode according to the invention.

For preventing the generation of the abnormal image due to the abnormal discharge, the control unit of the image forming apparatus according to the invention has an abnormal discharge countermeasure mode. In the abnormal discharge countermeasure mode, a control region ΔVb1 for holding the reverse contrast potential Vr to be the difference between the developing bias potential Vb and the non-image portion potential Vd to be constant and a control region ΔVb2 for decreasing the reverse contrast potential Vr to be the difference between the developing bias potential Vb and the non-image portion potential Vd are set as shown in FIG. 18 in order to cause the potential difference Vdt=|Vd−Vt1| between the non-image portion potential Vd and the primary transfer bias potential Vt1 to be equal to or smaller than the threshold Vth of the generation of the abnormal discharge. In other words, in the control region ΔVb1 in a normal state in which the transfer current value It1 in a primary transfer is normal or the abnormal image is not generated due to the abnormal discharge by the detection of a density through a patch image, the reverse contrast potential Vr is held to be constant and a toner image of high picture quality is stably formed, and furthermore, the toner scattering into the apparatus is also suppressed effectively. In the control region ΔVb2 in the case in which the transfer current value It1 in the primary transfer is rapidly increased or the abnormal image is generated due to the abnormal discharge by the detection of the density through the patch image, a control is carried out in such a direction that the primary transfer bias potential Vt1 is exactly maintained and the reverse contrast potential Vr is decreased in order to cause the potential difference Vdt between the non-image portion potential Vd and the primary transfer bias potential Vt1 to be equal to or smaller than the threshold Vth of the generation of the abnormal discharge. In other words, even if the developing bias potential Vb is set to be high in order to maintain the developing property, the control is carried out to cause the non-image portion potential Vd to be equal to or smaller than the threshold Vth of the generation of the abnormal discharge so that the abnormal image can be prevented from being generated due to the abnormal discharge. FIG. 19 shows an embodiment in which the control is carried out to fix the non-image portion potential Vd and the potential difference Vdt between the non-image portion potential Vd and the primary transfer bias potential Vt1 is set to be equal to or smaller than the threshold Vth of the generation of the abnormal discharge in the control region ΔVb2 in which the reverse contrast potential Vr in the abnormal discharge countermeasure mode is decreased.

Figure 20:
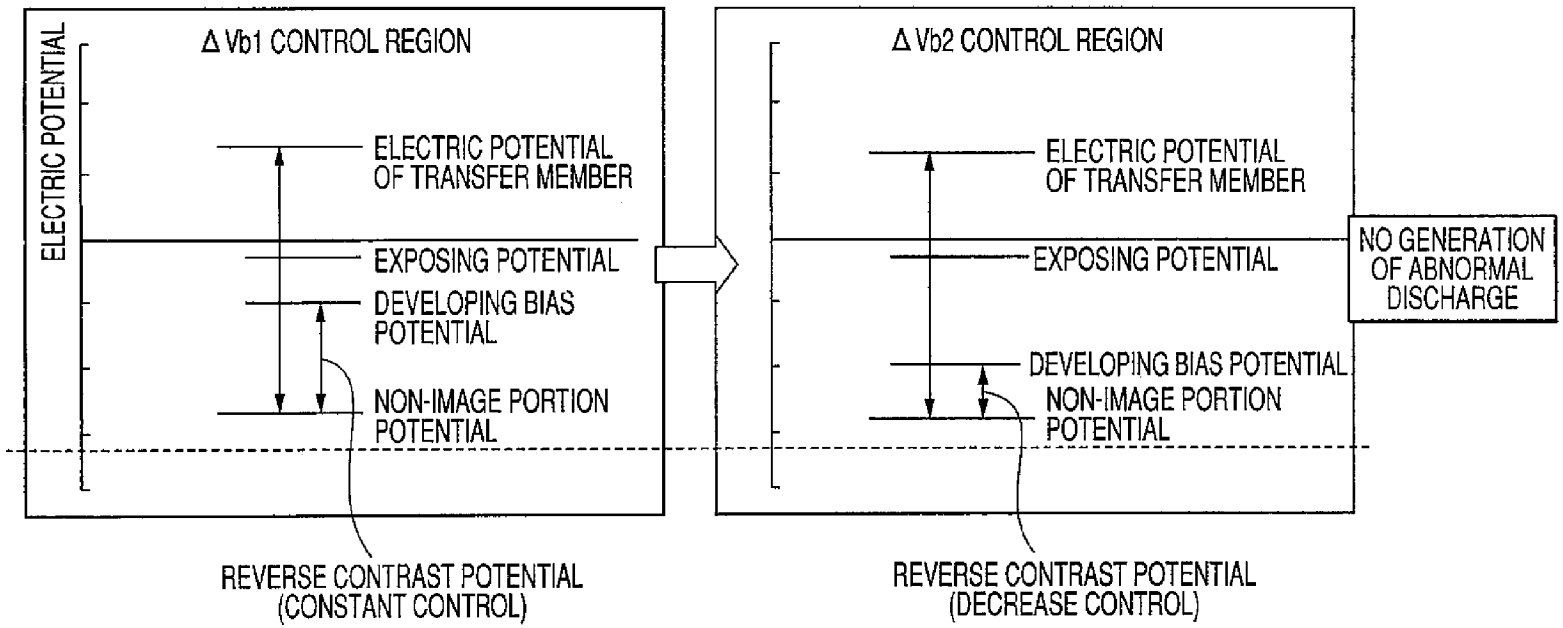
FIG. 20 is a diagram showing a relationship between electric potentials in the two control regions in the abnormal discharge countermeasure mode.

FIG. 20 shows a relationship between electric potentials in the control region ΔVb1 for setting the reverse contrast potential in the abnormal discharge countermeasure mode to be constant and the control region ΔVb2 for decreasing the reverse contrast potential Vr. In the control region ΔVb2, a control for holding the primary transfer bias potential Vt1 to be constant, and furthermore, holding the non-image portion potential Vd to be constant is carried out. Even if the developing bias potential Vb is set to be high in order to hold a developing property, the reverse contrast potential Vr is decreased. However, the potential difference Vdt between the non-image portion potential Vd and the primary transfer bias potential Vt1 can be held to be equal to or smaller than the threshold Vth of the generation of the abnormal discharge. Consequently, it is possible to prevent an abnormal image from being generated due to an abnormal discharge.

The normal mode and the abnormal discharge countermeasure mode can be switched by the operation of a control panel provided in the apparatus body in addition to the operation of the toner density detecting unit through the patch image. Consequently, the switching to the control region ΔVb2 for decreasing the reverse contrast potential Vr is carried out only when the abnormal image is generated due to the abnormal discharge. Therefore, it is possible to minimize the influence of a reduction in the reverse contrast potential Vr.

As described above, moreover, the apparatus body may be provided with sensors for detecting information about a lifetime such as the number of used sheets and information about an environment such as a temperature and humidity and an air pressure which are the fluctuation factors of the threshold Vth of the generation of the abnormal discharge with the potential difference Vdt between the non-image portion potential Vd and the primary transfer bias potential Vt1, and thus, it is also possible to add the function of switching the normal mode and the abnormal discharge countermeasure mode based on data sent from each sensor.

Figure 21:
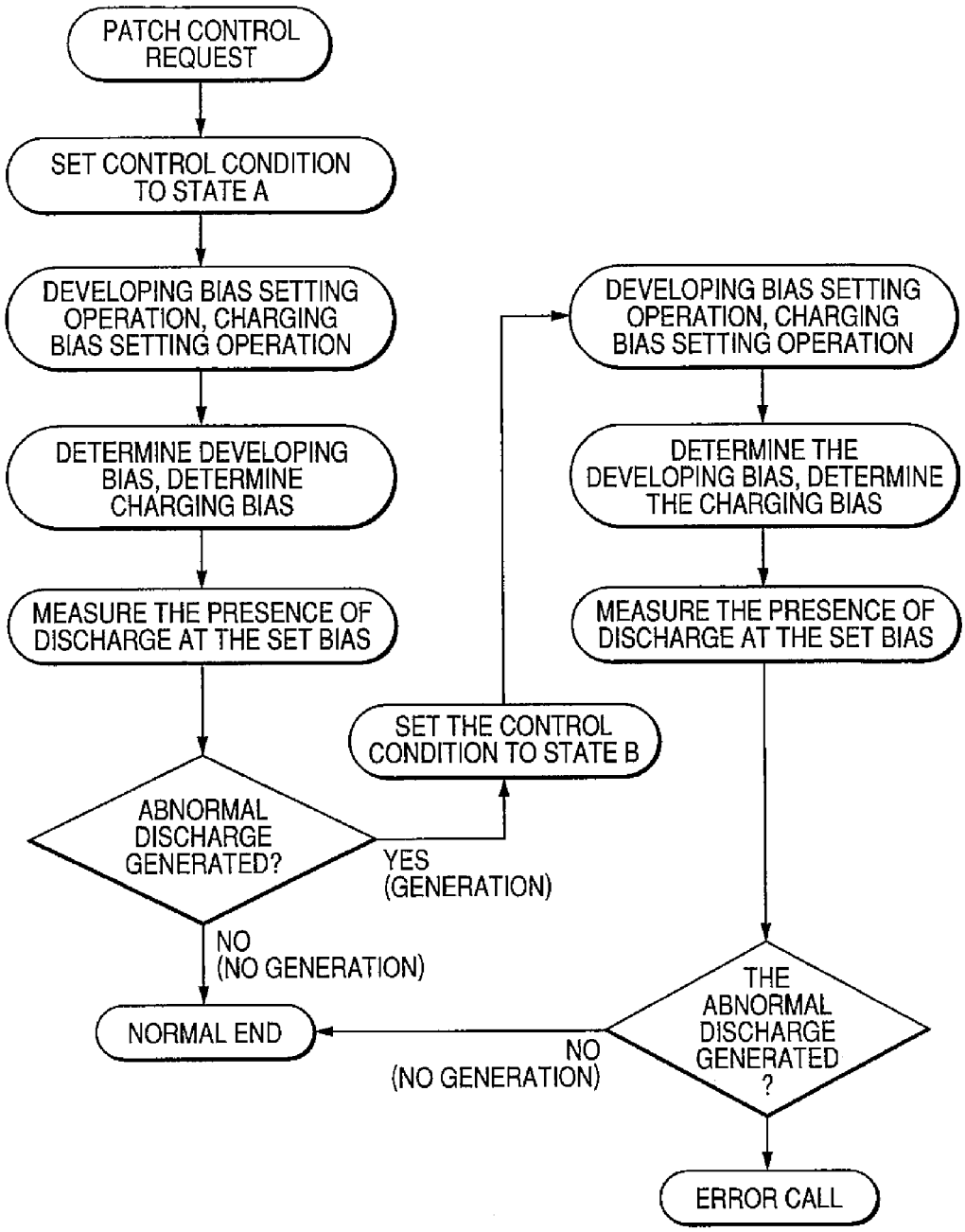
FIG. 21 is a flowchart showing a process for detecting the presence of an abnormal discharge and switching a normal mode and an abnormal discharge countermeasure mode according to a fifth embodiment of the invention.

FIG. 21 is a flowchart according to the fifth embodiment of a process for switching the normal mode and the abnormal discharge countermeasure mode depending on the generation of an abnormal image due to an abnormal discharge according to the invention. In the process, a patch control request is given for the presence of the abnormal discharge and, first of all, a state A is set as a control condition (ΔVb1: the reverse contrast potential Vr is constant). Subsequently, a developing bias setting operation and a charging bias setting operation corresponding to the state A are carried out, and a developing bias and a charging bias corresponding to the state A are determined and a patch image is formed on the image carrier or the intermediate transfer belt at the biases thus set. The presence of the abnormal discharge is checked by detecting the density of the patch image through a patch sensor to be toner density detecting unit. As an example, the density of a patch image having a low density after a high density is compared with that of a patch image having a low density after a medium density, and it is decided that the abnormal discharge is generated if a predetermined difference in the density or more is detected from both of them. When the abnormal discharge is not generated, a decision of "normal" is given. When it is decided that the abnormal discharge is generated, a state B is set as a control condition (ΔVb2: the reverse contrast potential Vr is decreased) and a developing bias setting operation and a charging bias setting operation corresponding to the state B are carried out, a developing bias and a charging bias corresponding to the state B are determined, and a patch image is formed on the image carrier or the intermediate transfer belt at the biases thus set. Consequently, the presence of the abnormal discharge is detected by the detection of a density through the patch image in the same manner as described above.

Figure 22:
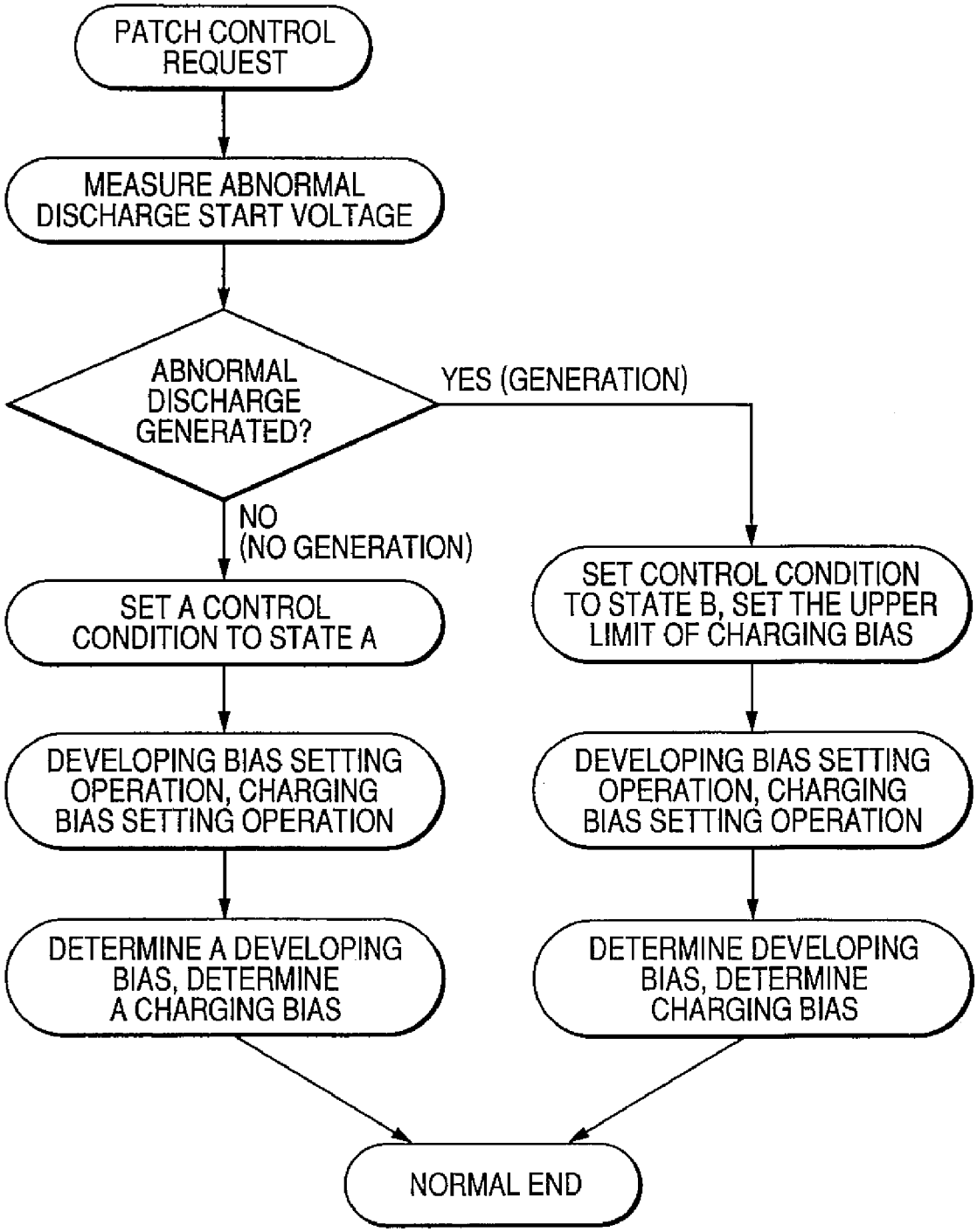
FIG. 22 is a flowchart showing a process for detecting the presence of an abnormal discharge and switching a normal mode and an abnormal discharge countermeasure mode according to a sixth embodiment of the invention.

FIG. 22 is a flowchart according to the sixth embodiment of the process for switching the normal mode and the abnormal discharge countermeasure mode depending on the generation of an abnormal image due to an abnormal discharge according to the invention. In the process, a patch control request is given for checking the presence of the abnormal discharge and an image density control factor is varied in a multistage, and at the same time, a predetermined patch image is created, a toner density is detected by the toner density detecting unit, and an abnormal discharge start voltage is measured based on the toner density thus detected so that the presence of an abnormal discharge is decided. When it is decided that the abnormal discharge is not generated, a state A is set as a control condition (ΔVb1: the reverse contrast potential Vr is constant) and a developing bias setting operation and a charging bias setting operation corresponding to the state A are carried out, and a developing bias and a charging bias corresponding to the state A are determined. When it is decided that the abnormal discharge is present, a state B is set as a control condition (ΔVb2: the reverse contrast potential Vr is decreased) to set the upper limit of a charging bias potential. Subsequently, a developing bias setting operation and a charging bias setting operation corresponding to the state B are carried out, and a developing bias and a charging bias corresponding to the state B are determined.

Table 4 shows the result of an experiment in the image forming apparatus according to the fifth embodiment of the invention.

TABLE 4

| Vb (Development) | Vd (Non-image portion potential) | Vr (=IVb − VdI) | Vt1 (Primary transfer) | Vdt (=IVd − Vt1I) | Presence of abnormal discharge, (No, Yes) | Fine line density | Amount of scattering | Remark |
|---|---|---|---|---|---|---|---|---|
| | | | NG example | | | | | |
| −100 | −500 | −400 | 300 | 800 | No | Normal | Normal | |
| −150 | −550 | −400 | 300 | 850 | No | Normal | Normal | |
| −200 | −600 | −400 | 300 | 900 | No | Normal | Normal | |
| −250 | −650 | −400 | 300 | 950 | No | Normal | Normal | |
| −300 | −700 | −400 | 300 | 1000 | No | Normal | Normal | |
| −350 | −750 | −400 | 300 | 1050 | Yes | Normal | Normal | |
| −400 | −800 | −400 | 300 | 1100 | Yes | Normal | Normal | |
| In the case in which a discharge threshold is 1000 V Contribute to a fine line density | | | | | | | | |
| | | | Example of countermeasure | | | | | |
| −100 | −500 | −400 | 300 | 800 | No | Normal | Normal | |
| −150 | −550 | −400 | 300 | 850 | No | Normal | Normal | |
| −200 | −600 | −400 | 300 | 900 | No | Normal | Normal | |
| −250 | −650 | −400 | 300 | 950 | No | Normal | Normal | |
| −300 | −700 | −400 | 300 | 1000 | No | Normal | Normal | |
| −350 | −700 | −350 | 300 | 1000 | No | Slightly high | Slightly large | Regulated with exposure power |
| −400 | −700 | −300 | 300 | 1000 | No | Slightly high | Slightly large | Regulated with exposure power |

In the case in which a discharge threshold is 1000 V

As is apparent from the result of an experiment shown in the Table 4, the potential difference Vdt between the non-image portion potential Vd and the primary transfer bias potential Vt1 can be caused to be equal to or smaller than the threshold Vth of the generation of the abnormal discharge and an abnormal image can be prevented from being generated due to an abnormal discharge by setting the control region ΔVb2 for decreasing the reverse contrast potential Vr in the abnormal discharge countermeasure mode in the region in which the abnormal image is generated due to the abnormal discharge.

Figure 23:
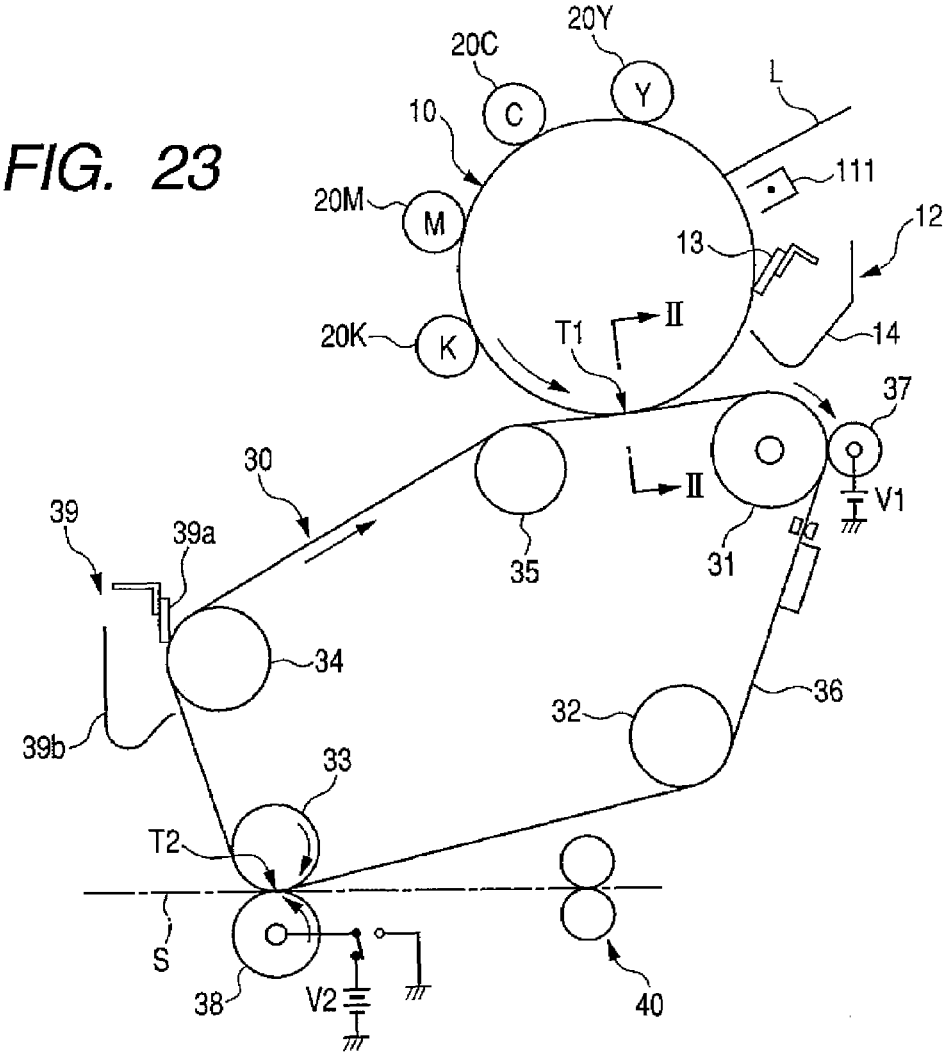
FIG. 23 is a typical view showing main parts of an image forming apparatus according to a seventh embodiment of the invention.
Figure 24:
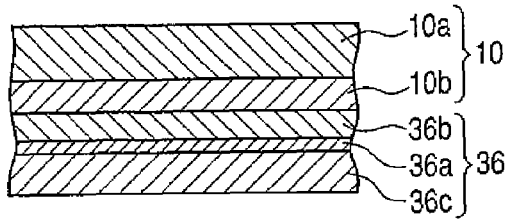
FIG. 24 is an end view showing an enlarged portion taken along II-II in FIG. 23.
Figure 25:
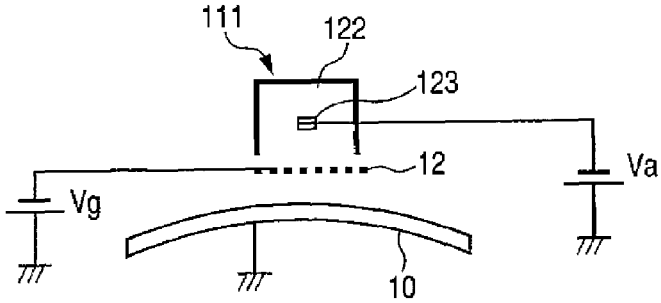
FIG. 25 is a partial enlarged view showing a corona charger.

Next, a seventh embodiment and a sixth embodiment will be described with reference to drawings. FIG. 23 is a typical view showing the seventh embodiment of an image forming apparatus according to the invention and FIG. 24 is an end view showing an enlarged portion taken along a II-II line in FIG. 23. FIG. 25 is a partial enlarged view showing an embodiment of a corona charging unit.

A corona charger 111 serving as a charging unit, a developing roller 20 (Y, M, C and K) serving as a developing unit, an intermediate transfer unit 30 and a cleaning unit 12 are provided in the direction of a rotation around an image carrier 10. The image carrier 10 has a cylindrical conductive base material 10*a* (see FIG. 24) and a photosensitive layer 10*b* formed on a surface thereof. The corona charger 111 includes a discharge electrode 123 in a back plate 122 to be a metal casing and a grid electrode 24 provided between the image carrier 10 and the discharge electrode 123 (see FIG. 25) and uniformly charges the outer peripheral surface of the image carrier 10. A selective light L is exposed corresponding to desirable image information by an exposing unit over the outer peripheral surface of the image carrier 10 charged uniformly so that an electrostatic latent image is formed on the image carrier 10 by the exposed light L. Hence, the identical parts and portions will be denoted by the same reference numerals, and a detailed description thereof will be omitted.

Figure 26:
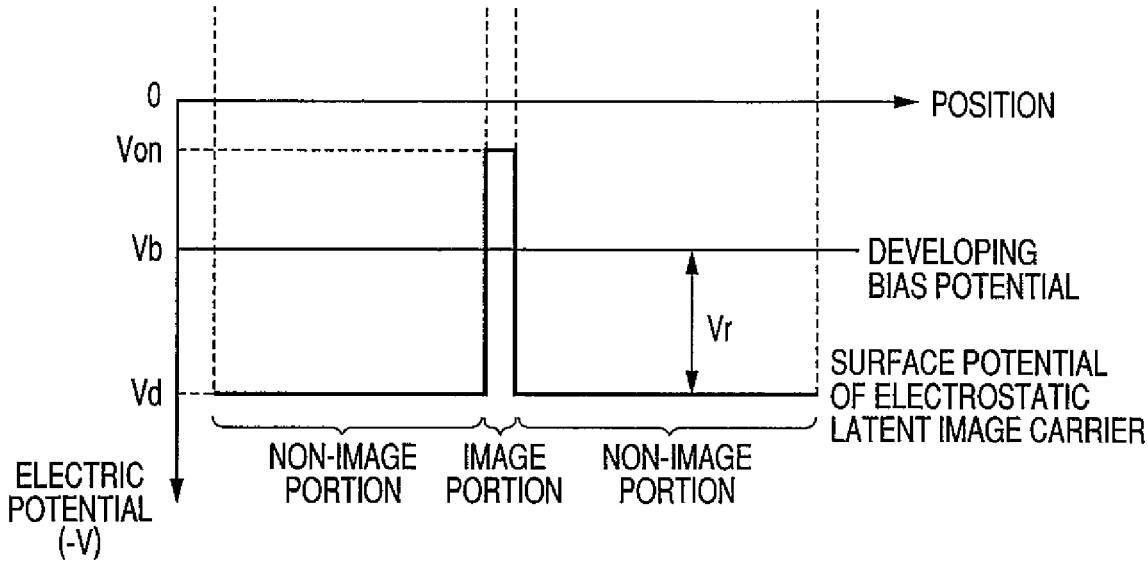
FIG. 26 is a diagram showing the principle of the image forming apparatus according to the invention.

A mechanism for forming an image in the image forming apparatus will be described with reference to FIG. 26. In the image forming apparatus according to the embodiment, the outer surface of the image carrier 10 provided under the corona charger 111 is charged to have a negative surface potential Vo with a grid bias potential Vg of the grid electrode 24 of the corona charger 111. When the light L exposed from the exposing unit is irradiated on the surface of the image carrier 10, a part of electric charges in the irradiated portion is neutralized so that the surface potential is changed to Von. Thus, scanning and exposure are carried out over the image carrier 10 while the light exposure L is turned ON/OFF corresponding to an image signal. Consequently, the electric potential of a surface region corresponding to an image portion is changed to Von (≠Vo) in response to the image signal, while the electric potential of a surface region corresponding to a non-image portion is attenuated from the surface potential Vo obtained immediately after the charging to Vd (|Vd|≦|Vo|) by a dark decay. In other words, |Vo|=α|Vg| and |Vd|<|Vo| are set and the grid bias potential Vg and the surface potential Vo of the image carrier provided under the grid electrode 24 have a functional relation, and a gradient a is mainly determined by a distance between the grid electrode 24 and the surface of the image carrier 10, the opening width of the back plate 122 and the charging ability of the image carrier 10. A relationship between Vo and the non-image portion potential Vd in the primary transfer portion is determined by a characteristic, that is, the dark decay which is peculiar to the material of the image carrier 10, and Vd is determined by the dark decay and a time required for reaching the primary transfer portion from a charging position. Accordingly, the grid bias potential Vg and the non-image portion potential Vd in the primary transfer portion have a functional relation. Thus, an electrostatic latent image corresponding to the image signal is formed on the image carrier 10. The electrostatic latent image thus formed is delivered to a developing position which is opposed to the developing roller 20 constituting the developing unit by the rotation of the image carrier 10. A toner charged to be negative is carried on the developing roller 20, and furthermore, a developing bias potential Vb to promote the toner to be stuck to the image portion of the image carrier 10 is applied thereto. As shown in FIG. 26, the developing bias potential Vb is set to have a value between the non-image portion potential Vd and the image portion potential Von. In a developing position, accordingly, the surface of the image carrier 10 has a lower electric potential than the developing roller 20 in a non-image portion, while the surface of the image carrier 10 has a higher electric potential than the developing roller 20 in an image portion. For this reason, any of the negative charged toners carried on the developing roller 20 which is placed in an opposed position to the image portion is moved to the image carrier 10 side by an electrostatic force, while a force in a drawing direction toward the developing roller 20 side acts on the toner placed in an opposed position to the non-image portion. Thus, the toner is stuck to only the image portion so that the electrostatic latent image on the image carrier 10 is revealed with the toner.

In the image forming process for forming a toner image, thus, it has been known that each of parameters such as the exposure energy of the exposed light L, the non-image portion potential Vd, the image portion potential Von and the developing bias potential Vb greatly influences the image density of a final toner image, and there have conventionally been proposed a large number of techniques for properly regulating some of these parameters as image density control factors, thereby optimizing the image density. In an actual image forming process, however, a toner image is formed with these parameters related mutually. For this reason, they cannot be always controlled independently and optionally. In particular, a relative electric potential relationship between the developing bias potential Vb and the non-image portion potential Vd greatly influences the quality of a toner image which is obtained and the amount of toner scattering into the apparatus in addition to the shade of an image. In order to set the image density control factor with higher precision to form a toner image of high quality, therefore, it is important that these values are to be properly set. The absolute value of the potential difference between the developing bias potential Vb and the non-image portion potential Vd will be referred to as a reverse contrast potential. More specifically, the reverse contrast potential is set to be $|Vb-Vd|$. The grid bias potential Vg and the non-image portion potential Vd in the primary transfer portion have the functional relation as described above. Therefore, $Vr=|Vb-Vg|$ can be used as a reverse contrast potential.

In order to investigate the influence of the relationship between the electric potentials, first of all, there will be considered the case in which the developing bias potential Vb is approximated to the level of the grid bias potential Vg having the functional relation with the non-image portion potential Vd to reduce the reverse contrast potential Vr. At this time, the potential difference between the image portion potential Von and the developing bias potential Vb, that is, the contrast potential ($=|Vb-Von|$) is increased and the movement of the toner from the developing roller 20 to the image carrier 10 is promoted in the image portion. Consequently, it is possible to obtain a high image density. On the other hand, however, the potential difference from the developing roller 20 is reduced in the non-image portion of the image carrier 10. Therefore, an action for returning an extra toner to the developing roller 20 side is reduced. For this reason, the amount of the toner liberated from the developing roller 20 and scattering into the apparatus is increased. On the other hand, when the developing bias potential Vb is exactly maintained and the absolute value of the grid bias potential Vg having the functional relation with the non-image portion potential Vd is increased to raise the reverse contrast potential Vr, the amount of the toner scattering into the apparatus can be decreased and a force for repelling a negative charged toner by a negative charge held in the non-image portion of the image carrier 10 is increased. For this reason, the toner is stuck, with difficulty, to an image portion in a narrow region interposed between the non-image portions, particularly, in an electrostatic latent image. As a result, the quality of a low density image having a comparatively low area ratio of a dot is deteriorated, for example, an isolated dot or a fine line is blurred or the uniformity of a line width is damaged.

Thus, it is preferable to increase the reverse contrast potential Vr in order to suppress the toner scattering, while there is a contradicting demand for reducing the reverse contrast potential Vr in order to maintain the quality of an image, for example, the uniformity of a fine line. In order to form an image of high picture quality while suppressing the toner scattering into the apparatus, it is necessary to set a parameter, for example, the developing bias potential Vb in such a manner that the reverse contrast potential Vr always has a proper value. When optimizing the forming density control factor of a halftone toner image, particularly, the quality of the reproducibility of a very small dot or a fine line greatly influences precision. In order to set the image density control factor with high precision, therefore, it is important to form a patch image in a state in which the reverse contrast potential Vr is maintained to have a proper value.

For this reason, there is provided a control unit for holding the potential difference between the developing bias potential Vb and the grid bias potential Vg having the functional relation with the non-image portion potential Vd on the image carrier 10, that is, the reverse contrast potential Vr to be constant, and furthermore, forming a halftone toner image as a patch image while setting and changing an image density control factor to influence the image density of a toner image in a multistage, and optimizing the image density control factor based on the result of the detection of the image density of the patch image which is obtained by the density detecting unit, thereby controlling the image density of a toner image formed by the developing unit. In a developing bias optimization processing in the optimization of the image density control factor, for example, the developing bias potential Vb is changed and set in a multistage to form the patch image in a state in which the absolute values of an exposure energy and a non-image portion potential are fixed to be maximum values within a variable range thereof. When the absolute value of the grid bias potential Vg having the functional relation with the non-image portion potential Vd is maximized, the reverse contrast potential $Vr=|Vb-Vg|$ is maximized also in any developing bias potential Vb so that the toner scattering in the apparatus can be minimized. With such a structure, the potential difference between the developing bias potential Vb and the grid bias potential Vg having the functional relation with the non-image portion potential Vd, that is, the reverse contrast potential Vr is held to be constant when the halftone toner image is to be formed as the patch image. Therefore, it is possible to form such a patch image on the condition that the very small dot and the fine line to be used for obtaining a halftone have an excellent reproducibility. Consequently, it is possible to carry out the processing of optimizing the image density control factor with high precision based on the image density of the patch image. As a result, it is possible to stably form a toner image of high picture quality. By maintaining the reverse contrast potential Vr to have a proper value, furthermore, it is also possible to effectively suppress the toner scattering into the apparatus as described above. In order to stably form a toner image on a low density side, particularly, it is desirable to use a patch image having a dot area ratio to the whole patch image of 20% or less.

Figure 27:
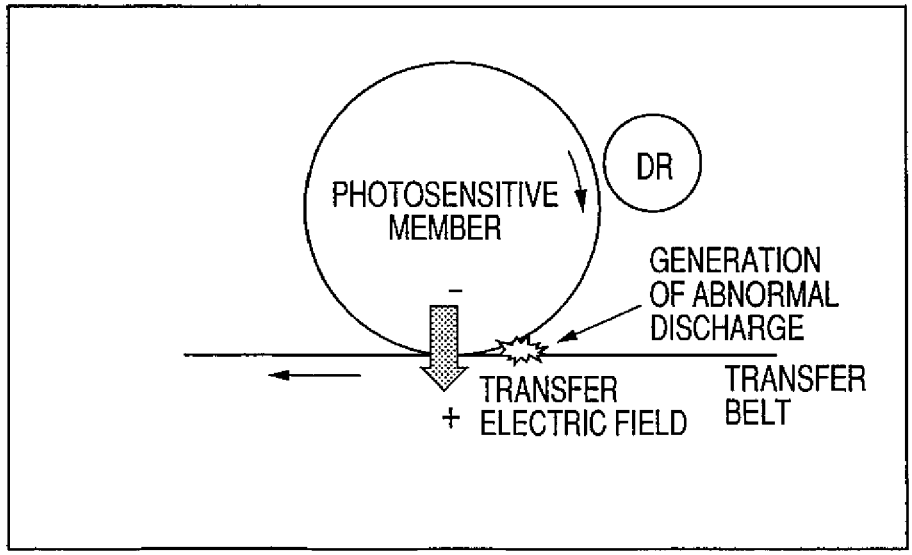
FIG. 27 is a view for explaining the state of an abnormal discharge.

In the image forming apparatus using the intermediate transfer belt 36 having the multilayer structure including the conductive layer 36*a* and the resistive layer 36*b*, as shown in FIG. 27, in some cases in which a potential difference Vdt |Vd−Vt1| between the non-image portion potential Vd on the image carrier (photosensitive member) 10 and the primary transfer bias potential Vt1 is increased, an abnormal image is generated partially or wholly due to an abnormal discharge in the primary transfer portion. This phenomenon is particularly remarkable over a half image.

Figure 28A:
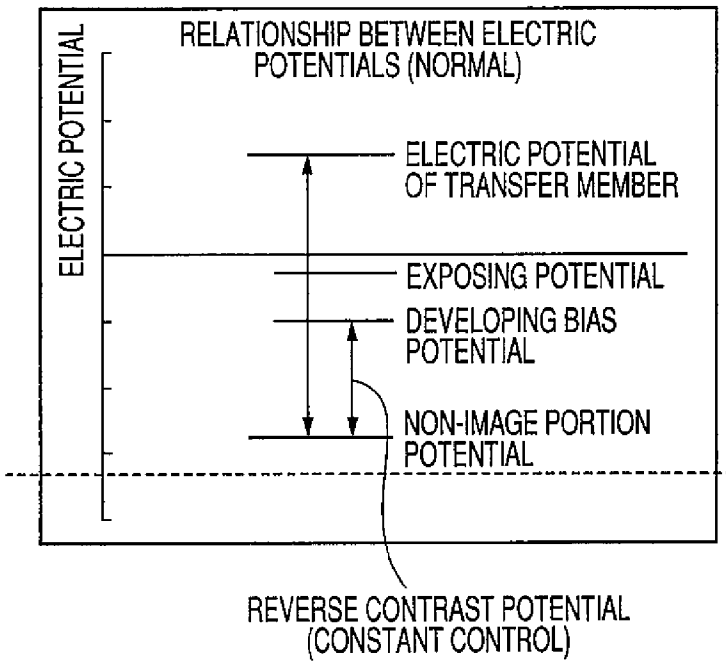
FIGS. 28A and 28B are diagrams showing a relationship between electric potentials in a normal state and a state in which an abnormal discharge is generated.
Figure 28B:
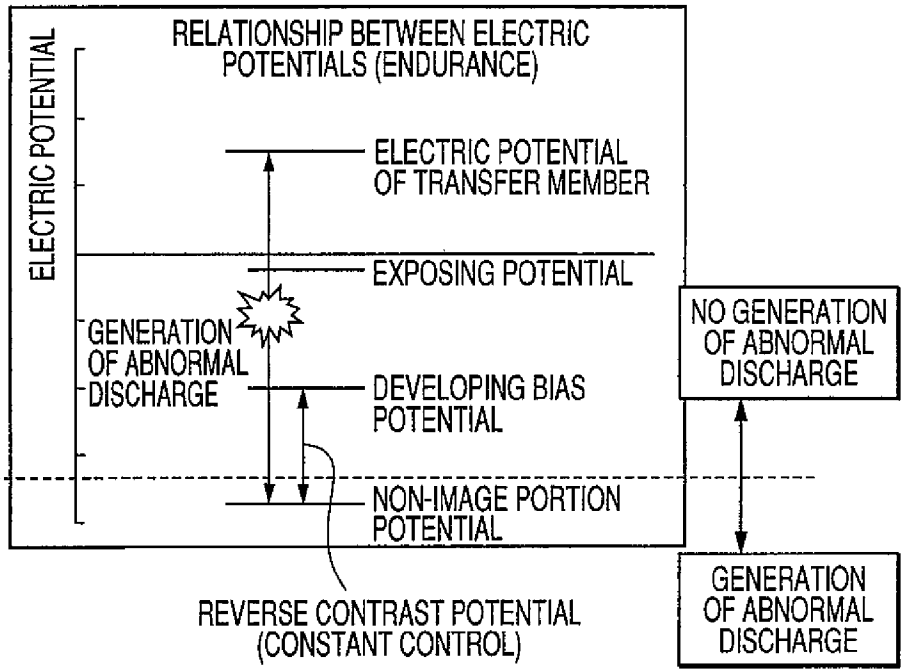

A mechanism for generating the phenomenon will be described based on a relationship between electric potentials shown in FIGS. 28A and 28B. FIG. 28A shows a relationship between electric potentials in a normal mode, and a primary transfer is carried out while the reverse contrast potential Vr to be the difference between the developing bias potential Vb and the non-image portion potential Vd is held to be constant. The potential difference Vdt=|Vd−Vt1| between the non-image portion potential Vd and the primary transfer bias potential Vt1 is equal to or smaller than a threshold Vth of the generation of an abnormal discharge. Therefore, an abnormal image can be prevented from being generated due to the abnormal discharge. FIG. 28B shows the relationship between the electric potentials in a state in which the abnormal discharge is generated. In this case, when the primary transfer is carried out while the reverse contrast potential Vr to be the difference between the developing bias potential Vb and the grid bias potential Vg having the functional relation with the non-image portion potential Vd is held to be constant, the thickness of the photosensitive layer of the image carrier is decreased and the threshold of the generation of the abnormal discharge is reduced, and furthermore, a developing property (a flying property) is deteriorated after a large number of sheets are printed. Consequently, it is necessary to set the developing bias potential Vb to be high. The developing bias potential Vb is set to be high so that it is necessary to hold the reverse bias potential Vr to be constant. Consequently, the non-image portion potential Vd is also set to be high and the potential difference Vdt=|Vd−Vt1| between the non-image portion potential Vd and the primary transfer bias potential Vt1 exceeds the threshold Vth of the generation of the abnormal discharge so that an abnormal image is generated due to the abnormal discharge.

For preventing the generation of the abnormal image due to the abnormal discharge, the control unit of the image forming apparatus according to the invention has an abnormal discharge countermeasure mode. In the abnormal discharge countermeasure mode, there are set a control region ΔVb1 for holding the reverse contrast potential Vr to be the difference between the developing bias potential Vb and the grid bias potential Vg having the functional relation with the non-image portion potential Vd to be constant and a control region ΔVb2 for decreasing the reverse contrast potential Vr to be the difference between the developing bias potential Vb and the grid bias potential Vg having the functional relation with the non-image portion potential Vd as shown in FIG. 29 in order to cause the potential difference Vdt=|Vd−Vt1| between the non-image portion potential Vd and the primary transfer bias potential Vt1 to be equal to or smaller than the threshold Vth of the generation of the abnormal discharge. In other words, in the control region ΔVb1 in the normal state in which the abnormal image is not generated due to the abnormal discharge, the reverse contrast potential Vr is held to be constant and a toner image of high picture quality is stably formed, and furthermore, the toner scattering into the apparatus is also suppressed effectively. In the control region ΔVb2 in the case in which the abnormal image might be generated due to the abnormal discharge or is generated due to the abnormal discharge, a control is carried out in such a direction that the primary transfer bias potential Vt1 is exactly maintained and the reverse contrast potential Vr is decreased in order to cause the potential difference Vdt between the non-image portion potential Vd and the primary transfer bias potential Vt1 to be equal to or smaller than the threshold Vth of the generation of the abnormal discharge. In other words, even if the developing bias potential Vb is set to be high in order to maintain the developing property, the control is carried out to cause the grid bias potential Vg having the functional relation with the non-image portion potential Vd to be equal to or smaller than the threshold Vth of the generation of the abnormal discharge so that the abnormal image can be prevented from being generated due to the abnormal discharge.

FIGS. 30A and 30B show states brought at the early stage of the use of the apparatus in the two control regions ΔVb1 and ΔVb2 and after the endurance of the apparatus in the abnormal discharge countermeasure mode. Assuming that the grid bias potential Vg is equal to the non-image portion potential Vd at the early stage of the use of the apparatus in FIG. 30A, the thickness of the photosensitive layer of the image carrier is decreased, an abnormal discharge start voltage is dropped and |Vd| is also reduced after the endurance of the apparatus in FIG. 30B.

Figure 31:
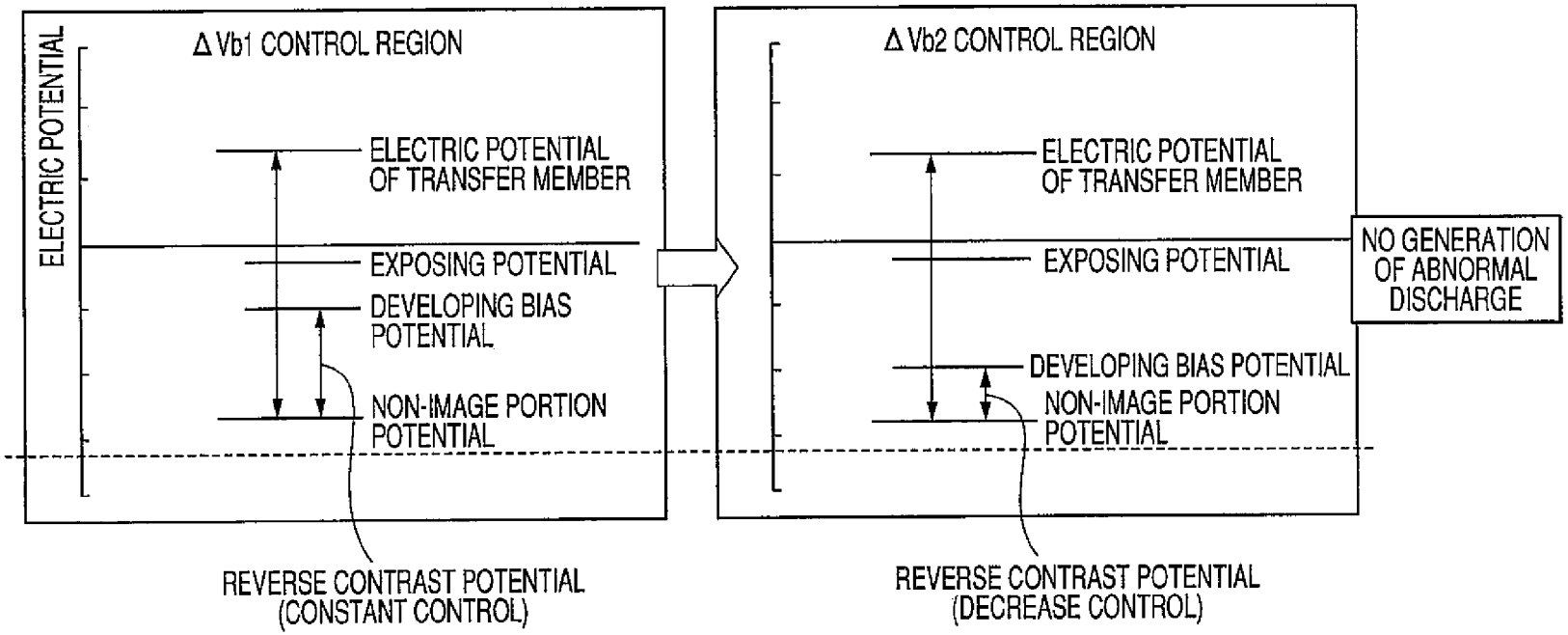
FIG. 31 is a diagram showing a relationship between electric potentials in the two control regions in the abnormal discharge countermeasure mode.

FIG. 31 shows a relationship between electric potentials in the two control regions ΔVb1 and ΔVb2 in the abnormal discharge countermeasure mode. In the control region ΔVb2, the primary transfer bias potential Vt1 is maintained to be constant, and furthermore, the grid bias potential Vg having the functional relation with the non-image portion potential Vd is controlled. Even if the developing bias potential Vb is set to be high, the reverse contrast potential Vr is decreased. However, the potential difference Vdt between the non-image portion potential Vd and the primary transfer bias potential Vt1 can be held to be equal to or smaller than the threshold Vth of the generation of the abnormal discharge. Consequently, it is possible to prevent an abnormal image from being generated due to an abnormal discharge.

The normal mode and the abnormal discharge countermeasure mode can be switched by the operation of a control panel provided in the apparatus body. Consequently, the control region ΔVb2 for decreasing the reverse contrast potential Vr is held only when the abnormal image is generated due to the abnormal discharge. Therefore, it is possible to minimize the influence of a reduction in the reverse contrast potential Vr.

As described above, moreover, the apparatus body may be provided with sensors for detecting information about a lifetime such as the number of used sheets and information about an environment such as a temperature and humidity and an air pressure which are the fluctuation factors of the threshold Vth of the generation of the abnormal discharge with the potential difference Vdt between the non-image portion potential Vd and the primary transfer bias potential Vt1, and thus, the normal mode and the abnormal discharge countermeasure mode may be switched based on data transmitted from each of the sensors.

Furthermore, it has been found that a transfer current flows in a large amount when the abnormal discharge is generated in the primary transfer portion of the intermediate transfer belt 36 having the multilayer structure including the conductive layer and the image carrier 10. By detecting a change in a transfer current value, accordingly, it is possible to detect the generation of the abnormal discharge. Consequently, the change in the transfer current value may be detected to switch the normal mode and the abnormal discharge countermeasure mode.

Table 5 shows the result of an experiment in the image forming apparatus according to the seventh embodiment of the invention.

this embodiment will be denoted by the same reference numerals of the seventh embodiment, and a detailed description thereof will be omitted. In this embodiment, the image forming apparatus includes a control unit for holding the potential difference between the developing bias potential Vb and the grid bias potential Vg having the functional relation with the non-image portion potential Vd on the image carrier 10, that is, the reverse contrast potential Vr to be constant, and furthermore, forming a halftone toner image as a patch image while setting and changing an image density control factor to influence the image density of a toner image in a multistage, and optimizing the image density control factor based on the result of the detection of the image density of the patch image which is obtained by a density detecting unit, thereby controlling the image density of a toner image formed by the developing unit. In a developing bias optimization processing in the optimization of the image density control factor, for example, the developing bias potential Vb is changed and set in a multistage to form the patch image in a state in which the absolute values of an exposure energy and a non-image portion potential are fixed to be maximum values within a variable range thereof. When the absolute value of the grid bias

TABLE 5

| Vb (Development) | Vd (Grid potential) | Vr (=IVb − VdI) | Vt1 (Primary transfer) | Vdt (=IVd − Vt1I) | Presence of abnormal discharge, (No, Yes) | Fine line density | Amount of scattering | Remark |
|---|---|---|---|---|---|---|---|---|
| | | | NG example | | | | | |
| −100 | −500 | −400 | 300 | 800 | No | Normal | Normal | |
| −150 | −550 | −400 | 300 | 850 | No | Normal | Normal | |
| −200 | −600 | −400 | 300 | 900 | No | Normal | Normal | |
| −250 | −650 | −400 | 300 | 950 | No | Normal | Normal | |
| −300 | −700 | −400 | 300 | 1000 | No | Normal | Normal | |
| −350 | −750 | −400 | 300 | 1050 | Yes | Normal | Normal | |
| −400 | −800 | −400 | 300 | 1100 | Yes | Normal | Normal | |
| In the case in which a discharge threshold is 1000 V | | | | | | | | |
| Contribute to a fine line density | | | | | | | | |
| | | | Example of countermeasure | | | | | |
| −100 | −500 | −400 | 300 | 800 | No | Normal | Normal | |
| −150 | −550 | −400 | 300 | 850 | No | Normal | Normal | |
| −200 | −600 | −400 | 300 | 900 | No | Normal | Normal | |
| −250 | −650 | −400 | 300 | 950 | No | Normal | Normal | |
| −300 | −700 | −400 | 300 | 1000 | No | Normal | Normal | |
| −350 | −700 | −350 | 300 | 1000 | No | Slightly high | Slightly large | Regulated with exposure power |
| −400 | −700 | −300 | 300 | 1000 | No | Slightly high | Slightly large | Regulated with exposure power |

In the case in which a discharge threshold is 1000 V

As is apparent from the result of an experiment shown in the Table 5, the potential difference Vdt between the non-image portion potential Vd and the primary transfer bias potential Vt1 can be caused to be equal to or smaller than the threshold Vth of the generation of the abnormal discharge and an abnormal image can be prevented from being generated due to an abnormal discharge by setting the control region ΔVb2 for decreasing the reverse contrast potential Vr in the abnormal discharge countermeasure mode in the region in which the abnormal image is generated due to the abnormal discharge.

Next, a eighth embodiment will be described with reference to drawings. Hence, the identical parts and portions of potential Vg having the functional relation with the non-image portion potential Vd is maximized, the reverse contrast potential Vr=|Vb−Vg| is maximized also in any developing bias potential Vb so that the toner scattering in the apparatus can be minimized. With such a structure, the potential difference between the developing bias potential Vb and the grid bias potential Vg having the functional relation with the non-image portion potential Vd, that is, the reverse contrast potential Vr is held to be constant when the halftone toner image is to be formed as the patch image. Therefore, it is possible to form such a patch image on the condition that the very small dot and the fine line to be used for obtaining a halftone have an excellent reproducibility. Consequently, it is possible to carry out the processing of optimizing the image density control factor with high precision based on the image density of the patch image. As a result, it is possible to stably form a toner image of high picture quality. By maintaining the reverse contrast potential Vr to have a proper value, furthermore, it is also possible to effectively suppress the toner scattering into the apparatus as described above. In order to stably form a toner image on a low density side, particularly, it is desirable to use a patch image having a dot area ratio to the whole patch image of 20% or less.

In order to prevent a deterioration in an image from being caused by a contamination or aging due to a toner in the corona charger 11 including the back plate 22, the discharge electrode 23 and the grid electrode 24, moreover, a charge current is increased stepwise depending on the contamination of the corona charger 11 based on information about a lifetime such as the number of times of use so that the deterioration in the image is prevented, and at the same time, the lifetime of the corona charger 11 is increased.

In the image forming apparatus using the intermediate transfer belt 36 having the multilayer structure including the conductive layer 36*a* and the resistive layer 36*b*, as shown in FIG. 5, in some cases in which a potential difference Vdt=|Vd−Vt1| between the non-image portion potential Vd on the image carrier (photosensitive member) 10 and the primary transfer bias potential Vt1 is increased, an abnormal image is generated partially or wholly due to an abnormal discharge in the primary transfer portion. This phenomenon is particularly remarkable over a half image.

Figure 32A:
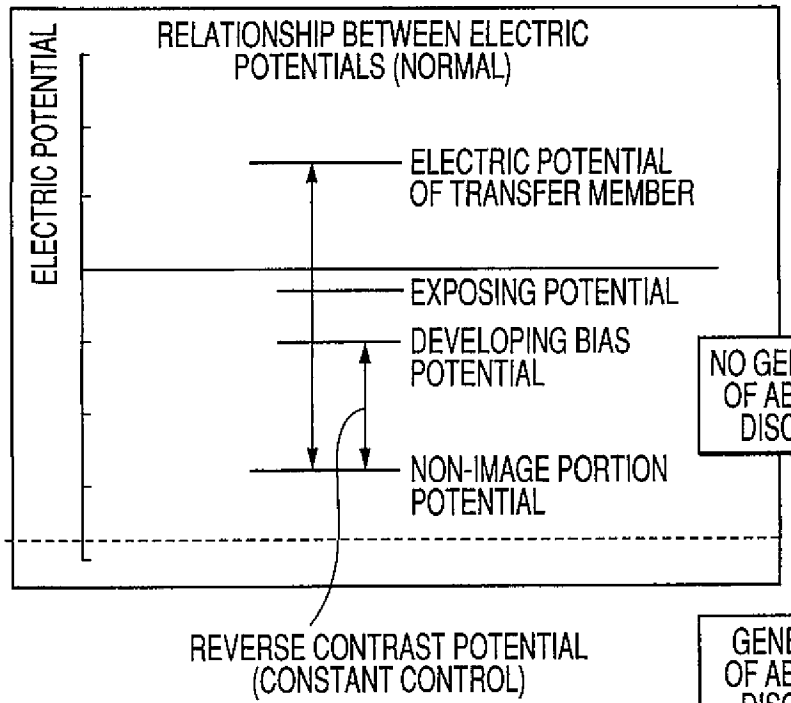
FIGS. 32A and 32B are diagrams showing a relationship between electric potentials in a normal state and a state in which an abnormal discharge is generated.
Figure 32B:
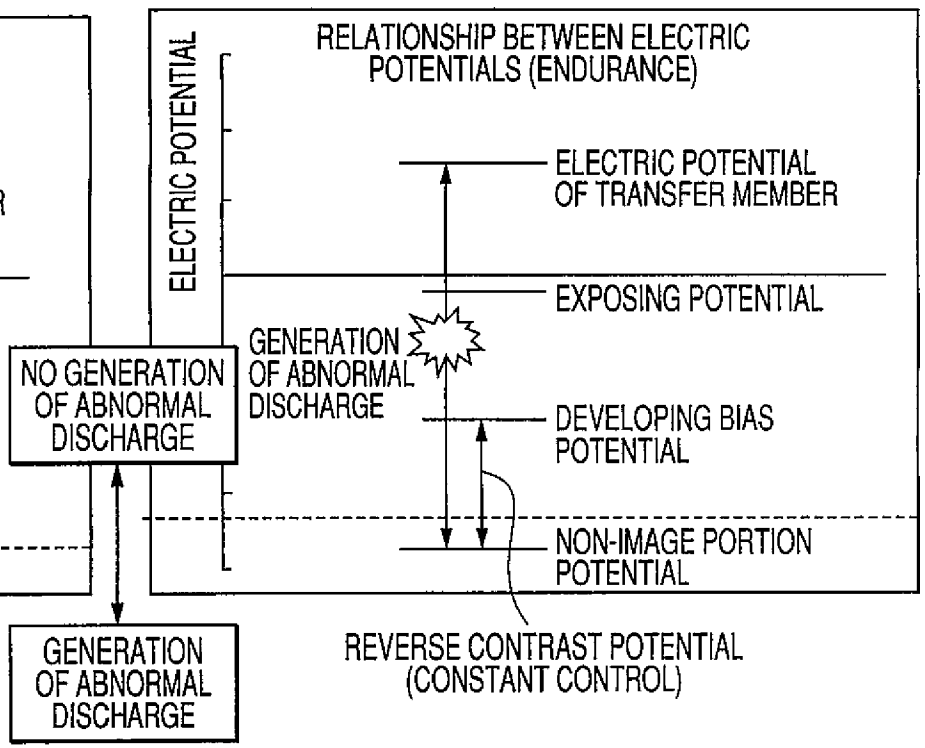

A mechanism for generating the phenomenon will be described based on a relationship between electric potentials shown in FIGS. 32A and 32B. FIG. 32A shows a relationship between electric potentials in a normal mode, and a primary transfer is carried out while the reverse contrast potential Vr to be the difference between the developing bias potential Vb and the non-image portion potential Vd is held to be constant. The potential difference Vdt=|Vd−Vt1| between the non-image portion potential Vd and the primary transfer bias potential Vt1 is equal to or smaller than a threshold Vth of the generation of an abnormal discharge. Therefore, an abnormal image can be prevented from being generated due to the abnormal discharge. FIG. 32B shows the relationship between the electric potentials in a state in which the abnormal discharge is generated. In this case, when the primary transfer is carried out while the reverse contrast potential Vr to be the difference between the developing bias potential Vb and the grid bias potential Vg having the functional relation with the non-image portion potential Vd is held to be constant, the thickness of the photosensitive layer of the image carrier is decreased and the threshold of the generation of the abnormal discharge is reduced, and furthermore, a developing property (a flying property) is deteriorated after a large number of sheets are printed. Consequently, it is necessary to set the developing bias potential Vb to be high. The developing bias potential Vb is set to be high so that it is necessary to hold the reverse bias potential Vr to be constant. Consequently, the non-image portion potential Vd is also set to be high and the potential difference Vdt=|Vd−Vt1| between the non-image portion potential Vd and the primary transfer bias potential Vt1 exceeds the threshold Vth of the generation of the abnormal discharge so that an abnormal image is generated due to the abnormal discharge.

Figure 33A:
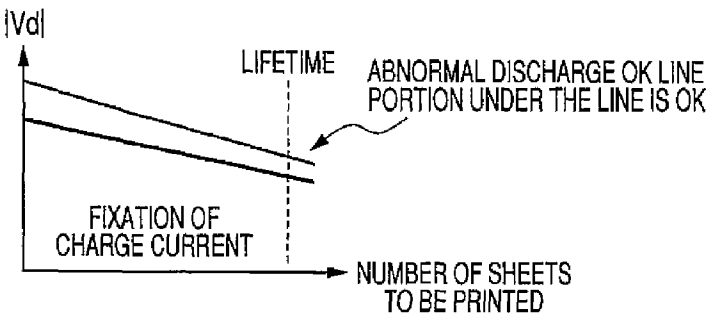
FIGS. 33A and 33B are charts showing a change in a non-image portion potential in the case in which a charge current is fixed by a corona charger and the case in which the charge current is increased stepwise.
Figure 33B:
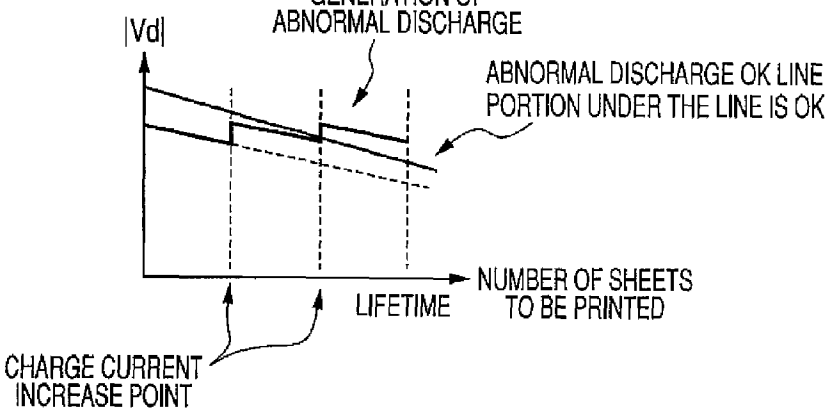

Furthermore, FIGS. 33A and 33B show a change in the non-image portion potential Vd and the state of the generation of the abnormal discharge in the case in which the charge current is fixed by the corona charger 11 and the case in which the charge current is increased stepwise. As shown in FIG. 33A, in the case in which the charge current is fixed, the corona charger 11 is contaminated with a toner so that the non-image portion potential Vd is also decreased and the potential difference Vdt=|Vd−Vt1| between the non-image portion potential Vd and the primary transfer bias potential Vt1 is equal to or smaller than the threshold Vth of the generation of the abnormal discharge when the number of sheets to be printed is increased. Therefore, the abnormal image is not generated due to the abnormal discharge. Since the non-image portion potential Vd is decreased, however, a deterioration in an image is generated. When the charge current is increased stepwise corresponding to the number of sheets to be printed and the non-image portion potential Vd is increased stepwise as shown in FIG. 33B in order to prevent the deterioration in an image, the potential difference Vdt=|Vd−Vt1| between the non-image portion potential Vd and the primary transfer bias potential Vt1 exceeds the threshold Vth of the generation of the abnormal discharge in a certain stage. Consequently, the abnormal image is generated due to the abnormal discharge.

Figure 34:
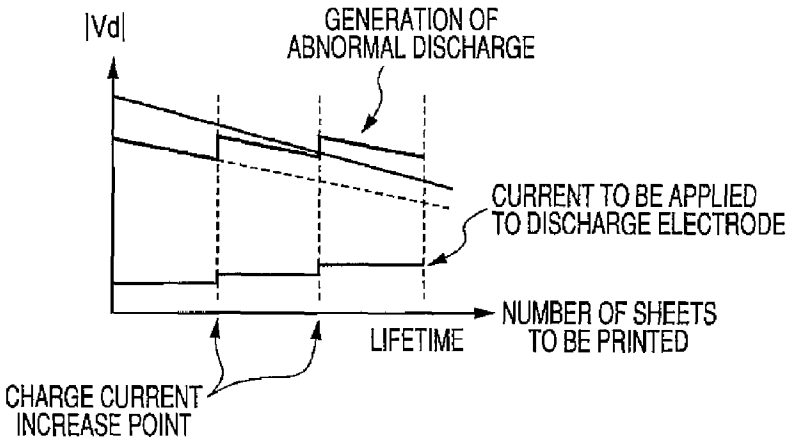
FIG. 34 is a chart showing a relationship between the stepwise increase in the charge current of the corona charger and the non-image portion potential.

For preventing the generation of the abnormal image due to the abnormal discharge, the control unit of the image forming apparatus according to the invention increases a discharge current to be applied to the discharge electrode 23 stepwise corresponding to the number of sheets to be printed in the corona charger 11 and decreases the non-image portion potential Vd to be increased with a stepwise increase in a discharge current in a dotted line as shown in FIG. 34. For this reason, the grid bias potential Vg having the functional relation with the non-image portion potential Vd is decreased and the potential difference Vdt=|Vd−Vt1| between the non-image portion potential Vd and the primary transfer bias potential Vt1 is set to be equal to or smaller than the threshold Vth of the generation of the abnormal discharge. The decrease in the non-image portion potential Vd is linked with the deterioration in the image. As a countermeasure, therefore, the discharge time is prolonged corresponding to the decrease in the grid bias potential Vg, thereby preventing the deterioration in an image.

Figure 35:
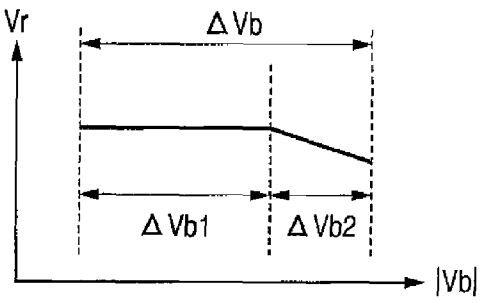
FIG. 35 is a chart for explaining two control regions in an abnormal discharge countermeasure mode according to a eighth embodiment of the invention.

Moreover, the control unit of the image forming apparatus according to the invention has an abnormal discharge countermeasure mode as shown in FIG. 35 in order to set the potential difference Vdt=|Vd−Vt1| between the non-image portion potential Vd and the primary transfer bias potential Vt1 to be equal to or smaller than the threshold Vth of the generation of the abnormal discharge. The abnormal discharge countermeasure mode sets a control region ΔVb1 for holding the reverse contrast potential Vr to be the difference between the developing bias potential Vb and the grid bias potential Vg having the functional relation with the non-image portion potential Vd to be constant and a control region ΔVb2 for decreasing the reverse contrast potential Vr to be the difference between the developing bias potential Vb and the grid bias potential Vg having the functional relation with the non-image portion potential Vd. In other words, in the control region ΔVb1 in the normal state in which the abnormal image is not generated due to the abnormal discharge, the reverse contrast potential Vr is held to be constant and a toner image of high picture quality is stably formed, and furthermore, the toner scattering into the apparatus is also suppressed effectively. In the control region ΔVb2 in the case in which the abnormal image might be generated due to the abnormal discharge or is generated due to the abnormal discharge, a control is carried out in such a direction that the primary transfer bias potential Vt1 is exactly maintained and the reverse contrast potential Vr is decreased in order to cause the potential difference Vdt between the non-image portion potential Vd and the primary transfer bias potential Vt1 to be equal to or smaller than the threshold Vth of the generation of the abnormal discharge. In other words, even if the developing bias potential Vb is set to be high in order to maintain the developing property, the control is carried out to cause the grid bias potential Vg having the functional relation with the non-image portion potential Vd to be equal to or smaller than the threshold Vth of the generation of the abnormal discharge so that the abnormal image can be prevented from being generated due to the abnormal discharge.

Figures 36A, 36B:
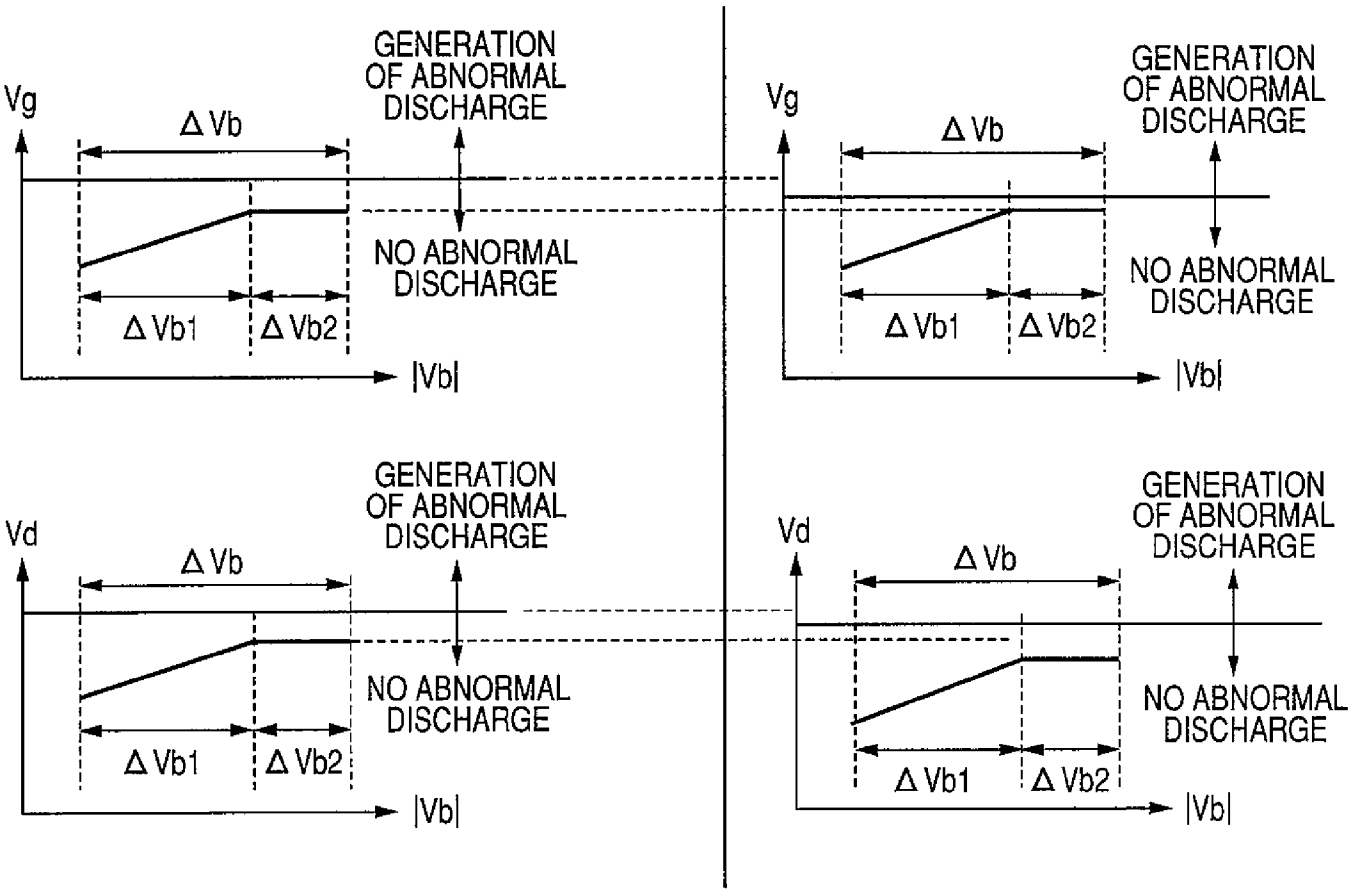
FIGS. 36A and 36B are charts for explaining the two control regions in the abnormal discharge countermeasure mode.

FIGS. 36A and 36B show states brought at the early stage of the use of the apparatus in the two control regions ΔVb1 and ΔVb2 and after the endurance of the apparatus in the abnormal discharge countermeasure mode. Assuming that the grid bias potential Vg is equal to the non-image portion potential Vd at the early stage of the use of the apparatus in FIG. 36A, the thickness of the photosensitive layer of the image carrier is decreased, an abnormal discharge start voltage is dropped and |Vd| is also reduced after the endurance of the apparatus in FIG. 36B.

Figure 37:
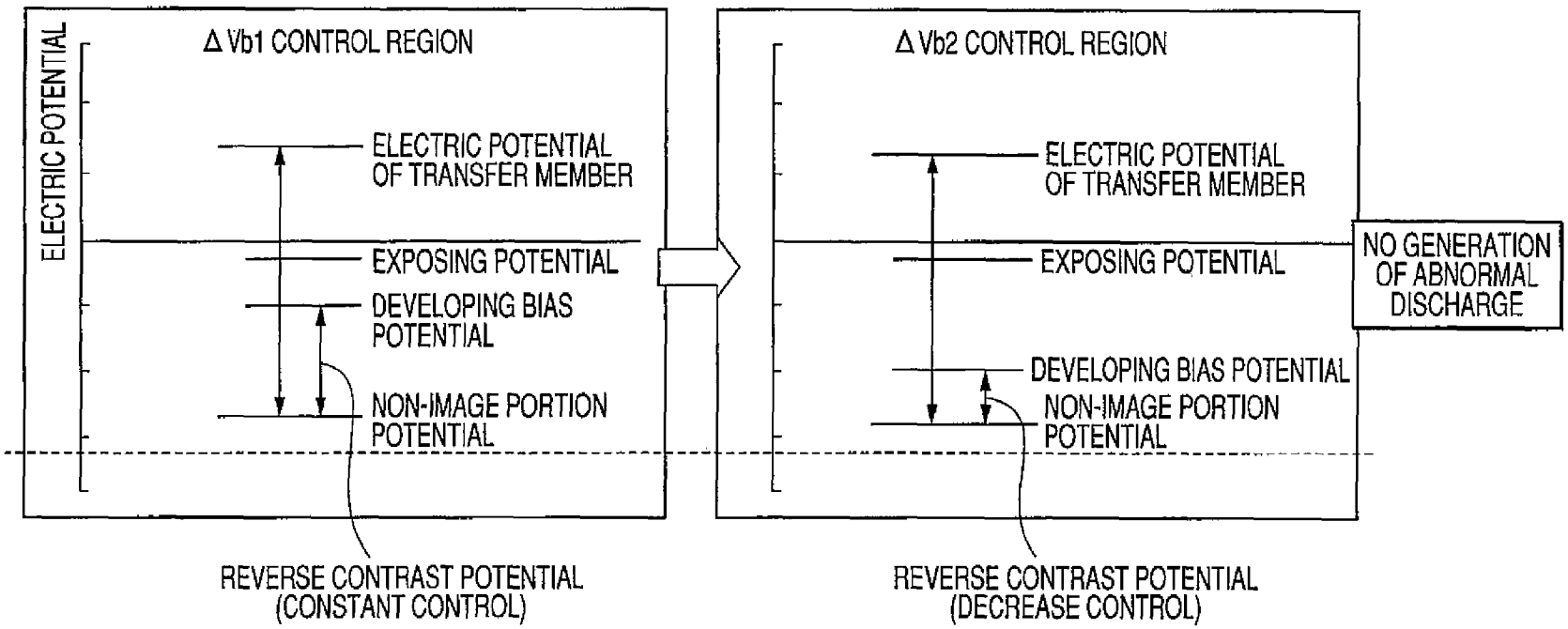
FIG. 37 is a diagram showing a relationship between electric potentials in the two control regions in the abnormal discharge countermeasure mode.

FIG. 37 shows a relationship between electric potentials in the two control regions ΔVb1 and ΔVb2 in the abnormal discharge countermeasure mode. In the control region ΔVb2, the primary transfer bias potential Vt1 is maintained to be constant, and furthermore, the grid bias potential Vg having the functional relation with the non-image portion potential Vd is controlled. Even if the developing bias potential Vb is set to be high, the reverse contrast potential Vr is decreased. However, the potential difference Vdt between the non-image portion potential Vd and the primary transfer bias potential Vt1 can be held to be equal to or smaller than the threshold Vth of the generation of the abnormal discharge. Consequently, it is possible to prevent an abnormal image from being generated due to an abnormal discharge.

The normal mode and the abnormal discharge countermeasure mode can be switched by the operation of a control panel provided in the apparatus body. Consequently, the control region ΔVb2 for decreasing the reverse contrast potential Vr is switched only when the abnormal image is generated due to the abnormal discharge. Therefore, it is possible to minimize the influence of a reduction in the reverse contrast potential Vr.

As described above, moreover, the apparatus body may be provided with sensors for detecting information about a lifetime such as the number of used sheets and information about an environment such as a temperature and humidity and an air pressure which are the fluctuation factors of the threshold Vth of the generation of the abnormal discharge with the potential difference Vdt between the non-image portion potential Vd and the primary transfer bias potential Vt1, and thus, the normal mode and the abnormal discharge countermeasure mode may be switched based on data transmitted from each of the sensors.

Furthermore, it has been found that a transfer current flows in a large amount when the abnormal discharge is generated in the primary transfer portion of the intermediate transfer belt 36 having the multilayer structure including the conductive layer and the image carrier 10. By detecting a change in a transfer current value, accordingly, it is possible to detect the generation of the abnormal discharge. Consequently, the change in the transfer current value may be detected to switch the normal mode and the abnormal discharge countermeasure mode.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

What is claimed is:

1. An image forming apparatus comprising:

an image carrier;

a charging unit configured to charge the image carrier;

an exposing unit configured to form an electrostatic latent image on the charged image carrier;

a developing unit configured to develop the electrostatic latent image formed on the image carrier with a development material for forming a development image;

an intermediate transfer member that includes a multilayer structure having a conductive layer;

a transfer unit configured to transfer the development image on the intermediate transfer member; and a control unit that controls a transfer potential and a charging potential so that a potential difference between the transfer potential and a non-image portion potential on the image carrier in a transfer position falls within a predetermined range, wherein the control unit performs a normal mode and an abnormal discharge countermeasure mode;

wherein a reverse contrast potential is controlled so as to become constant within a variable range of a developing bias potential in the normal mode;

wherein the reverse contrast potential is decreased within the variable range of the developing bias potential in the abnormal discharge countermeasure mode; and wherein the reverse contrast potential is defined as an absolute value of a potential difference between the developing bias potential and the non-image portion potential.

2. The image forming apparatus as set forth in claim 1, wherein the control unit controls the charging potential so as to fix the non-image portion potential in the abnormal discharge countermeasure mode.

3. The image forming apparatus as set forth in claim 1, wherein the control unit switches the normal mode and the abnormal discharge countermeasure mode.

4. The image forming apparatus as set forth in claim 3, further comprising an apparatus body that has a user interface, wherein the normal mode and the abnormal discharge countermeasure mode are switched in accordance with an operation through the user interface.

5. The image forming apparatus as set forth in claim 3, wherein the control unit switches the normal mode and the abnormal discharge countermeasure mode based on at least one of life time information about a lifetime of an image forming operation including a number of used sheets set in an apparatus body and information about environment of an air pressure, a temperature or humidity.

6. The image forming apparatus as set forth in claim 1, further comprising a toner density detecting unit that detects a toner density of a patch image on at least one of the image carrier and the intermediate transfer member, wherein the control unit performs the normal mode and the abnormal discharge countermeasure mode based on the toner density detected by the toner density detecting unit.

7. The image forming apparatus as set forth in claim 6, wherein the control unit controls the charging potential so as to fix the non-image portion potential Vd in the abnormal discharge countermeasure mode.

8. The image forming apparatus as set forth in claim 6, wherein the toner density detecting unit compares a first density of a patch image having a low density formed after a high density image with a second density of a patch image having a low density formed after a medium density image; and wherein the control unit performs the abnormal discharge countermeasure mode when a difference between the first density and the second density detected by the toner density detecting unit is greater than a threshold value.

9. The image forming apparatus as set forth in claim 6, further comprising an apparatus body that has a user interface, wherein the normal mode and the abnormal discharge countermeasure mode are switched in accordance with an operation through the user interface.

10. The image forming apparatus as set forth in claim 6, wherein the control unit switches the normal mode and the abnormal discharge countermeasure mode based on at least one of life time information about a lifetime of an image forming operation including a number of used sheets set in an apparatus body and information about environment of an air pressure, a temperature or humidity.

11. The image forming apparatus as set forth in claim 1, further comprising a toner density detecting unit that detects a toner density of a patch image on at least one of the image carrier and the intermediate transfer member, wherein the control unit controls an image density control factor including at least the developing bias potential for applying to the developing unit in accordance with the toner density detected by the toner density detecting unit;

wherein the control unit forms a patch image while varying the image density control factor;

wherein the control unit measures an abnormal discharge voltage based on the toner density detected by the toner density detecting unit;

wherein the control unit performs the normal mode when the abnormal discharge voltage is not measured; and wherein the control unit performs the abnormal discharge countermeasure mode when the abnormal discharge voltage is measured.

12. The image forming apparatus as set forth in claim 11, wherein the control unit controls the charging potential so as to fix the non-image portion potential in the abnormal discharge countermeasure mode.

13. The image forming apparatus as set forth in claim 11, wherein the toner density detecting unit compares a first density of a patch image having a low density formed after a high density image with a second density of a patch image having a low density formed after a medium density image; and wherein the control unit performs the abnormal discharge countermeasure mode when a difference between the first density and the second density detected by the toner density detecting unit is greater than a threshold value.

14. The image forming apparatus as set forth in claim 11, further comprising an apparatus body that has a user interface, wherein the normal mode and the abnormal discharge countermeasure mode are switched in accordance with an operation through the user interface.

15. The image forming apparatus as set forth in claim 11, wherein the control unit switches the normal mode and the abnormal discharge countermeasure mode based on at least one of life time information about a lifetime of an image forming operation including a number of used sheets set in an apparatus body and information about environment of an air pressure, a temperature or humidity.

16. The image forming apparatus as set forth in claim 1, further comprising a transfer current detecting unit that detects a transfer current, wherein the control unit performs the normal mode and the abnormal discharge countermeasure mode based on at least one of a value of the transfer current and a change in the value of the transfer current detected by the transfer current detecting unit.

17. The image forming apparatus as set forth in claim 16, wherein the control unit switches the normal mode and the abnormal discharge countermeasure mode based on the transfer current in a transfer of a half image which is detected by the transfer current detecting unit.

18. The image forming apparatus as set forth in claim 16, further comprising a toner density detecting unit that detects a toner density of a patch image on at least one of the image carrier and the intermediate transfer member, wherein the control unit switches the normal mode and the abnormal discharge countermeasure mode based on the toner density detected by the toner density detecting unit.

19. The image forming apparatus as set forth in claim 18, wherein the toner density detecting unit compares a first density of a patch image having a low density formed after a high density image with a second density of a patch image having a low density formed after a medium density image; and wherein the control unit performs the abnormal discharge countermeasure mode when a difference between the first density and the second density detected by the toner density detecting unit is greater than a threshold value.

20. The image forming apparatus as set forth in claim 16, wherein the control unit controls the charging potential so as to fix the non-image portion potential in the abnormal discharge countermeasure mode.

21. The image forming apparatus as set forth in claim 16, further comprising an apparatus body that has a user interface, wherein the control unit switches the normal mode and the abnormal discharge countermeasure mode in accordance with an operation through the user interface.

22. The image forming apparatus as set forth in claim 16, wherein the control unit switches the normal mode and the abnormal discharge countermeasure mode based on at least one of life time information about a lifetime of an image forming operation including a number of used sheets set in an apparatus body and information about environment of an air pressure, a temperature or humidity.

23. An image forming apparatus comprising:

an image carrier;

a charging unit configured to charge the image carrier;

an exposing unit configured to form an electrostatic latent image on the charged image carrier;

a developing unit configured to develop the electrostatic latent image formed on the image carrier with a development material for forming a development image;

an intermediate transfer member that includes a multilayer structure having a conductive layer;

a transfer unit configured to transfer the development image on the intermediate transfer member; and a control unit that controls a transfer potential and a charging potential so that a potential difference between the transfer potential and a non-image portion potential on the image carrier in a transfer position falls within a predetermined range, wherein the control unit performs a normal mode and an abnormal discharge countermeasure mode;

wherein the transfer potential is controlled so as to become constant within a variable range of a developing bias potential in the normal mode;

wherein the transfer potential is decreased within the variable range of the developing bias potential in the abnormal discharge countermeasure mode.

24. The image forming apparatus as set forth in claim 23, wherein the control unit controls a reverse contrast potential so as to become constant within a variable range of a developing bias potential in the normal mode and the abnormal discharge countermeasure mode; and wherein the reverse contrast potential is defined as an absolute value of a potential difference between the developing bias potential and the non-image portion potential.

25. The image forming apparatus as set forth in claim 24, wherein the control unit switches the normal mode and the abnormal discharge countermeasure mode.

26. The image forming apparatus as set forth in claim 25, further comprising an apparatus body that has a user interface, wherein the normal mode and the abnormal discharge countermeasure mode are switched in accordance with an operation through the user interface.

27. The image forming apparatus as set forth in claim 25, wherein the control unit switches the normal mode and the abnormal discharge countermeasure mode based on at least one of life time information about a lifetime of an image forming operation including a number of used sheets set in an apparatus body and information about environment of an air pressure, a temperature or humidity.

28. An image forming apparatus comprising:

an image carrier;

a charging unit configured to charge the image carrier;

an exposing unit configured to form an electrostatic latent image on the charged image carrier;

a developing unit configured to develop the electrostatic latent image formed on the image carrier with a development material for forming a development image;

an intermediate transfer member that includes a multilayer structure having a conductive layer;

a transfer unit configured to transfer the development image on the intermediate transfer member; and a control unit that controls a transfer potential and a charging potential so that a potential difference between the transfer potential and a non-image portion potential on the image carrier in a transfer position falls within a predetermined range, wherein the charging unit is a corona charging unit;

wherein the corona charging unit includes a discharge electrode, a back plate and a grid electrode;

wherein the control unit controls an image density control factor including at least the developing bias potential for applying to the developing unit; and wherein the control unit controls the transfer potential and a grid bias potential so that a potential difference between the transfer potential and a non-image portion potential on the image carrier in a transfer position falls within a predetermined range.

29. The image forming apparatus as set forth in claim 28, wherein the control unit performs a normal mode and an abnormal discharge countermeasure mode;

wherein a reverse contrast potential is controlled so as to become constant within a variable range of a developing bias potential in the normal mode;

wherein the reverse contrast potential is decreased within the variable range of the developing bias potential in the abnormal discharge countermeasure mode; and wherein the reverse contrast potential is defined as an absolute value of a potential difference between the developing bias potential and the grid bias potential.

30. The image forming apparatus as set forth in claim 29, wherein the control unit controls the corona charging unit so as to fix the grid bias potential in the abnormal discharge countermeasure mode.

31. The image forming apparatus as set forth in claim 29, wherein the control unit switches the normal mode and the abnormal discharge countermeasure mode.

32. The image forming apparatus as set forth in claim 31, further comprising an apparatus body that has a user interface, wherein the normal mode and the abnormal discharge countermeasure mode are switched in accordance with an operation through the user interface.

33. The image forming apparatus as set forth in claim 31, wherein the control unit switches the normal mode and the abnormal discharge countermeasure mode based on at least one of life time information about a lifetime of an image forming operation including a number of used sheets set in an apparatus body and information about environment of an air pressure, a temperature or humidity.

34. The image forming apparatus as set forth in claim 28, wherein the control unit controls the transfer potential, the grid bias potential and a discharge current applied to the discharge electrode of the corona charging unit so that the potential difference between the transfer potential and the non-image portion potential on the image carrier in a transfer position falls within the predetermined range.

35. The image forming apparatus as set forth in claim 34, wherein the control unit increase increases a discharge current value and a discharge time of the discharge current and also decreases the grid bias potential based on lifetime information about a lifetime of an image forming operation including a number of used sheets.

36. The image forming apparatus as set forth in claim 34, wherein the control unit performs a normal mode and an abnormal discharge countermeasure mode;

wherein a reverse contrast potential is controlled so as to become constant within a variable range of a developing bias potential in the normal mode;

wherein the reverse contrast potential is decreased within the variable range of the developing bias potential in the abnormal discharge countermeasure mode; and wherein the reverse contrast potential is defined as an absolute value of a potential difference between the developing bias potential and the grid bias potential.

37. The image forming apparatus as set forth in claim 36, wherein the control unit switches the normal mode and the abnormal discharge countermeasure mode.

38. The image forming apparatus as set forth in claim 37, further comprising an apparatus body that has a user interface, wherein the normal mode and the abnormal discharge countermeasure mode are switched in accordance with an operation through the user interface.

39. The image forming apparatus as set forth in claim 37, wherein the control unit switches the normal mode and the abnormal discharge countermeasure mode based on at least one of life time information about a lifetime of an image forming operation including a number of used sheets set in an apparatus body and information about environment of an air pressure, a temperature or humidity.

40. An image forming method, comprising:

applying a charging bias to a charging unit to charge a surface of an image carrier;

exposing the charged surface of the image carrier to form an electrostatic latent image on the image carrier;

applying a developing bias to a developing unit to develop the electrostatic latent image with a development material for forming a development image;

applying a transfer bias to transfer the development image on the surface of the image carrier to an intermediate transfer member including a multilayer structure having a conductive layer;

controlling a transfer potential and a charging potential so that a potential difference between the transfer potential and a non-image portion potential on the image carrier in a transfer position falls within a predetermined range;

performing a normal mode and an abnormal discharge countermeasure mode;

controlling a reverse contrast potential so as to become constant within a variable range of a developing bias potential in the normal mode; and decreasing the reverse contrast potential within the variable range of the developing bias potential in the abnormal discharge countermeasure mode, wherein the reverse contrast potential is defined as an absolute value of a potential difference between the developing bias potential and the non-image portion potential.

41. The image forming method as set forth in claim 40, further comprising a process of detecting a toner density of a patch image on at least one of the image carrier and the intermediate transfer member, wherein the normal mode and the abnormal discharge countermeasure mode are performed in the control process based on the toner density detected by the toner density detecting process.

42. The image forming method as set forth in claim 40, wherein the charging unit is a corona charging unit;

wherein in the applying process of the charge bias, a grid bias potential is applied to a grid electrode of the corona charging unit; and wherein in the control process, the transfer potential and a grid bias potential are controlled so that a potential difference between the transfer potential and the non-image portion potential on the image carrier in the transfer position falls within a predetermined range.

43. The image forming method as set forth in claim 40, wherein the charging unit is a corona charging unit;

wherein in the applying process of the charge bias, a discharging current is applied to a discharge electrode of the corona charging unit, and also a grid bias potential is applied to a grid electrode of the corona charging unit; and wherein in the control process, the transfer potential, the grid bias potential and the discharging current are controlled so that a potential difference between the transfer potential and the non-image portion potential on the image carrier in the transfer position falls within a predetermined range.

44. An image forming method comprising:

applying a charging bias to a charging unit to charge a surface of an image carrier;

exposing the charged surface of the image carrier to form an electrostatic latent image on the image carrier;

applying a developing bias to a developing unit to develop the electrostatic latent image with a development material for forming a development image;

applying a transfer bias to transfer the development image on the surface of the image carrier to an intermediate transfer member including a multilayer structure having a conductive layer; and controlling a transfer potential and a charging potential so that a potential difference between the transfer potential and a non-image portion potential on the image carrier in a transfer position falls within a predetermined range, wherein in the control process, a normal mode and an abnormal discharge countermeasure mode are performed;

wherein the transfer potential is controlled so as to become constant while a reverse contrast potential is maintained in constant within a variable range of a developing bias potential in the normal mode;

wherein the transfer potential is decreased within the variable range of the developing bias potential in the abnormal discharge countermeasure mode; and wherein the reverse contrast potential is defined as an absolute value of a potential difference between the developing bias potential and the non-image portion potential.

45. An image forming method comprising:

applying a charging bias to a charging unit to charge a surface of an image carrier;

exposing the charged surface of the image carrier to form an electrostatic latent image on the image carrier;

applying a developing bias to a developing unit to develop the electrostatic latent image with a development material for forming a development image;

applying a transfer bias to transfer the development image on the surface of the image carrier to an intermediate transfer member including a multilayer structure having a conductive layer;

controlling a transfer potential and a charging potential so that a potential difference between the transfer potential and a non-image portion potential on the image carrier in a transfer position falls within a predetermined range; and a process of detecting a transfer current, wherein in the control process, a normal mode and an abnormal discharge countermeasure mode are performed based on at least one of a value of the transfer current and a change in the value of the transfer current detected by the transfer current detecting process.

* * * * *